US005826131A

United States Patent [19]

Tsuji et al.

[11] Patent Number: 5,826,131

[45] Date of Patent: Oct. 20, 1998

[54] DEVELOPMENT PROCESSING APPARATUS

[75] Inventors: Osami Tsuji; Toshio Kurokawa; Hideaki Nomura, all of Kanagawa, Japan

[73] Assignee: Fuji Photo Film Co., Ltd., Kanagawa, Japan

[21] Appl. No.: 998,058

[22] Filed: Dec. 24, 1997

[30] Foreign Application Priority Data

| | | | |
|---|---|---|---|
| Dec. 26, 1996 | [JP] | Japan | 8-349095 |
| Jun. 30, 1997 | [JP] | Japan | 9-174998 |
| Jun. 30, 1997 | [JP] | Japan | 9-175000 |

[51] Int. Cl.[6] ..... G03D 3/13

[52] U.S. Cl. ..... 396/613; 396/612; 396/617; 396/620

[58] Field of Search ..... 396/594, 598, 396/599, 600, 617, 620, 613, 603, 612

[56] References Cited

U.S. PATENT DOCUMENTS

| | | | |
|---|---|---|---|
| 4,949,114 | 8/1990 | Combet et al. | 396/599 |
| 5,495,311 | 2/1996 | Lant et al. | 396/594 |
| 5,555,066 | 9/1996 | Benker | 396/613 |
| 5,713,054 | 1/1998 | Shimamura et al. | 396/612 |

FOREIGN PATENT DOCUMENTS

| | | |
|---|---|---|
| 9211826 | 8/1997 | Japan . |
| 9292688 | 11/1997 | Japan . |

*Primary Examiner*—A. A. Mathews

*Attorney, Agent, or Firm*—Sughrue, Mion, Zinn, Macpeak & Seas, PLLC

[57] ABSTRACT

A photosensitive material processing apparatus is provided with a loading section for loading therein a film container accommodating a film which is wound from one edge section in the longitudinal section thereof around a spool shaft with the edge section thereof in the longitudinal section separated from the spool shaft for development and also which is returned in the separated state to a customer, said film accommodated therein in the state of being wound around the spool shaft; a feeding device means for feeding the film into the loading section from another edge section of the film wound around the spool shaft and also retaining the film in the state where the former edge section of the film in the longitudinal direction is kept locked in the loading section; and a single processing tank for receiving a portion of the film fed out by the feeding means from the loading section and developing the film with a processing liquid. Therefore, it is not necessary to convey the film in a curved manner in the processing tank.

15 Claims, 73 Drawing Sheets

DEVELOPMENT PROCESSING APPARATUS

BACKGROUND OF THE INVENTION

1. Field of the Invention

The present invention relates to a photosensitive material processing apparatus which develops a film accommodated in a film accommodating container.

2. Description of the Related Art

Conventionally, 135-size negative films commonly used are removed from a spool shaft or are cut in a vicinity of a spool shaft, and are subjected to development processing while being conveyed by conveyor rollers or the like through a plurality of processing tanks.

A developed negative film is cut per a prespecified number of frames, which are returned as piece negatives to the customer.

In recent years, the APS (Advanced Photo System) has been proposed as a new system in which a developed negative film is returned to the customer as accommodated in a film accommodating container (cartridge) and without being cut.

In this APS, a negative film is taken out from a cartridge brought by a customer, and the negative film having been subjected to development processing is returned to the customer in the state where the negative film is accommodated in the cartridge.

In the processing with an automatic developing machine for negative films based con the conventional technology, it has been required to carry out complicated and troublesome works such as cutting a tip of a film and adhering the film to a dedicated leader conforming to a carrier device in a processing tank, or setting the leader with at a prespecified position on the automatic developing machine.

Further, a complicated mechanism for bending and transferring a leader with a negative film adhered thereon and a roller are required in the processing tank, and the processing tank has a complicated mechanism with a large capacity and required a large space and a large quantity of processing liquid.

As an automatic developing machine required a plurality of processing tanks to carry out various types of processing such as developing with colors, fixing/bleaching, ringing, a size of the machine becomes larger and a wider space is required for installation thereof. For this reason, the automatic developing machine can not be installed at a narrow space, which disadvantageously limits places for installation thereof.

In addition, a 135-size negative film assumed that it is cut before being subjected to development processing, and for this reason image frames are formed up to a vicinity of a point where a spool shaft for a negative shaft is stopped, namely up to a final edge of a negative film.

In a case of 135-size negative film, at first a section of the negative film near a tip thereof is withdrawn, and perforation of the negative film withdrawn from the cartridge set in a camera is required to be engaged with sprockets (gear teeth) of the camera, so that it is impossible to form images in a section extending by a certain length from its tip.

For this reason, when it is tried to develop a 135-size negative film with the final edge section being held with fingers, sometimes image frames in a section near the rear edge of the negative film may not be developed.

On the other hand, when the new system described above is applied to an automatic developing machine, a device for separating a negative film from a spool shaft of a cartridge, or a device for again setting the negative film having being subjected to development processing on the spool shaft is required, so that the machine becomes disadvantageously complicated and large-sized.

If it is possible to develop a negative film based on the APS system with a processor for developing a 135-size negative film, the cost becomes lower and also a required space becomes smaller as compared to a case where the processors are installed separately. However, configuration (including an outer form) of a 135-size film container is different from that an APD type of a film container based, and the two types of film container can not be set in a loading section of the same container.

SUMMARY OF THE INVENTION

It is an object of the present invention to provide a photosensitive material processing apparatus which can be installed even at a small space and also processes a film in a first film container and a film in a second film container with a common mechanism.

A photosensitive material processing apparatus of a first aspect comprises a loading section for loading therein a film container accommodating a film which is wound from one edge section in the longitudinal section thereof around a spool shaft with the edge section thereof in the longitudinal section separated from the spool shaft for development and also which is returned in the separated state to the customer, the film accommodated therein in the state of being wound around the spool shaft; a feeding means for feeding the film into the loading section from another edge section of the film wound around the spool shaft and also retaining the film in the state where the former edge section of the film in the longitudinal direction is kept locked in the loading section, and a single processing tank for receiving a portion of the film fed out by the feeding means from the loading section and developing the film with a processing liquid.

In the photosensitive material processing apparatus according to the first aspect, a film container with a film not having been subjected to development processing accommodated therein is set in the loading section. The film is wound up from the film container into the loading section, and is retained in the loading section. The feeding means feeds out the film wound up into the loading section to a processing tank in the state where an edge section thereof in the longitudinal direction is engaged therein. The film fed out from the loading section is inserted into the processing tank, and is processed with a processing solution in the processing tank.

With the photosensitive material processing apparatus according to this aspect, a film is wound up from the film container into the loading section and is retained in the loading section, and the film is inserted from the loading section into the processing tank for development processing, so that it is not necessary to transfer or convey the film in a bent form in the processing tank, and further such components as a transfer roller for transforming the film are not required, so that size of the processing tank can be reduced, which enables minimization of the photosensitive material processing apparatus as a whole.

Herein the film of the type which is wound around a spool shaft, subjected to development processing in the state where it has been separated from the spool shaft, and is returned to the customer in the state is a 135-size film for ordinarily photographing (35 mm rolled film) . It should be noted that, in such films as a 135-size film, sometimes a larger number of images may be photographed as compared to the standard number of images, and in that case an area not having been exposed to light becomes very small. Herein the term of "returning" means to cut a film having been developed per a prespecified number of frames in a development processing station or a processing laboratory and return cut pieces as piece negatives to the customer or the like.

In a second aspect of the present invention, a photosensitive material processing apparatus according to the first aspect has a processing solution supply unit for circulating, replacing, and discharging a processing solution in the processing tank.

In the photosensitive material processing apparatus according to the second aspect, the processing solution supply unit circulates a processing solution (such as a color-developing liquid, a fixing/bleaching liquid, a rinsing solution or the like), replaces the recessing solution (replaces, for instance, a color-developing solution with a fixing/bleaching liquid, or a fixing/bleaching solution with a rinsing liquid), and discharges the processing liquid.

With the photosensitive material processing apparatus according to the second aspect, a plurality types of processing such as color development, fixing/bleaching, and washing with water are carried out in a single processing tank, which eliminates the necessity of a plurality of processing tanks, and for this reason size of the machine is reduced, which makes it possible for the machine to be installed even at a small space.

A photosensitive material processing apparatus of a third aspect comprises a loading section for loading therein a film container accommodating a film which is wound from one edge section in the longitudinal section thereof around a spool shaft with the edge section thereof in the longitudinal section separated from the spool shaft for development and also which is returned in the separated state to the customer, the film accommodated therein in the state of being wound around the spool shaft; an intermediate spool shaft for retaining one edge section of the film in the longitudinal direction of the film withdrawn from the film container loaded in the loading section and also for winding up the film from the one edge section in the longitudinal direction thereof up to another edge section thereof from the film container; a cutting unit for cutting the another edge section of the film in the longitudinal direction thereof after the film accommodated in the film container have been wound up around the intermediate spool shaft up to the other edge section of the film in the longitudinal direction thereof; a feeding means for feeding out the film wound around the intermediate spool shaft from the other edge section of the film in the longitudinal direction thereof and also for retaining the film in the state where the one edge section of the film in the longitudinal direction thereof is locked on the intermediate spool shaft; and a single processing tank for accommodating therein a portion of the film fed out by the feeding unit from the loading section and developing the portion with a processing liquid.

In the photosensitive material processing apparatus according to the third aspect, a film accommodated in a film container loaded in a loading section is wound up around the intermediate spool shaft, and then the cutting unit cuts a rear edge section of the film. The other actions and effects are the same as those in the first aspect.

A photosensitive material processing apparatus of a fourth aspect comprises a first loading section for loading a first film container accommodating a film which is wound around a spool shaft from one edge section in the longitudinal direction thereof with the edge section in the longitudinal section thereof separated from the spool shaft for development and which is returned in the separated state to the customer, the film accommodated in the container in the state where the film is wound around the spool shaft, and also for winding up and holding the film from the first film container; a first feeding unit for feeding out the film wound around in the first loading section from the other edge section of the film in the longitudinal section thereof and holding the film in the state where the edge section of the film in the longitudinal direction thereof is locked in the first loading section; a second loading section having an insertion/passage port through which a lengthy film wound around a spool shaft is inserted or withdrawn therefrom and for loading therein a second film container accommodating therein the film which is returned to the customer in the state where the film has been wound around the spool shaft from one edge section of the film in the longitudinal direction thereof, the film accommodated there in the state where the film has been wound up around the spool shaft; a second feeding unit for feeding out the film, starting from the other edge section of the film in the longitudinal direction thereof, from inside of the second film container loaded in the second loading section and also for maintaining the state wherein the one edge section of the film in the longitudinal direction thereof is locked on the spool shaft; a signal processing tank having a film insertion port and for accommodating therein the film's portion fed out from the first loading section or second loading section and developing the film with a developing liquid; and a moving unit for moving the other edge section of the film wound into the first loading section in the longitudinal direction thereof to a position opposite to a film insertion port of the processing tank and also moving an insertion/passage port of the second film container loaded in the second loading section to the film insertion port of the processing tank.

In the photosensitive material developing apparatus according to the fourth aspect, a first film container is loaded in a first loading section. A film in said first film container loaded in the first loading section is wound into the first loading section. Then, the other edge section of the film wound into the first loading section in the longitudinal direction thereof is moved, for instance, but the moving unit to a position opposite to an film insertion port of the processing tank.

After this movement of the film, the film is fed out by the first feeding unit in the state where one edge section of the film wound into the first loading section is locked. It should be noted that, if the other edge of the film wound into the first loading section oppose to the film insertion port of the processing tank at the initial position, it is not necessary to move the first loading section with the moving unit.

Further the second film container is loaded in the second loading section. In the state where one edge section in the longitudinal direction thereof of the film wound around the spool shaft in the second film container is locked, the insertion/passage port of the second film container loaded in the second loading section is moved by the moving unit to a position opposite to the film insertion port of the processing tank, and the film is fed out by the second feeding unit. The film fed out by the feeding unit is developed in the processing tank.

With the photosensitive material processing apparatus according to the fourth aspect, there are provided a first loading section and a second loading section, so that a film in the first film container and that in the second film container can be developed with a shared photosensitive material processing apparatus, which eliminates the necessity of providing a plurality of photosensitive material processing units and also makes it possible to reduce cost and a space required for installation thereof.

Herein a film which is returned in the state where it has been wound around a spool shaft is a film having image positions previously fixed according to the perforation or the like, and a representative example of that type if film is the APS film. It should be noted that the term of "returning" means to return the second film container with the film having been wound around the spool shaft to the customer of the like.

A photosensitive material processing apparatus of a fifth aspect comprises a first loading section for loading a first film container accommodating a film which is wound around a spool shaft from one edge section in the longitudinal direction thereof with the edge section in the longitudinal section thereof separated from the spool shaft for development and which is returned in the separated state to the customer, the film accommodated in the container in the state where the film is wound around the spool shaft, and also for winding up and holding the film from the first film container; a first feeding unit for feeding out the film wound around in the first loading section from the other edge section of the film in the longitudinal section thereof and holding the film in the state where the edge section of the film in the longitudinal direction thereof is locked in the first loading section; a second loading section having an insertion/passage port through which a lengthy film wound around a spool shaft is inserted or withdrawn therefrom and for loading therein a second film container accommodating therein the film which is returned to the customer in the state where the film has been wound around the spool shaft from one edge section of the film in the longitudinal direction thereof, the film accommodated there in the state where the film has been wound up around the spool shaft; a second feeding unit for feeding out the film, starting from the other edge section of the film in the longitudinal direction thereof, from inside of the second film container loaded in the second loading section and also for maintaining the state wherein the one edge section of the film in the longitudinal direction thereof is locked on the spool shaft; a first processing tank provided at a position opposite to the other edge section of the film wound into the first loading section in the longitudinal direction thereof and for accommodating therein a portion of the film fed out by the first feeding unit from said first loading section and developing the film with a developing liquid; and a second processing tank provided at a position opposite to an insertion/passage port of the second film container loaded in the second loading section and accommodating therein a portion of the film fed out by the second feeding unit from the second loading section and developing the film with a developing liquid.

In the photosensitive material processing apparatus according to the fifth aspect, the first film container is loaded in the first loading section. A film in the first film container loaded in the first loading section is wound into the first loading section. The film is fed out by the first feeding unit into the first processing tank in the state where one edge section of the film wound into the first loading section is locked.

Further a second film container is loaded in the second loading section. The film is fed out by the second feeding unit into the second processing tank in the state where one edge section of the film, in the longitudinal direction thereof, wound around the spool shaft in the second film container is locked. The film fed out by the feeding unit is developed in the first or second processing tank.

A photosensitive material processing apparatus of a sixth aspect comprises a single shared loading section for loading therein a first film container accommodating said first film which is wound up around a first spool shaft from one edge section of the film in the longitudinal direction thereof with the one edge section of the film in the longitudinal direction thereof separated from the first spool shaft and is returned to the customer in the separated state, the first film stored therein in the state where the film has been wound up around said first spool shaft, and also a second film container having an insertion/passage port from which a second lengthy film wound around a second spool shaft is inserted and withdrawn therethrough and is returned to the customer in the state where the film has been wound around said second spool shaft from an edge section of said second film in the longitudlinal direction thereof, the second film accommodated therein in the state where said second film has been wound around said second spool shaft; a linkage unit for linkage to said second spool shaft; and a rotation driving unit for rotating said second spool shaft through said linkage unit.

In the photosensitive material processing apparatus according to the sixth aspect, the first film container with the first film not having been subjected to development stored therein or the second film container with the second film not having been subjected to development is loaded in the loading section. The first film is wound from the first film container into the loading section and is retained in the loading section. The second spool shaft is linked to the linkage unit and the second spool shaft is rotated by the rotation driving unit. In association with this rotation, the second film goes into or comes out from the second film container.

In the photosensitive material processing apparatus according to the sixth aspect, the first film container can be loaded in the single loading section and also the second film container can be loaded therein, so that the loading section can be shared, which enables minimization of the photosensitive material processing apparatus.

In the photosensitive material processing apparatus of a seventh aspect, the photosensitive material processing apparatus of the sixth aspect comprising: a feeding unit for moving said linkage unit to a position opposite to said second spool shaft and engaging the linkage unit therein; and a retaining unit linked to the feeding unit and for positioning the second film container in association with movement of the moving unit and retaining the moving unit there.

In the photosensitive material processing apparatus according to the seventh aspect, the linkage unit is moved by the moving unit and also the retaining unit is moved. The linkage unit is engaged with the second spool shaft.

In a photosensitive material processing apparatus of eighth aspect, the photosensitive material processing apparatus of the sixth or seventh aspect one edge section of the film in the longitudinal direction thereof withdrawn from the first film container loaded in the loading section and also winding up the first film, starting from one edge section of the first film in the longitudinal direction thereof up to the other edge section of the film in the longitudinal section thereon, from the first film container provided in the linkage unit.

In the photosensitive material processing apparatus according to the eighth aspect, the intermediate spool shaft provided in the linkage spool winds up the first film.

In a photosensitive material processing apparatus of a ninth aspect, the photosensitive material processing apparatus according to any of the sixth to eighth aspects comprises a cutting unit for cutting, when said first film in said first film container loaded in said loading section has been wounded into said loading section, the other edge section of said first film in the longitudinal direction thereof; a feeding unit for feeding out said first film from one edge section of said first film set in said loading section in the longitudinal section thereof or from the other edge section of the second film in the longitudinal section thereof and holding the film in the state where the one edge section of the film in the longitudinal section thereof is locked in said loading section; and a single shared processing tank having a film insertion port and for accommodating a portion of said first film and a portion of said second film, in the state where the other edge section of said first film wound up in said loading section of an insertion/passage port of said second film container loaded in said loading section is positioned at a position opposite to a film insertion port of said processing tank and developing the portions of the first and second films fed out by said feeding unit from said film insertion portion.

In the photosensitive material processing apparatus according to the ninth aspect, the first film container is loaded in the loading section. The film in the first film container loaded in the loading section is wound into the loading section. The film is fed out by the feeding unit in the state where one edge section of the film wound into the loading section is locked, and the film is developed there.

Further the second film container is loaded in the loading section. The film is fed out by the feeding unit in the state where one edge section of the film wound around the spool shaft in the second film container is locked. The film fed out by the feeding unit is developed in the processing tank.

Accordingly, with the photosensitive material processing apparatus according to the invention as described in claim 9, both the first film container and second film container can be loaded in the single loading section, so that a roller for feeding out the first or second film, a motor for driving the roller, and other components can be shared by the first and second films, and in addition, the film in the first film container and that in the second film container can be developed in a shared processing tank. Namely, with the photosensitive material processing apparatus according to the ninth aspect, it is not necessary to provide a plurality of photosensitive material processing apparatuses, which enables cost reduction as well as installation at a small space.

In a photosensitive material processing apparatus of a tenth aspect, the photosensitive material processing apparatus according to any of the sixth to eighth aspects comprises a cutting unit for cutting, after said first film in said first film container loaded in said loading section has been wound up into said loading section, the other edge section of said first film in the longitudinal direction thereof; a feeding unit for feeding out said film from one edge section of said first film in the longitudinal section thereof set in said loading section or the other edge section of said second film in the longitudinal section thereof and holding the film in the state where the edge section of the film in the longitudinal direction thereof is locked in said loading section; a first processing tank having a film insertion port and also having an internal width dimension corresponding to a width of said first film and for accommodating a portion of said first film fed out from said feeding unit from said loading section and developing the film with a processing liquid; a second processing tank having a film insertion port and also having an internal width dimension corresponding to a width of said second film and for accommodating a portion of said second film fed out by said feeding unit from said loading section and developing the film with a developing liquid; and a moving unit for moving either one of said loading section of said first processing tank to position the other edge section of said first film to a position opposite to the film insertion port of said first processing tank and also moving either one of said loading section and said second processing tank to position an insertion/passage portion of said second film container to a position opposite to the film insertion port of said second processing tank.

In the photosensitive material processing apparatus according to the tenth aspect, the first film container is loaded in the loading section. The film in the first film container loaded in the loading section is wound into the loading section. For instance, the other edge section of the film wound by the moving unit into the loading section in the longitudinal direction thereof is moved to a position opposite to the film insertion port of the first processing tank.

After this movement, the film is fed out by the feeding unit in the state where one edge section of the film wound into the loading section in the longitudinal direction thereof is locked. It should be noted that, when the other edge section of the film wound into the loading section is positioned at a position opposite to the film insertion port of the processing tank at the initial position, it is not necessary to move the loading section with the moving unit.

Further the second film container is loaded in the loading section. In the state where one edge section of the film wound around the spool shaft in the second film container is locked, the insertion/passage port of the second film container loaded in the loading section is moved by the moving unit to a position opposite to the film insertion port of the second processing tank, and the film is fed out by the feeding unit. The film fed out by the feeding unit is developed in the second processing tank.

In the photosensitive material processing apparatus according to the tenth aspect the first processing tank and second processing hank having widths corresponding to widths of the first and second films respectively are provided, so that both edge sections of the first and second films in the lateral direction are guided by the portions of internal walls of the first and second processing tanks more accurately.

In a photosensitive material processing apparatus of eleventh aspect, the photosensitive material processing apparatus according to the ninth or tenth aspect has a processing solution supply unit for circulating, replacing, and discharging the processing solution in the processing tank.

In the photosensitive material processing apparatus of eleventh aspect, the processing solution supply unit circulates the processing unit (such as a color-developing liquid, a fixing/bleaching liquid, or a rinsing liquid) in the processing tank, replaces the processing unit (replaces, for instance, the color-developer with the fixing/bleaching liquid, or the fixing/bleaching solution with the rinsing liquid), and discharges the processing liquid.

With the photosensitive material processing apparatus according to the eleventh, a plurality types of processing such as development with colors, fixing/bleaching, washing with water are carried out with the processing solution supply unit in the single processing tank, so that a plurality of processing tanks are not required, which enables minimization of the apparatus and installation of the apparatus even at a small space.

In a photosensitive material processing apparatus of twelfth aspect, the photosensitive material processing apparatus according to any of ninth to eleventh aspects has a recording unit for recording images formed on the first and second films on a recording medium.

In the photosensitive material processing apparatus of the twelfth aspect, image data on the film having been subjected to development processing is output to the recording unit and is subjected to the processing such as printing.

A photosensitive material processing apparatus of a thirteenth comprises a first loading section for loading therein a first film container accommodating therein a first film which is wound around a spool shaft from one edge section of the film in the longitudinal direction thereof with the one section of the film in the longitudinal section thereof separated from said spool shaft and is returned to the customer in the separated state, said first film accommodated therein in the state where the first film has been wound around said spool shaft and also winding up and retaining said first film from said first film container; a second loading section having an intermediate spool shaft for retaining one edge section of said first film withdrawn from said first film container loaded in said loading section and winding up said first film, starting from said one edge section of said first film in the longitudinal section thereof up to the other section of the film in the longitudinal section thereof, from said first film container; a third loading section for loading therein a second film container having a insertion/passage port through which a lengthy second film wound up around a spool shaft is inserted or withdrawn therefrom and accommodating said second film returned to the customer in the state where said second film has been wound around said spool shaft; a feeding unit for feeding out said first film wound around an intermediate spool shaft in said second loading section or said second film in said second film container in said third loading section from the other edge section of said second film in the longitudinal direction thereof and also holding the film in the state where said one edge section in the longitudinal section thereof is loaded on said intermediate spool shaft or said spool shaft; and a processing tank for accommodating therein a portion of said film fed out by said feeding unit from said second loading section or said third loading section and developing the film with a developing liquid.

In the photosensitive material processing apparatus of the thirteenth aspect, the first film container is loaded in the first loading section. The second film container is loaded in the second loading section. The film in the second film container loaded in the second loading section is wound up by the intermediate spool shaft. The film is fed out by the feeding unit in the state where one edge section of the film wound around the intermediate spool shaft in the longitudinal direction thereof is locked. And the film fed out by the feeding unit is developed in the processing tank.

In a photosensitive material processing apparatus of a fourteenth aspect, the photosensitive material processing apparatus of the thirteenth aspect comprises a pulling unit for pulling said first film or said second film fed out by said feeding unit from said second loading section and said third loading section respectively holding one edge section of the film in the longitudinal direction thereof into said processing tank.

In the photosensitive material processing apparatus of the fourteenth aspect, a tip of the film is retained by the feeding unit, and the film is fed from the first loading section or the third loading section. The film fed out by the feeding unit is pulled by the pulling unit into the processing unit and is developed therein.

In a photosensitive material processing apparatus of a fifteenth aspect, the film in the second film container loaded in the second loading section is wound around the intermediate spool shaft in the third loading section, and then the cutting unit cuts off a rear section of the film.

In the photosensitive material processing apparatus according to the fifteenth aspect, the film in the second film container loaded in the second loading section is wound around the intermediate spool shaft in the third loading section, and then the cutting unit cuts off a rear section of the film.

DETAILED DESCRIPTION OF THE PREFERRED EMBODIMENTS

Embodiment 1

Next description is made for Embodiment 1 of the photosensitive material processing apparatus according to the present invention with reference to FIG. 1 to FIG. 5. It should be noted that, in these figures, the front side is indicated by an arrow mark RF, right side by an arrow mark RL, and upper side by an arrow mark UP.

(Processor)

Figure 1:
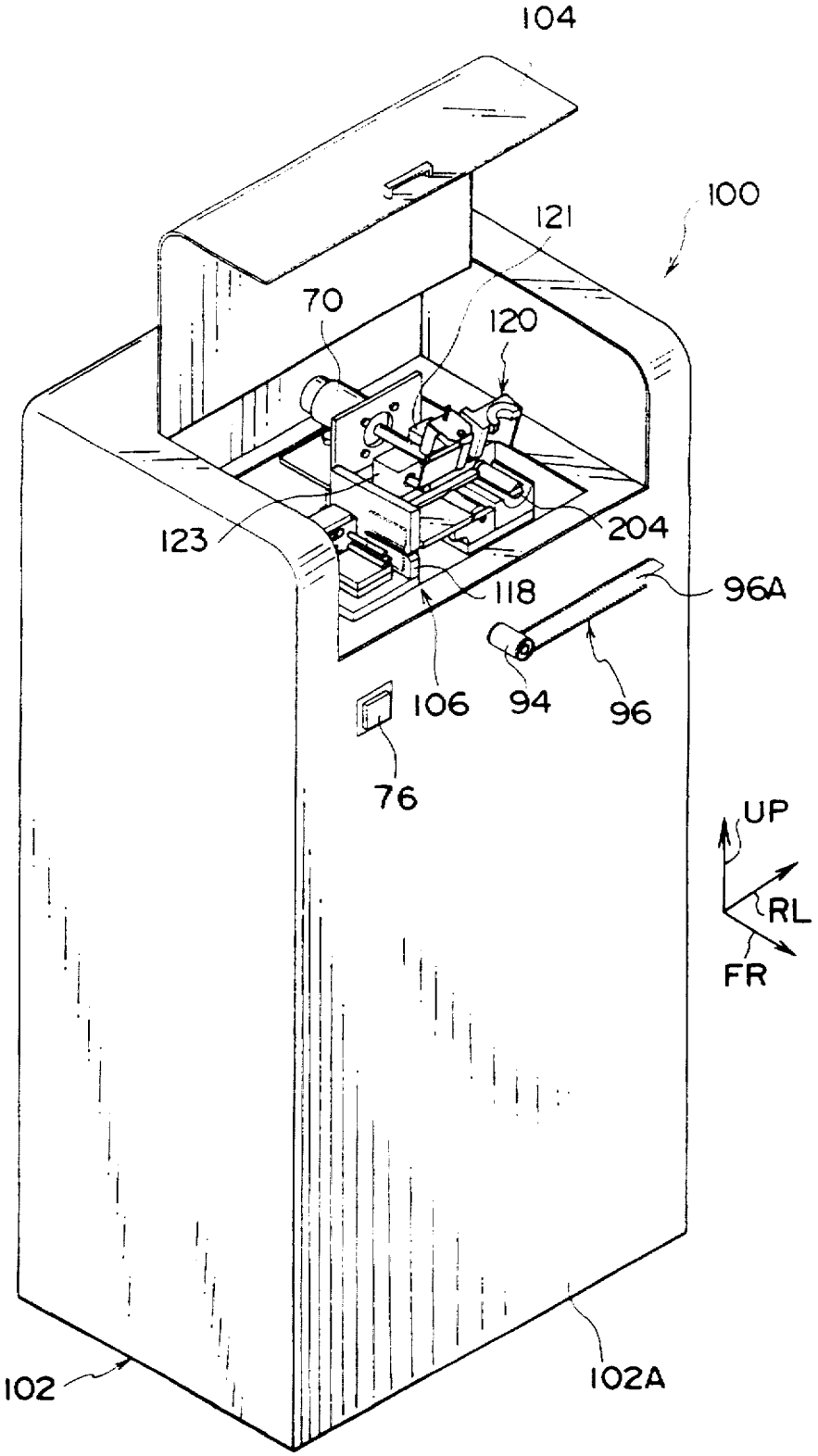
FIG. 1 is a general perspective view showing a processor according to Embodiment 1 of the present invention.

As shown in FIG. 1, a processor 100 as a photosensitive material processing apparatus, which develops a 135-size film 96 accommodated in a cartridge 94 as a film container and locked on a spool shaft 94A (Refer to FIG. 3), has a box-shaped casing 102 for shuttering.

Provided on the casing 102 is a loading section 106 in which the cartridge 94 is loaded, and an L-shaped cover 104 for covering the loading section 106 is rotatably provided.

Figure 3:
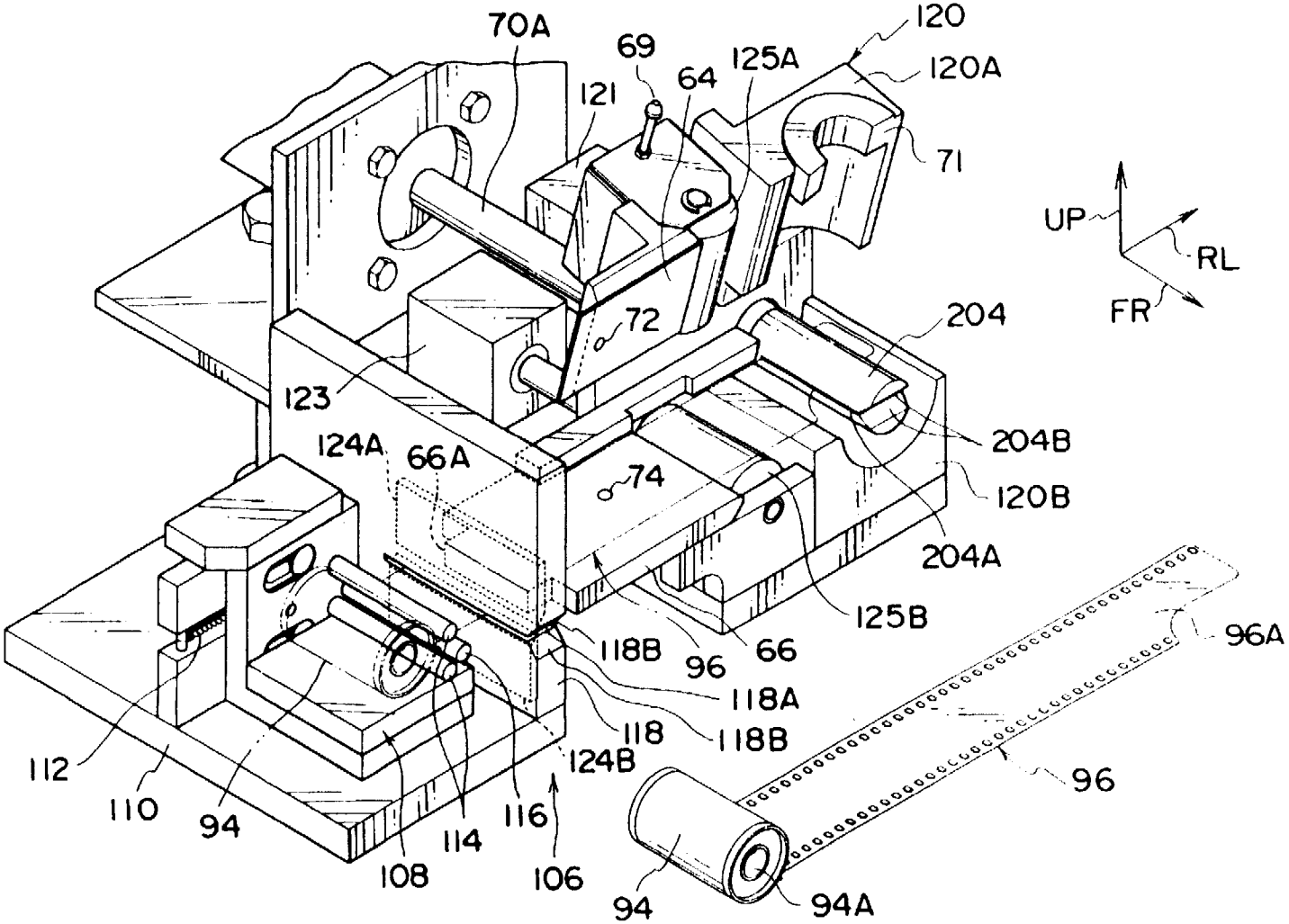
FIG. 3 is a perspective view showing a key section of the loading section shown in FIG. 1.

As shown in FIG. 3, a mounting member 108 for mounting the cartridge 94 thereon is provided in the loading section 106, and the mounting member 108 can slide right and left against a support member 110 provided in the loading section 108.

Figure 2:
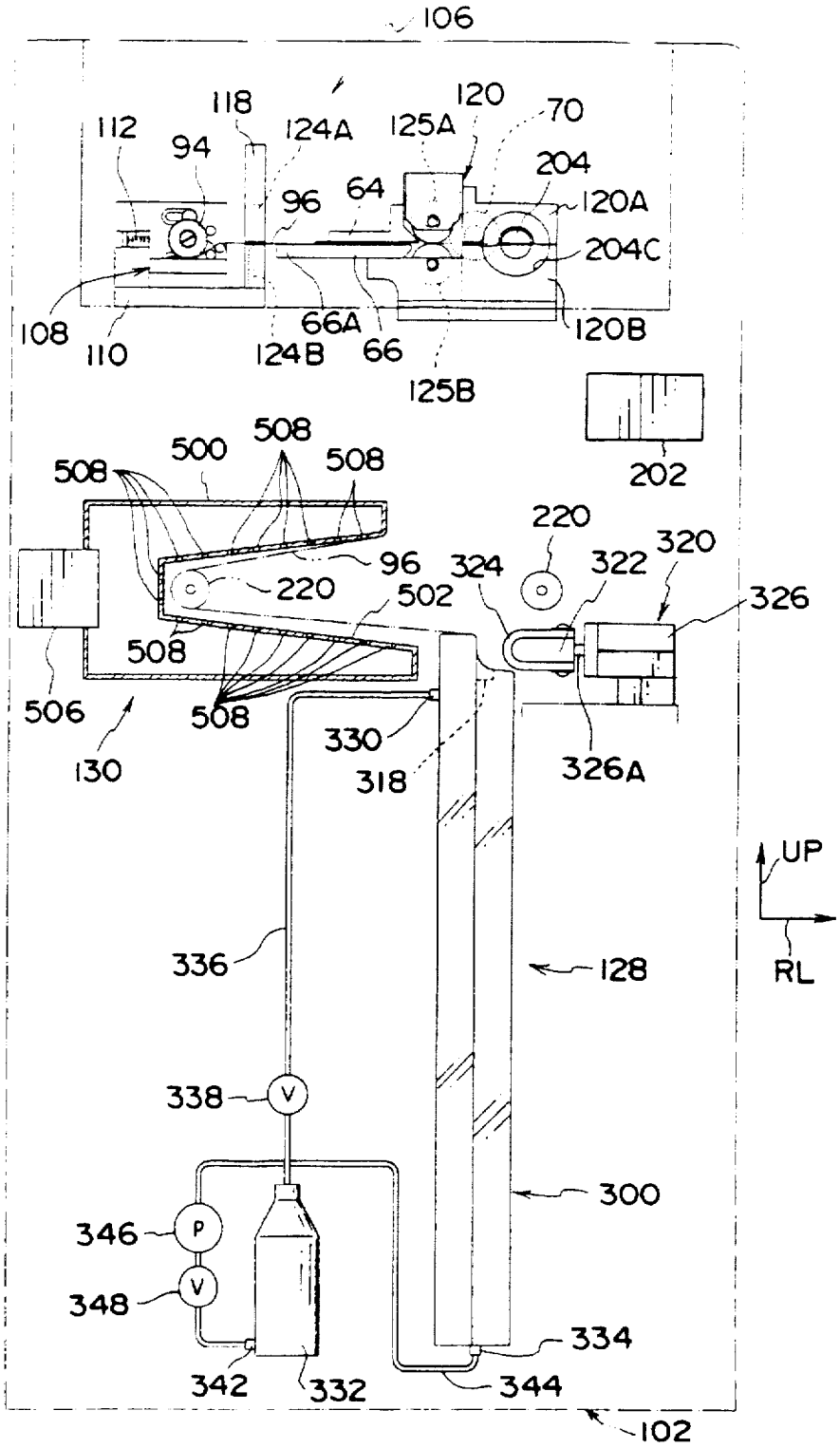
FIG. 2 is a cross-sectional view showing a key section of the processor shown in FIG. 1.

It should be noted that a coil spring 112 for pulling back the mounting member 108 slid to the side of an intermediate spool shaft 204 (right side) described hereinafter when a work of pulling out a film 96 inside the cartridge 94 is finished to the initial position shown in FIG. 2 is provided on the support member 110 as well as on the mounting member 108.

Figure 7:
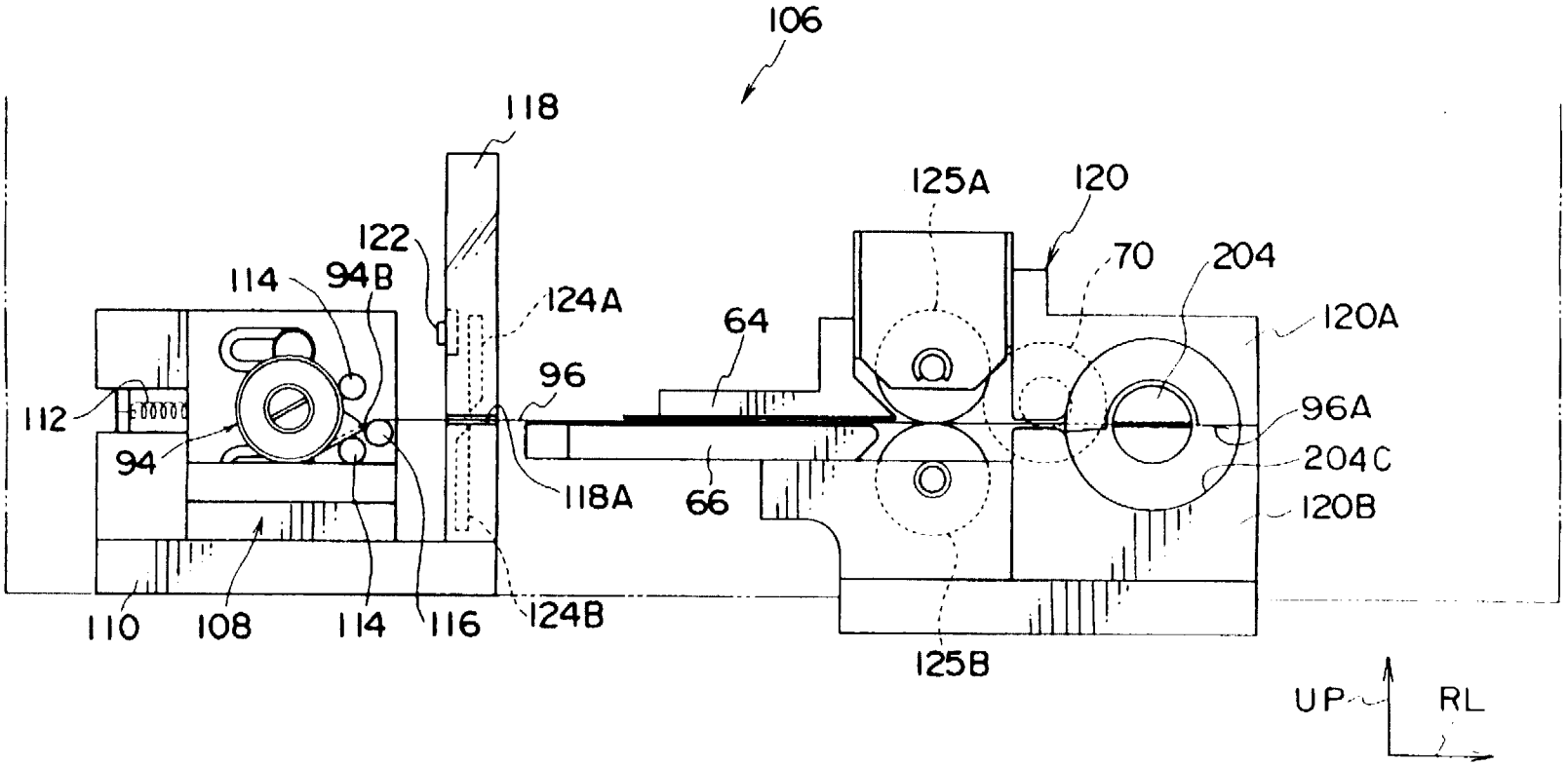
FIG. 7 is a perspective view showing internal configuration of the processor.

Two strings of round column-shaped stoppers 114 extending in a direction (a front-to-rear side direction) crossing at right angles a longitudinal direction of the film 96 withdrawn from the cartridge 94 are provided in the side of an exit/entrance 94B (right side) of the cartridge 94 mounted on this mounting member 108. As shown in FIG. 7, these stoppers 114 are arranged so that center lines thereof are positioned on the same line in the vertical direction, and contact an external peripheral surface of the cartridge 94.

A column-shaped guide shaft 116 is attached to a section opposite to the exit/entrance 94B of the cartridge 94 being oriented in the same direction as that of the pair of stoppers 114. This guide shaft 116 guides the film 96, and the film 96 is fed out in the state where the film 96 contacts a peripheral surface of the guide shaft 116.

A partition plate 118 is provided between the mounting member 108 and the intermediate cartridge 120 in which the intermediate spool shaft 204 is provided, and a lacked section 118 is formed on this partition plate 118 at a position opposite to a peripheral surface of an upper section of the guide shaft 116. As shown in FIG. 3, this lacked section 118A is formed continuously from an edge face in the front side of the partition plate 118, and the film 96 can be inserted from the edge face of the front side of the partition plate 118. It should be noted that the lacked section 118A is a little longer as compared to thickness of the film, and a tapered guide face 118B is formed so that the film 96 can easily be inserted into the lacked section 118A.

As shown in FIG. 7, provided on the partition plate 118 is a switch 122 at a position opposite to the mounting member 108. This switch 122 contacts the mounting member 108 when the mounting member 108 is slid to the side of the intermediate spool shaft 204. For this reason, a control unit 202 (microcomputer) connected to the switch 122 as shown in FIG. 2 determines that the film 96 in the cartridge 94 has completely been withdrawn.

As indicated by a broken line in FIG. 3, a pair of cutters 124A, 124B as a cutting unit are provided on the partition wall 118 at a position opposite to the lacked section 118A. The upper side cutter 124A can move up and down, while the lower side cutters 124B is fixed at the position shown in FIG. 3.

Figure 8:
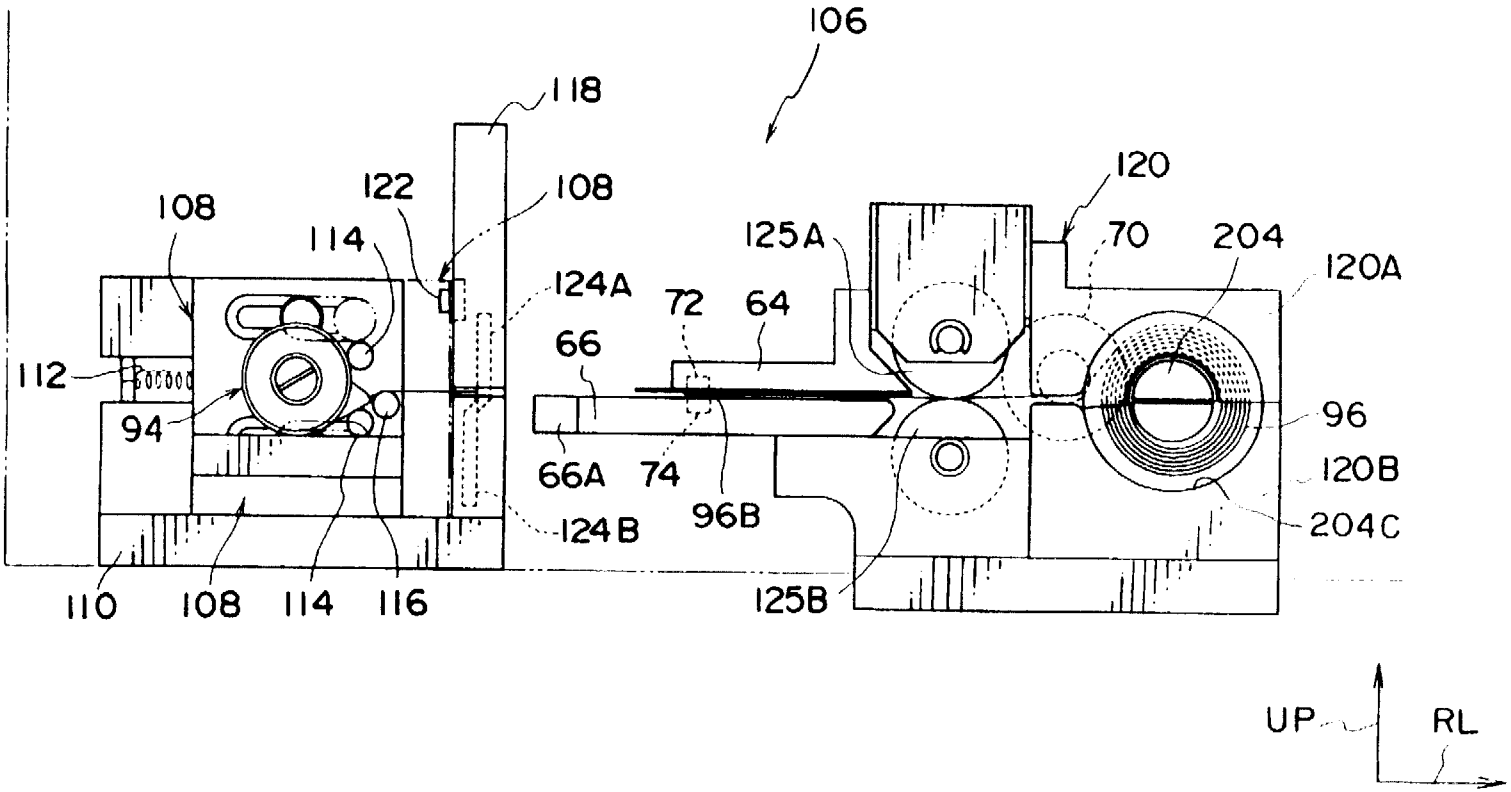
FIG. 8 is a front view showing a key section of the loading section shown in FIG. 3.

As shown in FIG. 8, in the state where the film 96 has completely been wound around the intermediate spool shaft 204, the cartridge 94 moves due to tension of the film 96, so that the mounting member 108 slides, being pushed by the stopper 114, to the side of intermediate spool shaft 204. For this reason, the switch 122 pressed by the mounting member 108 is turned ON, and the control unit 202 determines that the film 96 has completely been wound up. The upper cutter 124A goes down according to a control signal from the control unit 202, and the film 96 is cut at a rear edge 96B thereof.

Further, provided on the intermediate cartridge 120 of the loading section 106 in the left side of the intermediate spool shaft 204 are a pair of rollers 125A, 125B for feeding out the film 96 to the side of intermediate spool shaft 204 or to the contrary side. As shown in FIG. 3, the upper roller 125A is rotatably supported, while the lower roller 125B is jointed to a motor 123 rotating in the regular and reverse directions. It should be noted that the motor 123 is a stepping motor, and the control unit 202 determines a feed rate of the film 96 by counting a number of pulses from the motor 123.

Figure 4:
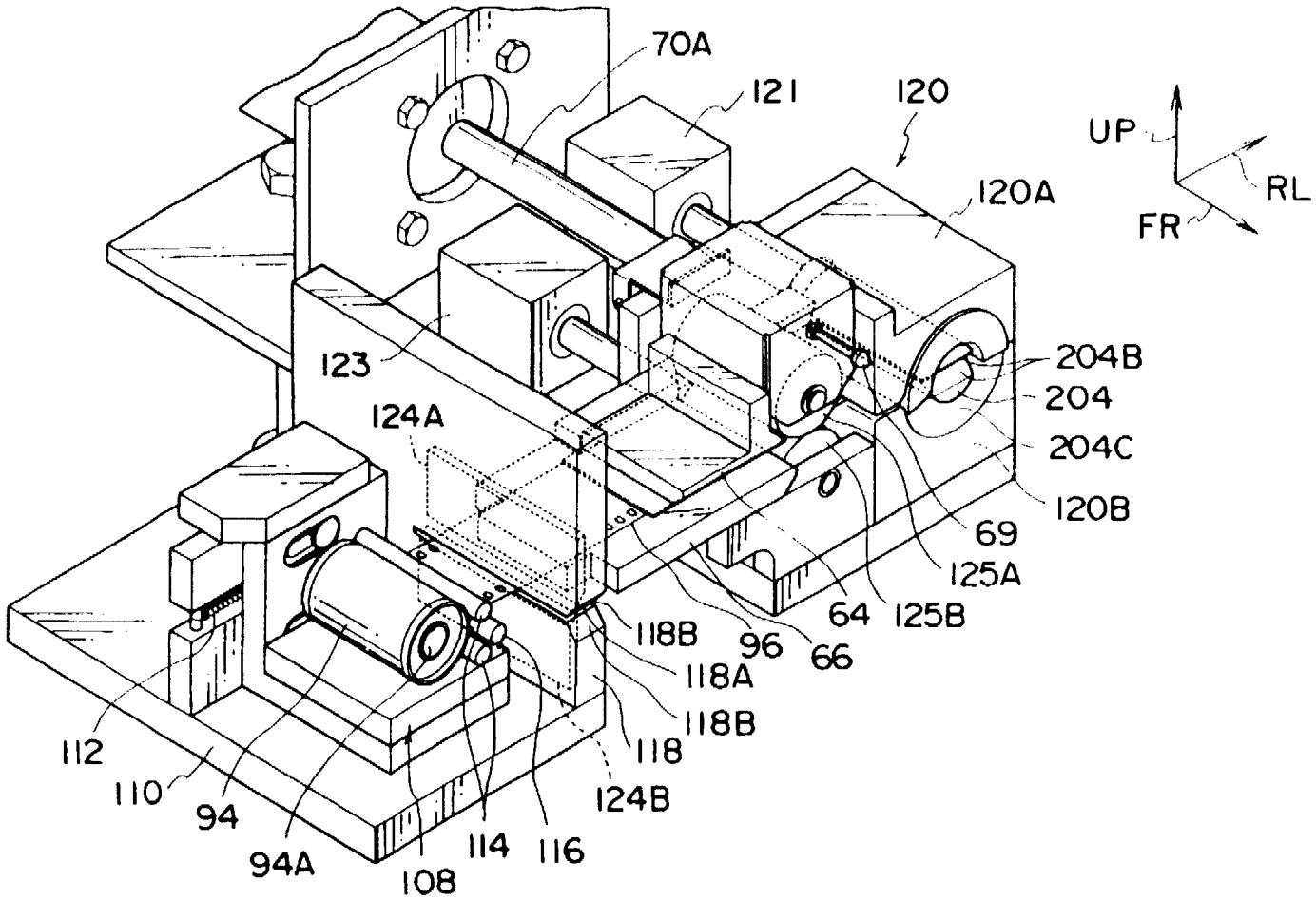
FIG. 4 is a perspective view showing the state where a cartridge is loaded in the loading section shown in FIG. 3.

As shown in FIG. 4, a motor 121 is jointed to the intermediate spool shaft 204 so that the motor 121 and the motor 123 for the roller 125B rotate synchronously. The motor 121 rotates in the regular and reverse direction, so that also the guide roller 205 rotates in the regular and reverse directions.

As shown in FIG. 3, a linear slit 204A slightly longer as compared to thickness of the film 96 is formed between two points on an external peripheral surface on the center line of the intermediate spool shaft 204. The film 96 is inserted through this slit 204A, and a locking unit for positioning and locking the inserted film 96 in the slit 204A is provided.

For instance, as this locking unit, balls for positioning the film 96 are proved at a substantially intermediate position of the intermediate spool shaft 204 in the lateral direction thereof, and some of the balls are energized by a coil spring not shown so that the balls are always pressed toward the film 96. With this locking unit, the film 96 is locked in the slit 204A. Further a plate spring or the like may be used as the locking unit.

Further as shown in FIG. 7, a tip of the film 96 is positioned on the intermediate spool shaft 204 due to an energizing force of balls not shown herein, and in this state, when the intermediate spool shaft 204 rotates, the film 96 is wound around the intermediate spool shaft 204 as shown in FIG. 8.

In this embodiment, after the tip 96A is withdrawn by a withdrawing device (Refer to, for instance, Japanese Patent Laid-Open Publication No. 2229/1980) for pulling out the tip 96A of the film 96, the tip 96A is set on the intermediate spool shaft 204. It should be noted that a withdrawing device for pulling out the tip 96A may be provided inside the intermediate cartridge 120.

Further as shown in FIG. 4, a round hole 204C is formed around the intermediate spool shaft 204. A shown in FIG. 6, this hole 204C is an escape for surrounding and retaining the film 96. It should be noted that, as shown in FIG. 3, a tapered guide face 204B is formed at a front edge (tip) of the intermediate spool shaft 204 at a position opposite to the slit 204A. This guide face 204B facilitates smooth insertion of the film 96 into the slit 204B.

As shown in FIG. 1 and FIG. 2, the intermediate cartridge 120 is jointed to a motor shaft 70A (Refer to FIG. 1) of the motor 70, and when the motor 70 rotates, the intermediate cartridge 120 rotates by 90 degrees counterclockwise (in the direction indicated by the arrow mark CC) as shown in FIG.

11. It should be noted that the motor 70 is a stepping motor and the control unit 202 determines a rotation rate of the intermediate cartridge 120 by counting a number of pulses from the motor 123.

Figure 10:
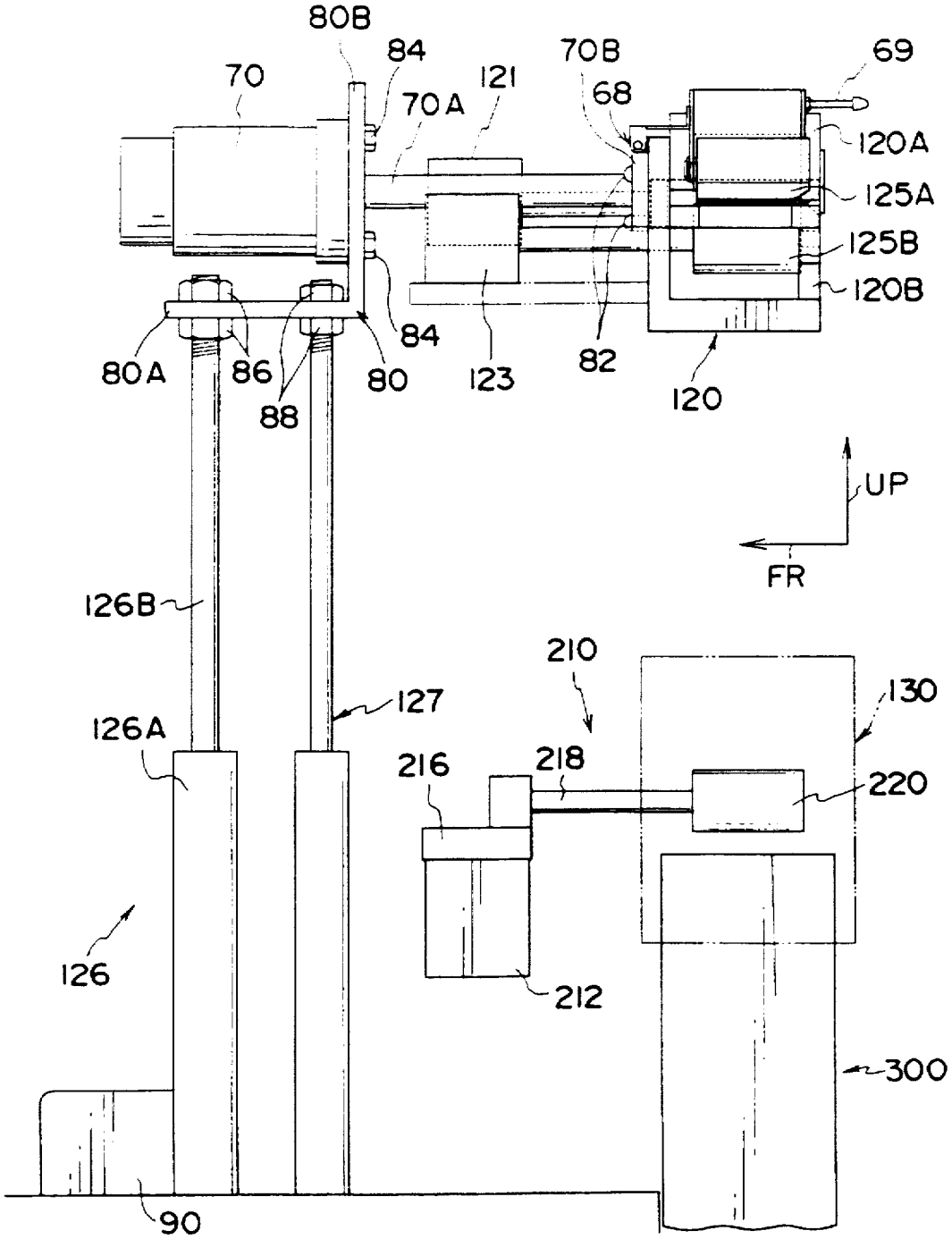
FIG. 10 is a left side view showing a key section of the processor shown in FIG. 2.

Further, as shown in FIG. 3, an upper section 120A of the intermediate cartridge 120 is inclined via a hinge 68 shown in FIG. 10 toward a lower section 120B of the intermediate cartridge 120. It should be noted that an energizing unit (such as, for instance, a spring, or a sheet spring) not shown for energizing the upper section of the intermediate cartridge 120 toward the lower section 120B is provided on this hinge 68. Because of this energizing unit, the upper section 120A of the intermediate cartridge 120 is not easily separated from the lower section 120B.

As shown in FIG. 3, provided in the intermediate cartridge 120 are a pair of guide plates 64, 66 at a position opposite to a lacked position 118A on the partition plate 118. As shown in FIG. 3 and FIG. 4, one guide plate 64 is fixed to the upper section 120A of the intermediate cartridge 120, and the other guide plate 66 is fixed to the upper section 120B of the intermediate cartridge 120.

Figure 5:
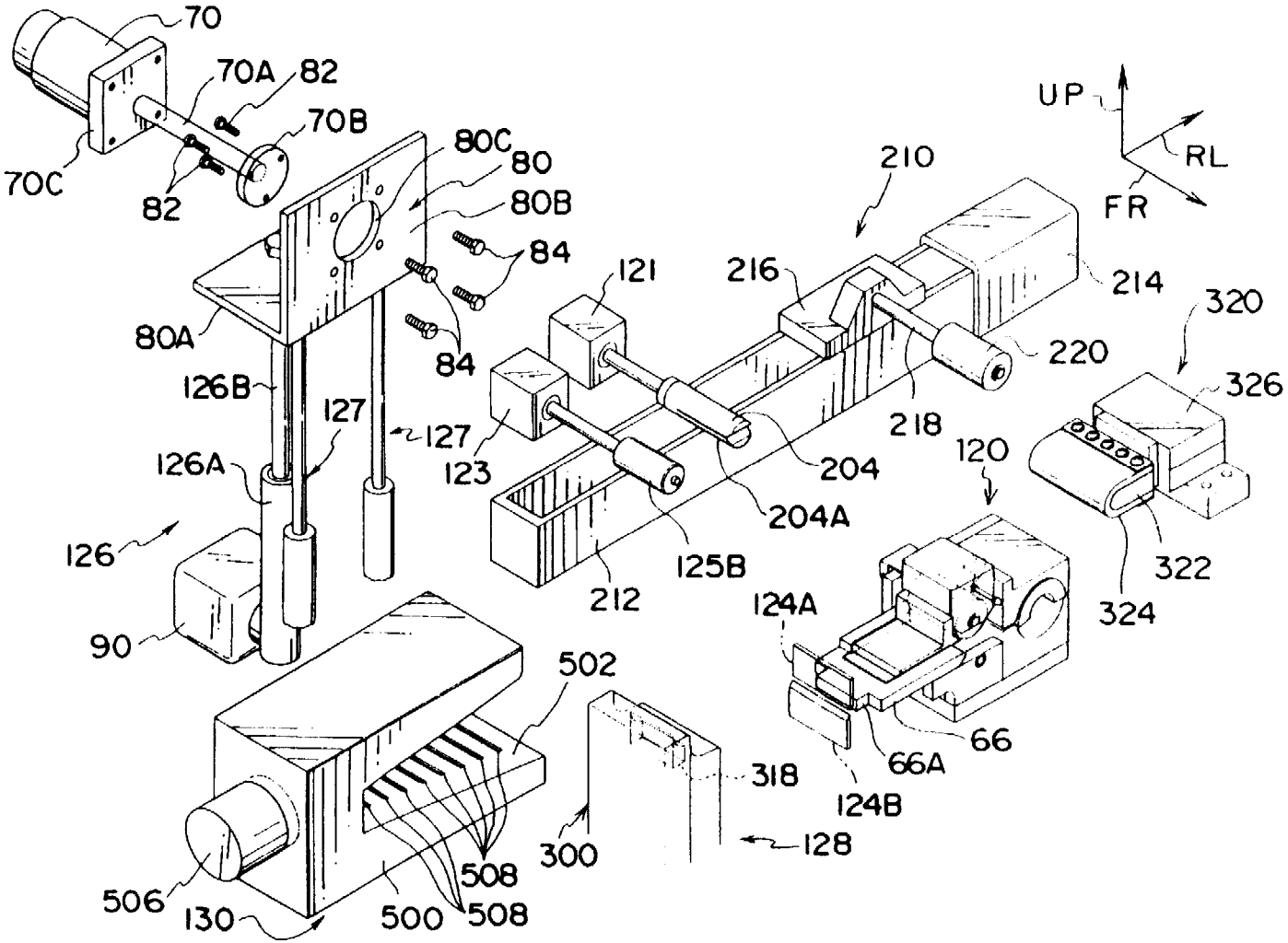
FIG. 5 is a dissolved perspective view showing a key section of the processor.

When the upper section 120A of the intermediate cartridge 120 is inclined around the hinge 68 shown in FIG. 10, the guide plate 64 is separated from the guide plate 66, which makes it possible for a film to be inserted (namely, the open and saved state). It should be noted that, as shown in FIG. 5, a tip 66A of the guide plate 66 corresponds to size of a film insertion port 318 of a processing tank, and that the tip 66A can be inserted into a film insertion port 318.

As shown in FIG. 3, a stopper 71 is formed in the upper section 120A of the intermediate cartridge 120 at a position opposite to a tip of the intermediate spool shaft 204. This stopper 71 prevents the film 96 from being separated from the hole 204C (Refer to FIG. 4).

Also provided in the upper section 120A of the intermediate cartridge 120 is a rod-shaped handle 69 in the side contrary to the roller 125A. This handle 69 as an opening unit facilitates easy inclination of the upper section 120A of the intermediate cartridge 120, but an opening unit for the upper section 120A is not limited to that described above, and such tools as an air cylinder, a spring, or solenoid may be used for that purpose. Further, a retaining unit (such as an air cylinder, a spring, a solenoid or the like) for retaining the upper section 120A of the intermediate cartridge 120 at a specified angle (in the state shown in FIG. 3) may be provided for that purpose.

It should be noted that, in the invention according to claim 1, the intermediate spool shaft 204 may not be provided in the intermediate cartridge 120. In this case, the film 96 is rolled into and locked in the hole 204C of the intermediate cartridge 120 due to the tendency of the film 96 for winding. Namely the film 96 rolled into the hole 204C is retained with the rear edge 96B held between rollers 125A, 125B.

Provided on the guide plates 74 and 96 for the intermediate cartridge 120 are a light-emitting element 72 and a light-receiving element 74 in the side of the partition plate 118 (left edge side) opposite to the film 96. When light from this light-emitting element 72 is supplied to the light-receiving element 74, the control unit 202 determines a position of the rear edge 96B of the film 96 (Refer to FIG. 8).

As shown in FIG. 1, a push-button switch 76 is provided on a front panel 102A of the casing 102, and when this switch 76 is pressed down, the motors 121, 123 rotate, and the film 96 held by the intermediate spool shaft 204 is wound up around the intermediate spool shaft 204, and the film 96 wound up as described above is developed and dried as described later.

It should be noted that an intermediate cartridge 126 shown in FIG. 5, developing section 128 shown in FIG. 5, and drying section 130 shown in FIG. 2 are provided in the casing 102 indicated by an imagination line in FIG. 2.

(Intermediate cartridge carrier)

Next description is made for configuration of an intermediate cartridge carrier 126.

Figure 11:
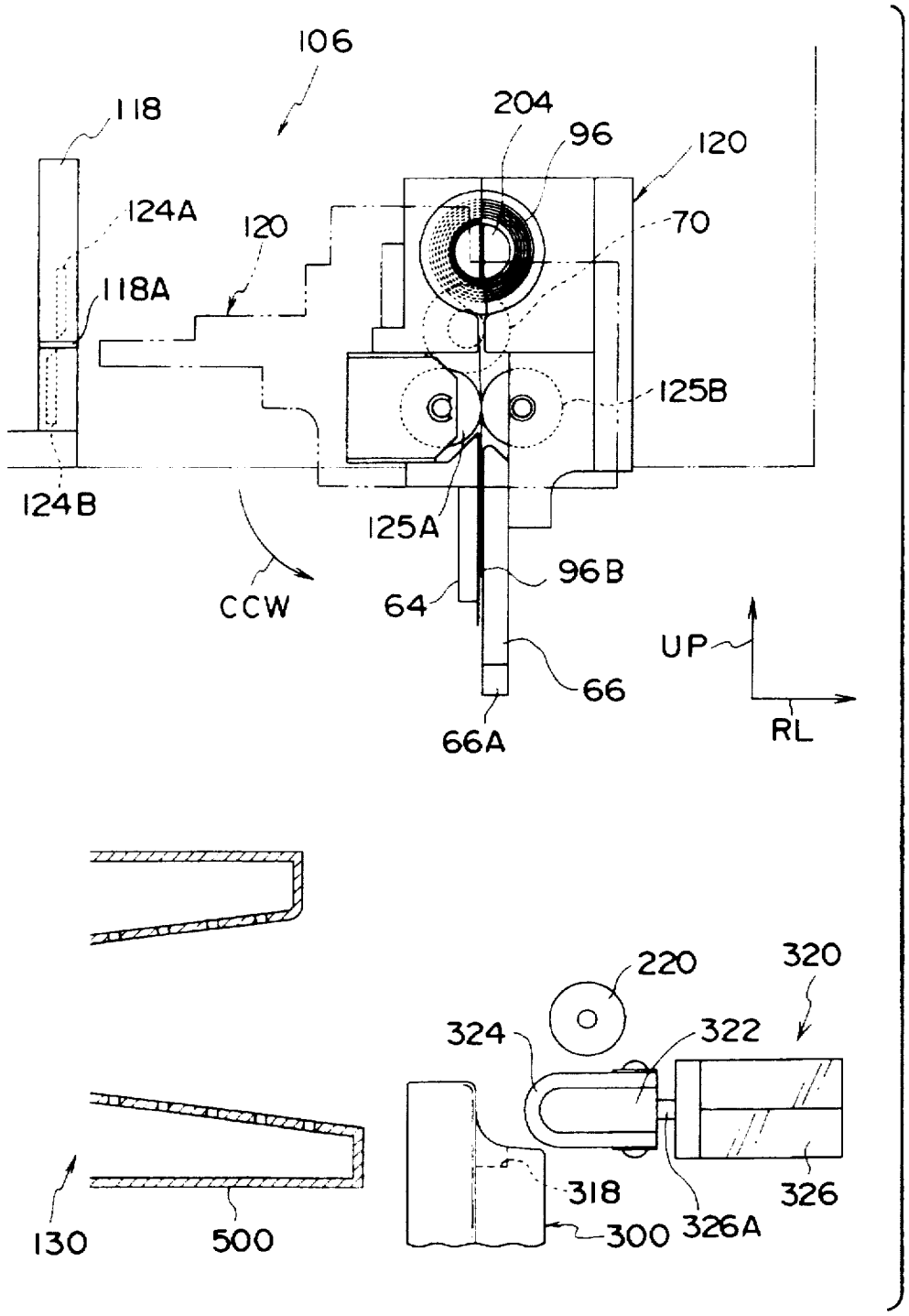
FIG. 11 is a view showing the state where the intermediate cartridge shown in FIG. 2 has been rotated.

As shown in FIG. 5, the intermediate cartridge carrier 126 is used for moving the intermediate cartridge 120 up and down, and moves the intermediate cartridge 120 up and down in the state where a rear edge of the film 96 shown in FIG. 11 is set at a position opposite to a film insertion port 318 of a processing tank 300 described later.

As shown in FIG. 10, the intermediate cartridge 120 is jointed via a bracket 80 having an L-shaped cross-section to the intermediate cartridge carrier 126 which is provided so that it can move up and down. Namely, a round mounting plate 70B is provided at a tip of a motor shaft 70A of the motor 70 rotating the intermediate cartridge 120, and the intermediate cartridge 120 is fixed by a plurality of bolts 82 (3 pieces in this embodiment) to this mounting plate 70B.

Further, a rectangular base 70C is provided in this motor 70, and this base 70C is fixed by a plurality of bolts 84*4 pieces in this embodiment) to a side piece 80B of the bracket 80. It should be noted that, as shown in FIG. 5, a hole 80C having a larger diameter as compared to that of the mounting plate 70B is formed in the side piece 80B, and the mounting plate 70B inserted through this hole 80C is attached to the intermediate cartridge 120.

The intermediate cartridge carrier 126 comprises a cylinder 126A and a rod 126B which is connected to this cylinder 126A and moves up and down. This rod 126 is fixed by a nut 86 (Refer to FIG. 10) to a lower piece 80A of the bracket 80.

Also a motor 90 is jointed to the cylinder 126A, and the rod 126B is moved up and down by moving a rack jointed to this motor 90 and not shown herein. Further a tip of a guide rod member 127 is fixed by a nut 88 to the lower piece 80A of the bracket 80. It should be noted that the rod 126B in this embodiment may be driven pneumatically, hydraulically, or by a screw or the like.

(Development processing section)

As shown in FIG. 2, the development processing section 128 has the processing tank 300 having a form like a seath of a sward formed from synthetic resin or the like. This processing tank 300 is provided in the vertical posture, and a film insertion port 318 with the upper edge open is formed as shown in FIG. 5.

Namely, in this embodiment, a film insertion port 318 through which the film 96 can be inserted or taken out is formed only in one side (upper side) of the processing tank 300 in the longitudinal direction thereof. It should be noted that length of the processing tank 300 is larger than processing length of the film 96 fed out to outside of the cartridge 94.

Figure 12:
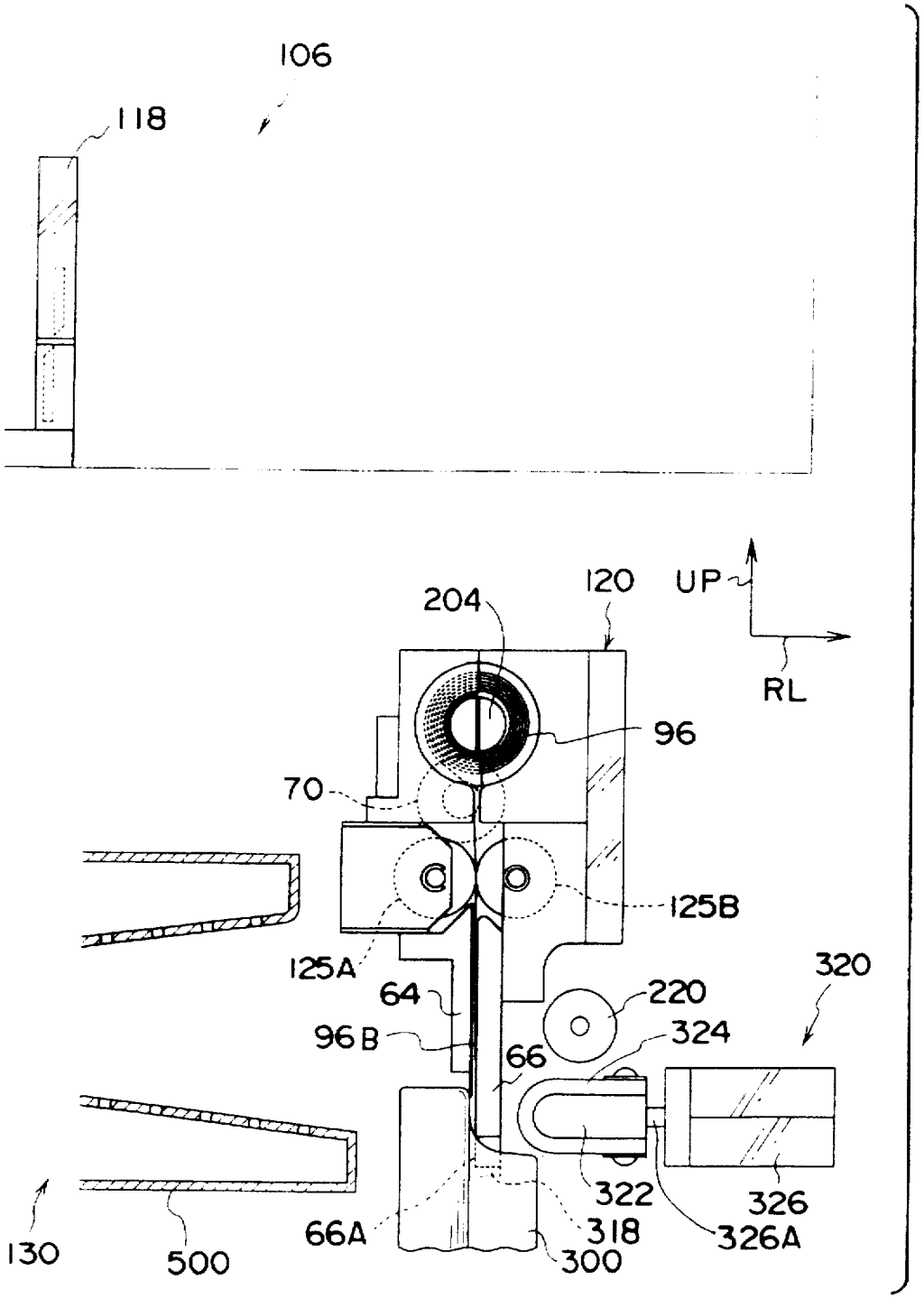
FIG. 12 is a view showing the state where the intermediate cartridge show in FIG. 11 has been down.

As shown in FIG. 12, the film 96 is fed out by the rollers 125A, 125B from the cartridge 120, and the rear edge 96B thereof is inserted into the film insertion port 318 of the processing tank 300. In this state, a tip 66A of the guide plate 66 is inserted into the film insertion port 318.

Figure 9:
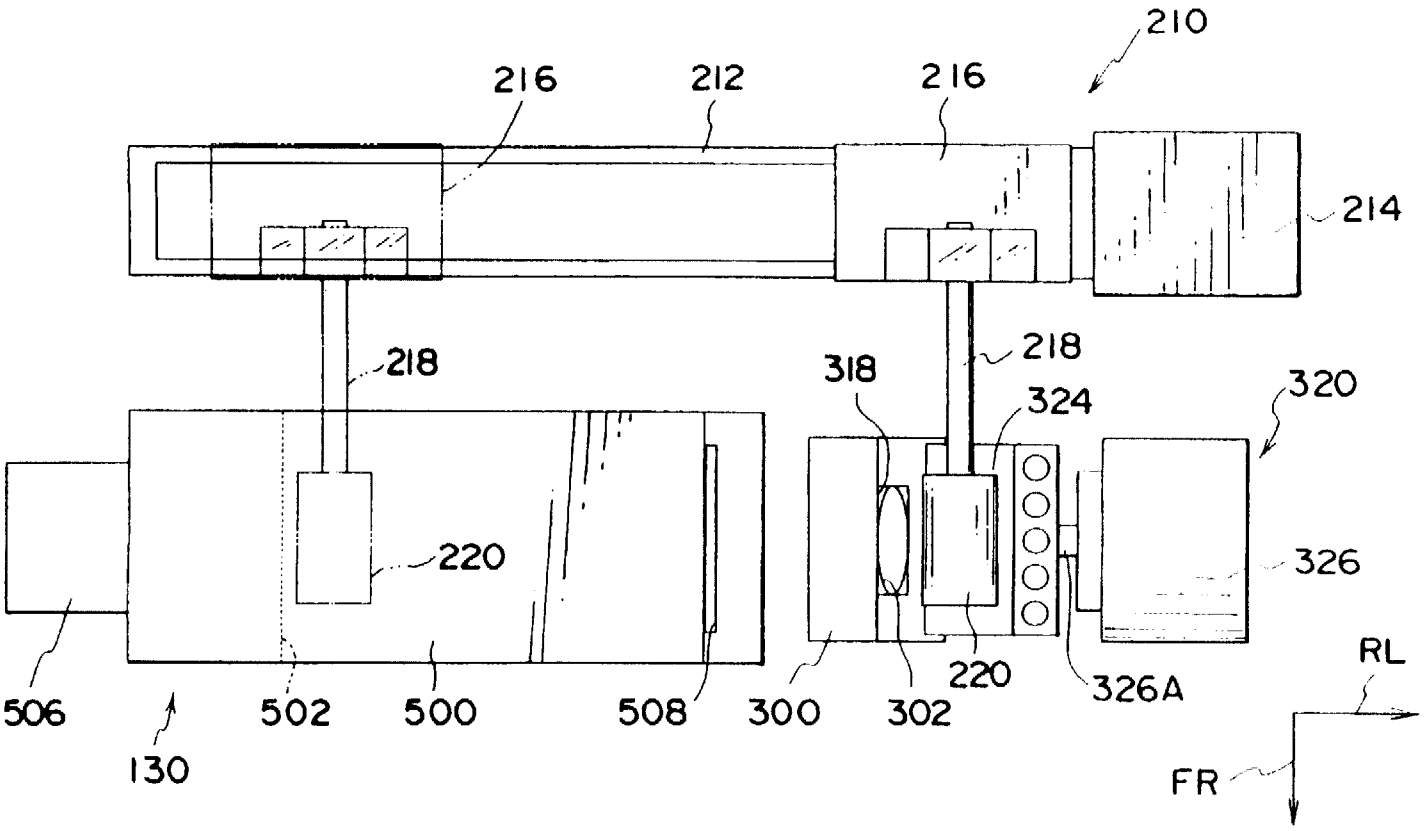
FIG. 9 is a flat view showing a key section of the processor shown in FIG. 2.

As shown in FIG. 9, internal walls 302 of the processing tank 300 face to each other and are warped so that a space between the two sides (opposing to both edge edges of the film 96 in its lateral direction) in the lateral direction (in the front-to-rear direction in FIG. 9) is smaller as compared to width of the film insertion port 318, and a space at a central section (a section opposing to an image frame of the film 96) in the lateral direction is wider as compared to a space between the two sides in the lateral direction described above.

For this reason, when the film 96 is inserted from the film insertion port 318, both edge sections of the film 96 in the lateral direction thereof are guided by sections of the internal walls 302 in its lateral direction, so that a central position of the film 96 in its lateral direction is prevented from contacting the internal walls 302 of the processing tank 300. It should be noted that a form of the processing tank is not limited to that like a linear sheath shape, and may be, for instance, a U-shaped form (In this case, the film insertion ports 318 may be formed at both edges of the processing tank 300 in the longitudinal direction thereof), and also the film 96 may be wound together with an emboss film made from such a material as synthetic resin into a cylindrical form to be accommodated in the processing tank.

(Sealing Device)

As shown in FIG. 2, a sealing device 320 is provided at a position opposite to the film insertion port 318. As shown in FIG. 5, the sealing device 320 has a block 322 closely contacted to the film insertion port 318. It should be noted that a thick packing 324 made from an elastic material such as rubber is adhered to a portion closely contacting the film insertion port 318.

Figure 13:
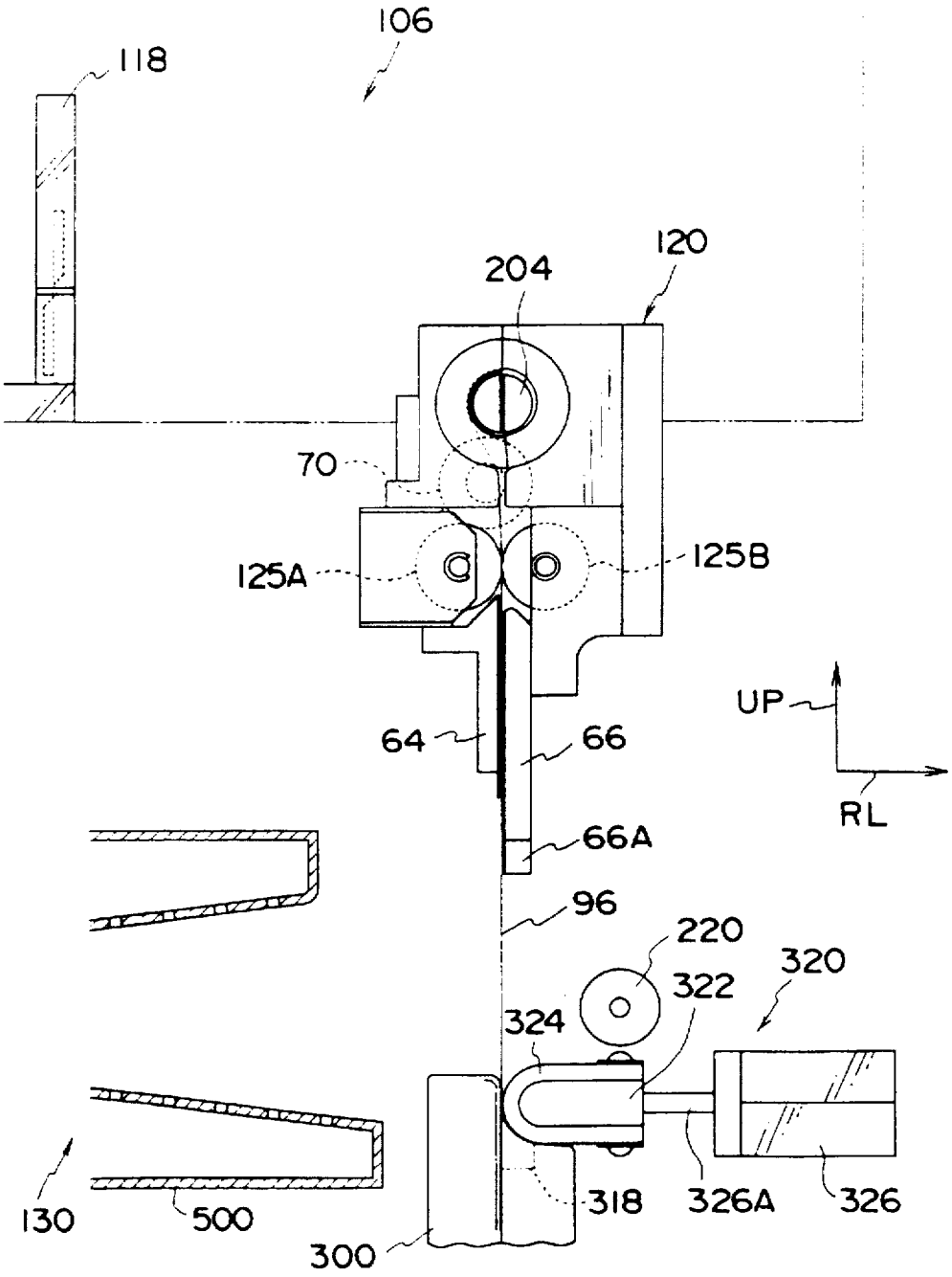
FIG. 13 is a view showing the state where the intermediate cartridge shown in FIG. 12 went up slightly and the processing tank has been closed.

This block 322 is jointed to a movable iron core 326A of a solenoid 326 as shown in FIG. 9, and as shown in FIG. 13, when a current flows through the solenoid 326, the movable iron core 326A presses the block 322 to the film insertion port 318 and an inner space of the processing tank is sealed.

(Path for circulation of a processing liquid)

As shown in FIG. 2, a pipe-shaped connecting section 330 communicated to an internal space of the processing tank is provided at a position near the upper section of the processing tank 300, and this connecting section 330 is connected via piping 336 to a stock tank 332. A processing solution such as a color-developing liquid, a bleaching/fixing liquid, or a rinsing solution is accommodated in the stock tank 332. It should be noted that a plurality of stock tanks are provided for a plurality types of processing liquids.

Also an electromagnetic valve 338 is connected to the piping 336 between the processing tank 300 and the stock tank 332, and a processing solution in the processing tank 300 is returned by this electromagnetic valve 338 is returned into inside of the stock tank 332.

Provided at a lower edge of the processing tank 300 is a pipe-shaped connecting section 334 communicated to an internal space of the tank, and one edge of this connecting section 334 is connected via the piping 344 to the connecting section 342 of the stock tank 332.

A pump 346 and an electromagnetic valve 348 each rotatable in the regular and reverse directions are connected to the piping 344 between the processing tank 300 and the stock tank 332, and the processing solution is supplied by this pump 346 and electromagnetic valve 348 into the processing tank 300. It should be noted that the electromagnetic valves 338, 348, and pump 346 are connected to the control unit 202, and are controlled according to a control signal from the control unit 202. Herein a processing solution supply unit according to the present invention includes the pipings 336 and 344, electromagnetic valves 338 and 348, and pump 346.

(Extruding section)

As shown in FIG. 10, an extruding section is provided under the intermediate cartridge 120 between the guide rod member 127 and the processing tank 300. This extruding section 210 comprises a lengthy box-shaped guide member 212 with the upper section opened, a pair of supporting shafts provided at both edges of this guide member 212 and not shown herein, a motor 214 connecting the right edge support shaft and connected to a right edge of the guide member 212, a belt rotated by this motor 214 and not shown herein, a slider 216 fixed to this belt and sliding right and left on this guide member 212, a guide shaft 218 supported by this slider 216, and a cylindrical roller 220 fixed to a tip of this guide shaft 218.

As shown in FIG. 9, at the initial position (at the position shown in FIG. 9) of the roller 220, the roller 220 is provided at a position opposite to the sealing device 320. Then the roller 220 moves from the initial position indicated by a solid line to the extruded position indicated by the imaginary line.

A material for the roller 220 may be metal such as aluminum, synthetic resin such as POM, rubber such as CR, or other one on the condition that the surface is smooth and does not give any damage to the film 96. Although the roller 220 according to this embodiment has a cylindrical form, a central section of the roller 220 may be recessed to an arched form so that it does not contact an image section of the film 96.

(Drying section)

As shown in FIG. 2, a drying section 130 for drying the film 96 having been subjected to development processing is provided in the left side of the processing tank 300 under the loading section 106. This drying section 130 has a duct 500 having a substantially U-shaped form. An opening 502 is formed in one side wall of the duct 500. This opening 502 forms as a space through which the film 96 goes in.

AS shown in FIG. 2 and FIG. 5, at the position of the opening 502 of the duct 500, a plurality of air blow-out ports 508 each having a slit-shaped form are formed at a specified gap in the front-to-rear direction. A drier 506 comprising a fan and a heater is connected to the left side of the duct 500. It should be noted that, in this embodiment, a temperature sensor not shown herein may be provided in the duct 500.

In this embodiment, air in the duct 500 is heated by the drier 506, and heated air is blown from the air blow-out port 508 to the film 96. For this reason, the film 96 is dried.

Figure 15:
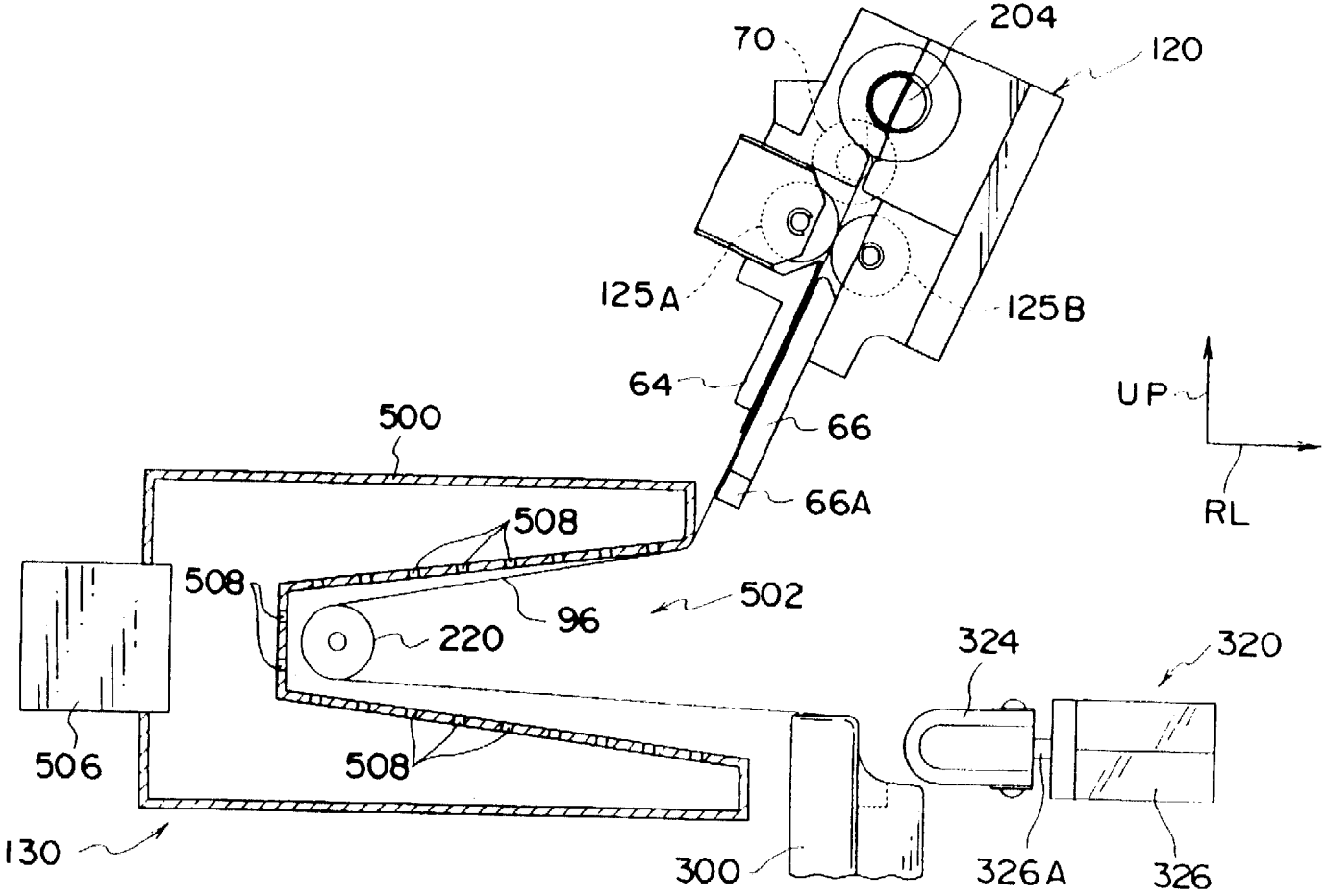
FIG. 15 is a view showing the state where the film shown in FIG. 14 is withdrawn by the roller from the processing tank to be dried.

It should be noted that the drier 506 or a temperature sensor or the like may be connected to the control unit 202 to adjust temperature of heated air blown out from the air blow-out port 508. Also as shown in FIG. 15, a roller or a guide not shown herein may be provided in the section contacting the film 96 in the state where the film 96 is pushed by the roller 220 into the opening 502 of the duct 500 so that the film 56 can move smoothly.

Further, when the film 96 is wound back around the intermediate spool shaft 204, image frames of the film 96 may be read with a read unit not shown herein for printing. Namely, the read unit outputs the image frames of the film 96 as read image data to the control unit 202. The image data supplied to the control unit 202 is output to a printer not shown herein for printing by the printer.

In this case, printing is executed by a separate printer according to the image data read by the read unit, so that the subsequent processing for development and printing for the wound back film 96 or the film 96 wound back is not required.

(Operation)

Next description is made for operation in this embodiment.

The following description for this embodiment assumes a case where the 135-size film 96 is developed. A user (a customer or a worker who received the film 96 from a customer) opens the cover 104 and pulls out the tip 96A of the film 96 not having been subjected to development processing (with a pull-out device not shown herein (Refer to, for instance, to Japanese Patent Laid-Open Publication No. 2229/1980) from the cartridge 19. As shown in FIG. 3, the upper section 120A of the intermediate cartridge 120 is opened, and the tip 96A of the film 96 is inserted into the slit 204A of the intermediate spool shaft 204 for positioning, and the cartridge 94 is mounted on the mounting member 108 (Refer to the imaginary line in FIG. 3 and to FIG. 4) . It should be noted that, the cover 104 shown in FIG. 1 is closed after the cartridge 94 is loaded in the loading section 106.

Figure 6:
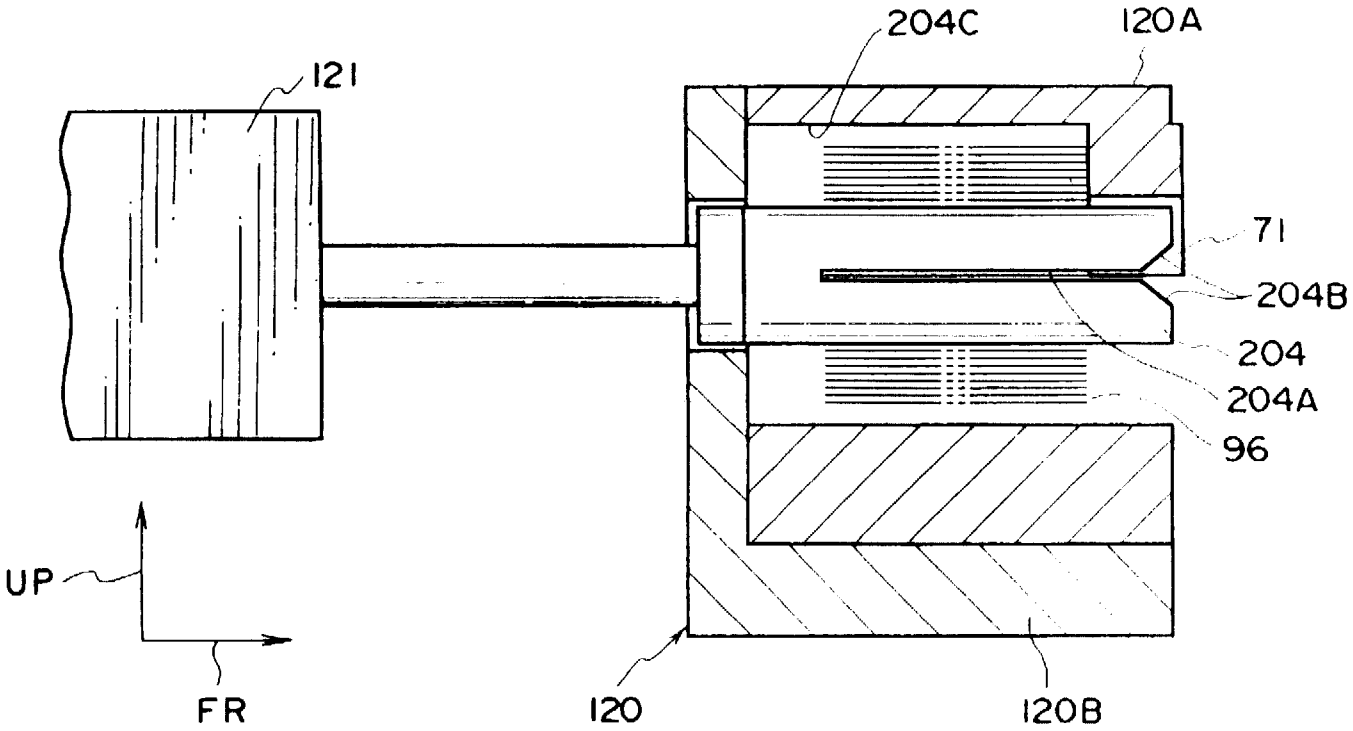
FIG. 6 s a cross-sectional view showing the state where a film is wound around an intermediate spool shaft in an intermediate cartridge.

When the switch 72 shown in FIG. 1 is turned ON, the motors 121, 123 shown in FIG. 4 rotate, and the film 96 held in the slit 204A of the intermediate spool shaft 204 is wound around the intermediate spool shaft 204 (Refer to FIG. 6). When the switch 122 is pressed by the mounting member 108 shown in FIG. 7 and is turned ON, the control unit 202 shown in FIG. 2 determines that the film 96 has completely been wound up. The upper cutter 124A goes down, as shown in FIG. 8, according to a control signal from this control unit 202 to cut the rear edge section 96B of the film 96.

Further, light beam is supplied from the light-emitting element 72 to the light-receiving element 74, and the film 96 is wound around the intermediate spool shaft 204 until the control unit 202 detects the rar edge section 96B of the film 96 (Refer to FIG. 8).

Then the motor 70 shown in FIG. 10 and FIG. 11 rotates, and as shown in FIG. 11, the intermediate cartridge 120 is rotated by 90 degrees counterclockwise (in the direction indicated by the arrow mark CC). Then, a tip 66A of the guide plate 66 is moved to a position opposite to the film insertion port 318 of the processing tank 300. In this state, a rod 126B of the intermediate cartridge carrier 126 shown in FIG. 10 is moved to move the intermediate cartridge 120 downward.

As shown in FIG. 12, the intermediate cartridge 120 stops in the state where the tip 66A of the guide plate 120 has been inserted into the film insertion port 318 of the processing tank 300, and the motors 121, 123 shown in FIG. 3 rotate to insert the film 96 into the processing tank 300.

It should be noted that an insertion rate of this film 96 is determined by the control unit 202 by means of counting the number of pulses from the motors 121, 123. Namely, the film 96 is not separated from the intermediate spool shaft 204, and the film 96 is inserted by a specified length (length of an area where the final image frame is formed) into the processing tank 300.

Then the intermediate cartridge 120 is moved upward by the intermediate cartridge carrier 126 up to a position shown in FIG. 13, and the tip 66A of the guide plate 66 is separated from the film insertion port 318 of the processing tank 300.

As shown in FIG. 13, at the same time when the intermediate cartridge 120 goes up, the block 322 (packing 324) of the sealing device 320 is closely adhered to the film insertion port 318, and development processing is executed inside the sealed processing tank with the rear edge section of the film 96 pressed down. It should be noted that timing of operation of the sealing device 320 as well as of the intermediate cartridge carrier 126 is detected by a sensor or the like not shown herein and is controlled by the control unit 202.

Next description is made for development of the film 96 with a processing liquid.

When the processing tank 300 is sealed up, the pump 346 and electromagnetic valves 338, 348 operate under controls by the control unit 202 in a prespecified sequence, and a color-developing liquid, a bleaching liquid, a fixing liquid, a rinsing liquid, and a stabilizing solution are charged in this order into the processing tank 300 to develop the film 96.

When the film 96 is processed with one type of processing liquid, the processing solution is circulated by the pump 346 in one direction between the stock tank 332 and the processing tank 300, but pump 346 is stopped once at an appropriate timing and then operated to circulate the processing solution in the processing tank in the reverse direction 300. With this operations, the length film 96 can be processed under stable conditions over a span in the longitudinal direction.

When processing with one type of processing solution is over, the processing solution in the processing tank 300 and pipings 336 and 344 are returned to the original stock tank 332, and the processing tank 300 and the pipings 336, 344 are emptied once. Thus replacement of a processing solution with air or vice versa in the processing tank 300 can be carried out by opening or closing the block 322. It should be noted that a dedicated electromagnetic valve may be provided for air communication between inside and outside of the processing tank 300 and air inside the processing tank 330 may be sucked or discharged by the electromagnetic valve when the processing solution is supplied to or discharged from the processing tank 300.

Then, the electromagnetic valve 338 is switched to operate the pump 346, and the next processing solution is sent into the processing tank 300.

When the film 96 has been processed with a color-developing liquid, a bleaching liquid, a fixing liquid, a rinsing liquid, and a stabilizing solution in this order, the block 322 of the sealing device 320 is separated from the film insertion port 318.

It should be noted that, before processing of the film 96 with a processing solution is over, the control unit 202 may allow the drier 506 to be energized to adjust temperature inside the duct 500 to a preset value.

Figure 14:
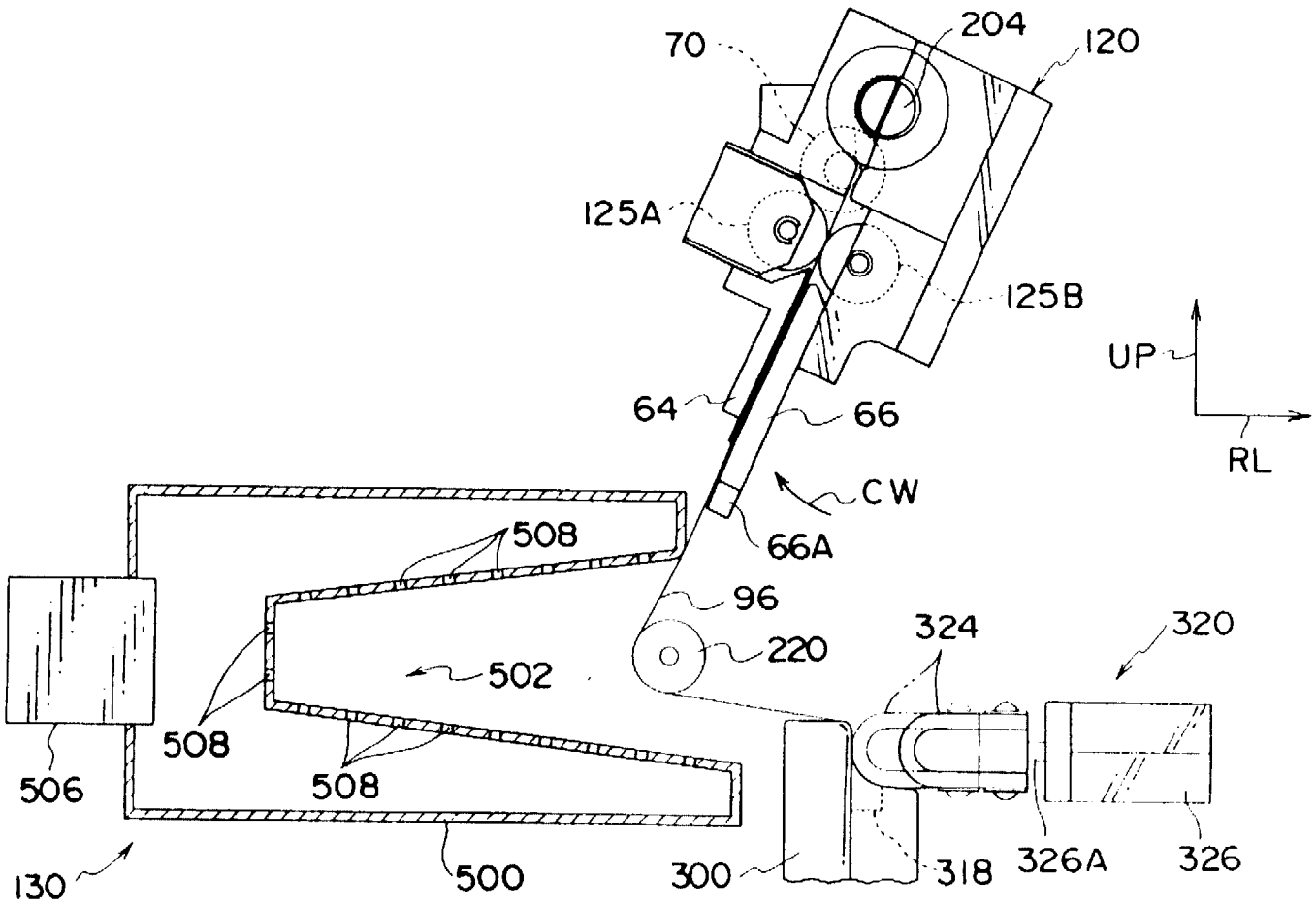
FIG. 14 is a view showing the state wherein the intermediate cartridge shown in FIG. 13 was rotated slightly and a film has been slightly pulled out by a roller from the processing tank.

Then, as shown in FIG. 14, the intermediate cartridge 120 is rotated counterclockwise by the motor 70 from the state shown in FIG. 13 to the state shown in FIG. 14 (in the direction indicated by the arrow mark CC in FIG. 14). It should be noted that a position of this intermediate cartridge 120 is determined by the control unit 202 by means of counting the number of pulses from the motor 70.

When the slider 216 is slid to the left side by rotating the motor 214 in the extruding section 210 shown in FIG. 5, the roller 220 moves to the left side, and the film 96 contacting the roller 220 is withdrawn from the processing tank successively and is sent into the opening 502 of the duct 500. It should be noted that the roller 200 stops at the utmost depth of the opening 502 of the duct 500.

Hot air is blown from the drier 506 to the film 96 sent into the opening 502 of the duct 500, and drying is executed for a period of time and under temperature specified according to a type of the film 96 to be dried.

Although the drier 500 is used in this embodiment, but the configuration is not limited to that described above, and infrared ray from an infrared ray heater or the like may be irradiated to the film 96. Also a drying capacity of the drier 506 can be adjusted by changing an air blowing rate of a fan not shown herein.

When the motors 121, 123 rotate, the film 96 is withdrawn from the processing tank 300, the film 96 withdrawn from this processing tank 300 passes through the opening 502 of the duct 500 at a constant speed (=a feeding rate of the film 96 in the opening 502 of the duct 500/a period of time for drying set according to a type of the film 96) and is wound around the intermediate spool shaft 204 successively.

It should be noted that, when the film 96 is dried while being transferred, by drying the film 96 under higher temperature in a first half of the drying period and under a lower temperature as compared to that employed in the first half period, it is possible to dry the film 96 within a shorter period of time, even with the same quantity of energy, as compared to that when drying is carried out under the same temperature during the entire period of time for drying.

As described above, by differentiating a drying capacity in the side close to the intermediate cartridge 120 and that in the side far from the intermediate cartridge 120, and also by setting conditions for drying when stopped and those while being transferred as described above, the film 96 can be dried within a short period of time with the minimum quantity of energy.

After the film 96 has completely been wound around the intermediate spool shaft 204, the intermediate cartridge 120 is rotated clockwise by the motor 70 from the state shown in FIG. 15 to the state shown in FIG. 8 (initial position). It should be noted that, when the series of operations described above is finished, a buzzer sound indicating end of the operating sequence may be generated or display of "development processing over" may be provided in the display section.

Then the cover opens the cover 104 shown in FIG. 1. Further, as shown in FIG. 3, the upper section 120A of the intermediate cartridge 120 is opened with the tip 96A of the film 96 removed from the slit 204A of the intermediate spool shaft 204, and the film 96 is removed from the intermediate cartridge 120. Also the cartridge 94 is removed from the mounting member 108.

As described above, with the present embodiment, the film 96 is wound from the cartridge 94 to the intermediate spool shaft 204 of the loading section 106 and is retained in the loading section 106, and further is inserted in this state from the loading section 106 into the processing tank 300 for development, so that it is not necessary to bend the film 96 in the processing tank 300 for transport, and in addition such components as a transfer roller for transfer the film 96 are not required, which enables size reduction of the processing tank 300 as well as of the photosensitive material processing apparatus itself.

Also in this embodiment, a plurality types of processing such as color development, fixing/bleaching, and rinsing are carried out in the signal processing tank 300 using a processing solution supply unit comprising the piping 336*s* 336, 344, electromagnetic valves 338, 348, and pump 3046, so that it is not necessary to install a plurality of processing tanks, which enables size reduction of machine and installation even at a small space.

The photosensitive material processing apparatus according to the present invention can be used to process various types of film, namely photosensitive materials, and preferably it is used for processing photosensitive materials for photographing. In other words, the photosensitive material processing apparatus according to the present invention can be used for processing color negative films, color inversion films, and monochrome films. Further a number of types of film is not always limited to two, and three or more types of film (such as 120-size film, 11-size film or the like) may be set for development in this apparatus.

The photosensitive material processing apparatus according to the present invention can be used for processing various types of photosensitive material, and preferably for processing photosensitive materials for photographing. Concretely the photosensitive material processing apparatus according to the present invention can be used for processing color films, color-inversion films, and monochrome films.

Various types of processing solution are used for the photosensitive material processing apparatus according to the present invention.

A color developer tank solution or a replenishing solution for color developer each used for development of a color negative film is a alkaline aqueous solution containing an aromatic primary amine-based color developer as a main component. As the color developer, aminophenol-based compounds are useful, but p-phenyldiamine-based compounds are preferably used, and the representative examples include 3-methyl-4-amino-N, N diethylaniline, 3-methy-4-amino-N-ethyl-N-β-hydroxyeethylaniline, 3-methyl-4-amino-ethyl-N-β-methanesulfonamideethylaniline, 3-methyl-4-amino-N-ethyl-β-methoxyethyaniline, 4-amino-3-methyl-N-methyl-N-(3-hydroxypropyl) aniline, 4-amino-3-methyl-N-ethyl-N-(3-hydroxypropyl) aniline, 4-amino-3-methyl-N-ethyl-N-N-(2-hydroxypropyl) aniline, 4-amino-3-ethyl-N-ethyl-N-(3-hydroxypropyl) aniline, 4-amino-3-methyl-N-propyl-N-(3-hydroxypropyl) aniline, 4-amino-3-propyl-N-methyl-N-(3-hydoxypropyl) aniline, 4-amino-3-methyl-N-methyl-N-(4-hydroxybutyl) aniline, 4-amino-3-methy-N-ethyl-N-((4-hydroxybutyl) aniline, 4-amino-methyl-N-propyl-N-(4-hydroxydibutyl) aniline, 4-amino-3-ethyl-N-ethyl-N-(3-hydroxy-2-methylpropyl) aniline, 4-amino-3-methyl-N,N-bis(4-hydroxybutyl) aniline, 4-amino-3-methyl-N,N-bis(5-hydroxypentyl) aniline, 4-amino-3-methyl-N-(5-hydroxypentyl)-N-(4-hydroxybutyl) aniline, 4-amino-3-methoxy-N-ethyl-N-(4-hydroxybutyl) aniline, 4-amino-3-ethoxy-N,N-bis (5-hydroxypentyl) aniline, 4-amino-3-propyl-N-(4-hydroxybutyl) aniline, and sulfates, hydrochlorides, or p-toluensulfonates thereof. Of these, especially 3-methyl-4-amino-N-ethyl-N-β-hydroxyethylaniline, 4-amino-3-methyl-N-ethyl-N-(3-hydroxypropyl) aniline, 4-amino-3-methyl-N-ethyl-N-(4-hydroxybutyl) aniline, and hydrochlorides and p-toluensulfonates or sulfonates thereof are especially preferable. Two or more of these compounds can be used, if required. A quantity of the aromatic primary amine-based main developer to be used is preferably in a range from 0.0002 mol to 0.2 mol per 1 litter of the color developer, and more preferably in a range from 0.001 mol to 0.1 mol.

The color developer coupling developer) generally contains a pH buffer such as carbonates, borates or phosphates, or 5-sulfosalicylates of any alkali metal, a development suppressor such as chloride salts, bromide salts, iodide salts, benzimidazoles, benzothiazoles or melcapto compounds, or a fogging-preventive agent. If required, the color developer may contain, in addition to hydroxylamine and diethylhydroxylamine, hydroxylamines expressed by the general formula in Japanese Patent Laid-Open Publication No. 1991/ 144446; sulfites; hydrazines such as N,N-biscalboxymethylhydrazine, phenylsemicarbazides; various types of preservatives such as triethanol or catecholsulfates; organic solvents such as ethylenegrychol, dethylenegrychol; a development promoter such as benzylalchol, polyethylenegrychol, quaternary ammonium salts, amines; a supplementary main developer such as a color-element forming couplers, conflict couplers, or 1-phenyl-3-pyrazorydon; a viscosity adding agent; various types of chelating agent represented by, for instance, aminopolycarbonate, aminopolyphosphonate, alkylphosphonate, phosphonocarbonate; and various types of compounding agent represented by, for instance, ethylenediamine tetraacetate, nitrilotriacetate, diethylenetriamine pentoacetate, cyclohexanediamine tetraacetate, hydroxyethyliminodiacetate, 1-hydroxyethyliden-1,1-diphosphonate, nitrilo-N,N,N-trimethylenephosphonic acid, ethylenediamine-N,N,N,N-tetramethylenephosphonate, ethylenediamine-di(o)-hydroxyphenylacetate, and the salts thereof.

Of the compounds described above, as preservatives, not-substituted hydroxylamine or substituted hydroxylamine is most preferable, and especially diethylhydroxylamine, monomethylhydrolamine, or a compound having an alkyl group substituted with a water-soluble group such as sulfo group, carboxy group, or a hydroxyl group is preferable. The most preferable examples are N,N-bis(2-sulfoethyl) hydroxyl amine and alkali metal group thereof.

As a chelating agent, a compound having the biosolubability is preferable. The examples include the chelating agents described as described in Japanese Patent Laid-Open Publications, No. 146998/ 1988, No. 199295/ 1988, No. 267750/ 1988, No. 267751/ 1988, No. 229146/ 1990, No. 186841/ 1991, German Patent No. 3,739,610, European Patent No. 468,325 or other documents.

Temperature required for processing with a coupling developer is in a range from 20° to 55° C., and preferably in a range from 30° to 55° C. The processing period is in a range from 30 seconds to 4 minutes, and preferably in a range from 45 seconds to 3 minutes 20 seconds. Most preferably the temperature is in a range from 60 seconds to 120 seconds.

In this processing method, a photosensitive material is subjected to color development and then to desilverization. In the desilverization process, both photosensitive materials are preferably processed with a common tank solution as well as with a common supplementary liquid. However, a quantity of the supplementary solution to be used can be set to a different value according to each photosensitive material. Next detailed description is made for the desilverization process.

The desilverization processing generally includes a bleaching process, a bleaching/fixing process, and a fixing process, so that various types of process are involved in the desilverization process. Concrete processes are enumerated below, but the desilverization process may other types of process.

(Process 1)Bleaching/fixing
(Process 2)Bleaching—Bleaching/fixing
(Process 3)Bleaching—Bleaching/fixing—fixing
(Process 4)Fixing—bleaching/fixing
(Process 5)Bleaching—fixing Each of the processes may be divided to two or more subprocess, or may be supplemented by the cascade method.

As a bleaching agent having the bleaching capability, amonopolycarbonnate iron (III) complex, persulfate, bromate, hydrogen peroxide, and hexacyanoferrate or the like are used, and most preferably aminopolycarbonate (III) complex is used.

The ferric salt used in this processing may be added and dissolved as an ironic complex salt previously complexed, or the complex salt may be formed in a solution in which a complexing compound and ferric salt (for instance, ferric sulfate, ferric chloride, ferric bromide, nitrate iron (III), sulfate iron (III) ammonium or the like) coexist and also which has the bleaching capability.

A quality of the complex-forming compound may be slightly larger than that required for forming a complex with ferric ions, and when added excessively, it is preferable to increase the quantity by a range from 0.01 to 10%.

The compound forming a ferric salt in the solution having the bleaching capability includes, but not limited to, ethylenediamine tetraacetate (EDTA), 1,3-propanediamine tetraacetate (1,3-PDTA), diethylenetriamine pentaacetate, 1,2-cyclohexandiamine tetraacetate, iminodiacetate, methyliminodiacetate, N-(2-acetamide) iminodiacetate, nitriilotriacetate, N-(2-carboxylethyl) iminodiacetate, N-(2-carbomethyl) iminodipropionate, β-alaninediacetate, α-methyl-nitrilotriacetate, 1,4-diminobutane tetraacetate, grycoletherdiamine tetraacetate, N-(2-carboxyphenyl) iminodiacetate, ethylenediamine-N-(2-carboxylphenyl)-N,N',N'-triacetate, ethylenediamine-N,N'-disuccinate, 1,3-diaminopropane-N,N'-disuccinate, ethylenediamine-N,N'-dimalonate, 1,3-diaminopropane-N,N'-dimalonate.

Density of ferric salt in the processing solution having the bleaching capability is generally in a range from 0.005 to 1.0 mol/l, preferably in a range from 0.01 to 0.50 mol/l, and more preferably in a range from 0.02 to 0.30 mol/l.

Density of a ferric salt in the replenishing solution for the processing solution having the bleaching capability is in a range from 0.005 to 2 mol/l, and more preferably in a range from 0.01 to 1.0 mol/l.

In a bath having the bleaching capability or prebaths therefor, various compounds may be used as a beaching promoting agent. For instance, the compound having a mercapto group or a disulfide bond as described in U.S. Pat. No. 3,893,858 Specification, German Patent No. 1,290,812 Specification, Japanese Patent Laid-Open Publication No. 95630/1978, Research Disclosure No. 17129 (July, 1978), thiourea-based compound as described in Japanese Patent Publication No. 8506/1970, Japanese Patent laid-Open Publication No. 20832/ 1977, Japanese Patent Laid-Open Publication No. 32735/ 1978, U.S. Pat. No. 3,706,561 or other documents, or halides such as iodine or bromine are preferable as the compounds are excellent in the bleaching capability.

Further a bath having the bleaching capability may contain rehalogenating against such as bromide (such as potassium bromide, sodium bromide, ammonium bromide), or chloride (such as potassium chloride, sodium chloride, ammonium chloride), or iodine (such as ammonium iodine). If required, one or more inorganic acids, organic acids, alkali metal or ammonium salt of these acids each having the pH buffering capability such as borax, sodium metaborate, acetic acid, sodium acetate, sodium carbonate, potassium carbonate, phosphorous acid, phosphoric acid, sodium phosphate, citric acid, sodium citrate, tartaric acid, malonic acid, succinic acid, glutaric acid, or corrosion preventive such as ammonium nitrate, or guanidine may be added.

Also the bath having the bleaching capability may contain other various types of fluorescent brightener, antifoamer, or surface surfactant, or an organic solvent such as polyvinylpyrrolidone, or methanol.

As a fixing components in the bleaching/fixing liquid, or a fixing liquid, a thiosulfate salt is preferably used. The thiosulfate salt includes sodium thiosulfate, potassium thiosulfate, ammonium thiosulfate or the like. Other known fixing agents including thiocyanates such as sodium thiocyanate, ammonium thiocyanate; thioether compounds such as ethylenebistiogrycholate, 3,6-dithia-1,8-octanediol, and water-soluble halogenized silver solvent such as mesoion compounds and thiourea compounds. In this invention, thiosulfate salts, especially thiosulfate ammonium salt, thiosulfate potassium salt, and thiosulfate sodium salt should preferably be used. A total quantity of a fixing agent is preferably in a range from 0.3 to 3 mol, and more preferably in a range from 0.5 to 2.0 mol.

The bleaching/fixing agent or fixing agent should preferably contain, as preservatives, sulfite (or bisulfites or metabisulfites), and the quantity is preferably in a range from 0.03 to 0.5 mol/l, and more preferably in a range from 0.05 to 0.3 mol/l.

The bleaching/ fixing solution or a fixing solution may contain, in addition to a sulfite ion releasing compound such as the sulfites (such as sodium sulfite, potassium sulfite, ammonium sulfite), bisulfite (such as ammonium bisulfite, sodium bisulfite, potassium bisulfite), metabisulfite (such as potassium metabisulfite, sodium metabisulfite, ammonium metabisulfite) as preservatives, aldehydes ( such as benzaldehyde, acetaldehyde), ketones (such as acetone), ascorbates, hydroxylamines, benzensulfinates, alkylsulfinates, if required. Especially benzensulfinic acid, p-methylbenzensulfinic acid, p-aminobenzenfulfinate or the like should preferably be used. A preferably quantity of the compound above is in a range from around 0.005 mol to 0.3 mol/l.

Further, a buffer, a fluorescent brightener, a chelating agent, a antifoamer, or a mildewproofing agent maybe added to the bleaching liquid, bleaching/fixing liquid, or fixing liquid.

A preferable pH area of the bleaching liquid, bleaching/ fixing liquid, and fixing solution is preferably in a range from 4 to 8, and more preferably in a range from 4.5 to 6.5.

A quantity for supplement to the bleaching liquid, bleaching/fixing liquid, or fixing solution is in a range from 50 to 2000 milliliters per 1 $m^2$ of photosensitive material. Also a over-flow solution as a rinsing solution or for bathing for stabilization may be added according to the necessity.

Processing temperature of the bleaching liquid, bleaching/ fixing liquid, or fixing solution is in a range from 20° to 50° C., and preferably in a range from 30° to 45° C. The processing time for each process is in a range from 10 seconds to 3 minutes, and preferably in a range from 20 seconds to 2 minutes.

It is especially preferable to carry out aeration, when processing with a processing solution with the bleaching capability, for the purpose to maintain the photographing capability under stable conditions. A known unit in the art may be sued for aeration, and blowing air into a processing solution with the bleaching capability or absorption of air by making use of an ejector can be carried out.

Aeration may directly be carried out in a processing tank, but as the photosensitive material processing apparatus according to the present invention has a small tank capacity, so that aeration should preferably be carried out in a processing solution storage tank.

When blowing air into a processing liquid, it is preferable to release air through a diffusing pipe with fine pores into the processing liquid. The diffusing pipe as described above is widely used in an aeration tank for active sewage treatment or the like. As for aeration, the information described in Z-121, Using Process C-41 Edition, Ver. S (1982) , pages BL-1 to BL-2 Eastman Kodac is useful. In the processing with a processing solution having the bleaching capability, it is preferable to carry out enhanced agitation, and for its purpose the information described in page 8, right upper column, line 6 to left bottom column, line 2 of Japanese Patent Laid-Open Publication No. 33847/1991 is available as it is.

In the photosensitive material processing material according to the present invention, when executing aeration, it is preferable to carry out aeration in a circulation system or a processing solution storage tank or the like.

A photosensitive material generally undergoes, after desilverization process, rinsing and/or stabilization. In the rinsing and/or stabilizing process, adjustment is required so that density of residual thiosulfaric acid in the photosensitive material already having been processed is in a range from 30 to 1500 micromol/$m^2$.

Concretely adjustment should preferably be made so that density of thiosulfate in the final bath is in a range from around 0.001 to 0.04 mol/l. Namely, the compound may be added in the final bath to attain the density described above, and when thiosulfate is used as a fixing component, a quantity of the compound added for supplement in the subsequent rinsing or stabilizing process should preferably be reduced so that the density in the final bath as described above is attained.

The actual quantity required for supplement varies according to density of thiosulfate in the fixing process or to a number of baths in the rinsing process or stabilizing process, but generally the quantity is in a range from 100 to 1000 milliliters, and preferably in a range from around 130 to 700 milliliters.

When deciding a quantity of water used in the rinsing process, a relation between a number of rinsing tanks and a flow rate of water in the multi-stage counterflow system can be obtained according to the method described in Journal of the Society of Motion Picture and Television Engineers Vol. 64, p. 248 to 253 (May issue, 1955). With the multi-state counterflow system described in the document above, a quantity of water used for rinsing can substantially be reduced, but because the time for water to reside in a tank becomes longer, bacteria grow, and generated floating materials are disadvantageously deposited on the photosensitive material.

To solve the problems as described above when processing a photosensitive material, the method of reducing calcium ions and magnesium ions described in Japanese Patent Laid-Open Publication No. 288,838/1987 can effectively be used. Also the isothiazolon compounds described in Japanese Patent Laid-Open Publication No. 8,542/1982, chlorine-based bactericides such as thiabendazoles, chloride isocyanurate sodium, and other types of bactercides described in "Chemistry of Bacteriaproofing/ Mildewproofing Agents" by Hiroshi Noguchi (1986), Sankyo Shuppan, "Technology for Sterilization, Disinfection, and Mildewproofing" edited by the Society of Sanitary Technology, "Dictionary of Bacteriaproofing/ Mildewproofing Agents" edited by the Japanese Society of Bacteriaproofing/Mildewproofing Technology 0(1986).

pH of the final bath when processing a photosensitive material may be set to any value, but the value is preferably in a range from 3.5 to 8, and more preferably in a range from 4 to 7. The pH should preferably be set so that it is reflected to a film pH of the photosensitive material already processed, and various types of buffer solution may be used for that purpose. Concretely malonic acid, succinic acid, malic acid, maleic acid, phthalic acid may be sued for that purpose.

Temperature of water used for rinsing and a period of rinsing with water may be set according to characteristic of the photosensitive material or its application, but generally the values are set to 20° to 45° C. and 20 seconds to 5 minutes, and preferably to 25° to 40° C. and 30 seconds to 3 minutes. Further the photosensitive material according to the present invention may directly be treated by a stabilizing solution in stead of being rinsed with water. In the processing for stabilization as described above, all the methods described in, for instance, Japanese Patent Laid-Open Publications No. 8543/1982, No. 14834/1983, and No. 220345/ 1985 can be used.

The stabilizing solution contains a compound for stabilizing an images formed with color elements such as formalin, benzaldehydes such as m-hydroxybenzaldehyde, addition product of formaldehyde bisutfite, hexamethylenetetramine and its derivate, hexabydrotriazin and its derivative, dimethylolurea, N-methylol compounds such as N-methylolpyrazol, organic acids, or pH buffering solution. A quantity of these compounds to be added is preferably in a range from 0.001 to 0.02 mol per 1 litter of stabilizing liquid, but lower free formaldehyde density in the stabilizing solution is preferable because a quantity of diffused formaldehyde becomes smaller. From the viewpoint as described above, it s preferable to use, as the color-element image stabilizing solution, N-methylolazols described in Japanese Patent Laid-Open Publication No. 270344/1992 such as m-hydroxybenzaldehyde, hexamethylenetetramine, N-methylolpyrazol or azolilmethylamines described in Japanese Patent Laid-Open Publication No. 313753/1992 such as N,N'-bis (1,2,4-triazol-1-ilmethyl) piperazine. Especially concurrent use of azols described in Japanese Patent Laid-Open Publication No. 359249/1992 (corresponding to European Patent Laid-Open Publication No. 519190A2) such as 1,2,4-triazol, and azolilmethylamine or its derivative such as 1,4-bis (1,2,4-triazol-1-ilmethy) piperazine is preferable because stability of an image is high and a vapor pressure of formaldehyde is low. Also it is preferable to add ammonium compounds such as ammonium chloride or ammonium sulfite, compounds of metal such as bi or Al, a fluorescent brightener, a harder, alkanolamine as described in U.S. Pat. No. 4,786,582, preservatives which may be contained in the fixing solution or bleaching/fixing solution as described above such as, for instance, the fulfinate compound described in Japanese Patent Laid-Open Publication No. 231051/ 1989.

The rinsing solution and/or stabilizing solution may contain various types of surface surfactant to prevent generation of non-uniformity in water droplets when the photosensitive material is dried after processing. A nonion surface surfactant should preferably be used, and especially an alkylphenolethyleneoxide addition product should preferably be used. As alkylphenol, especially pentyl, nonyl, dodecyl, and dinonylphenol are preferable, and a number of added moles of ethyleneoxide is preferably in a range from 8 to 14. Also use of silicon-based surface surfactant having high antifoaming effect is preferable.

It is preferable to add various types of chelating agent to the rinsing water and/or stabilizing liquid. Preferable chelating agents include, but not limited to, aminopolycarbonic acids such as ethylenediamine tetraacetate, diethyleneamin pentaacetate; organic phosphoric acids such as 1-hydroxyethylidene-1, 1-diphosphonic acid, N,N,N'-trimethylenephosphonic acid, diethylenetriamine-N,N,N', N'-tetramethylenephosphonic acid; or hydrolyzed products of anhydrous maleinic acid polymer described in European Patent No. 345,172A1.

Embodiment 2

Figure 16:
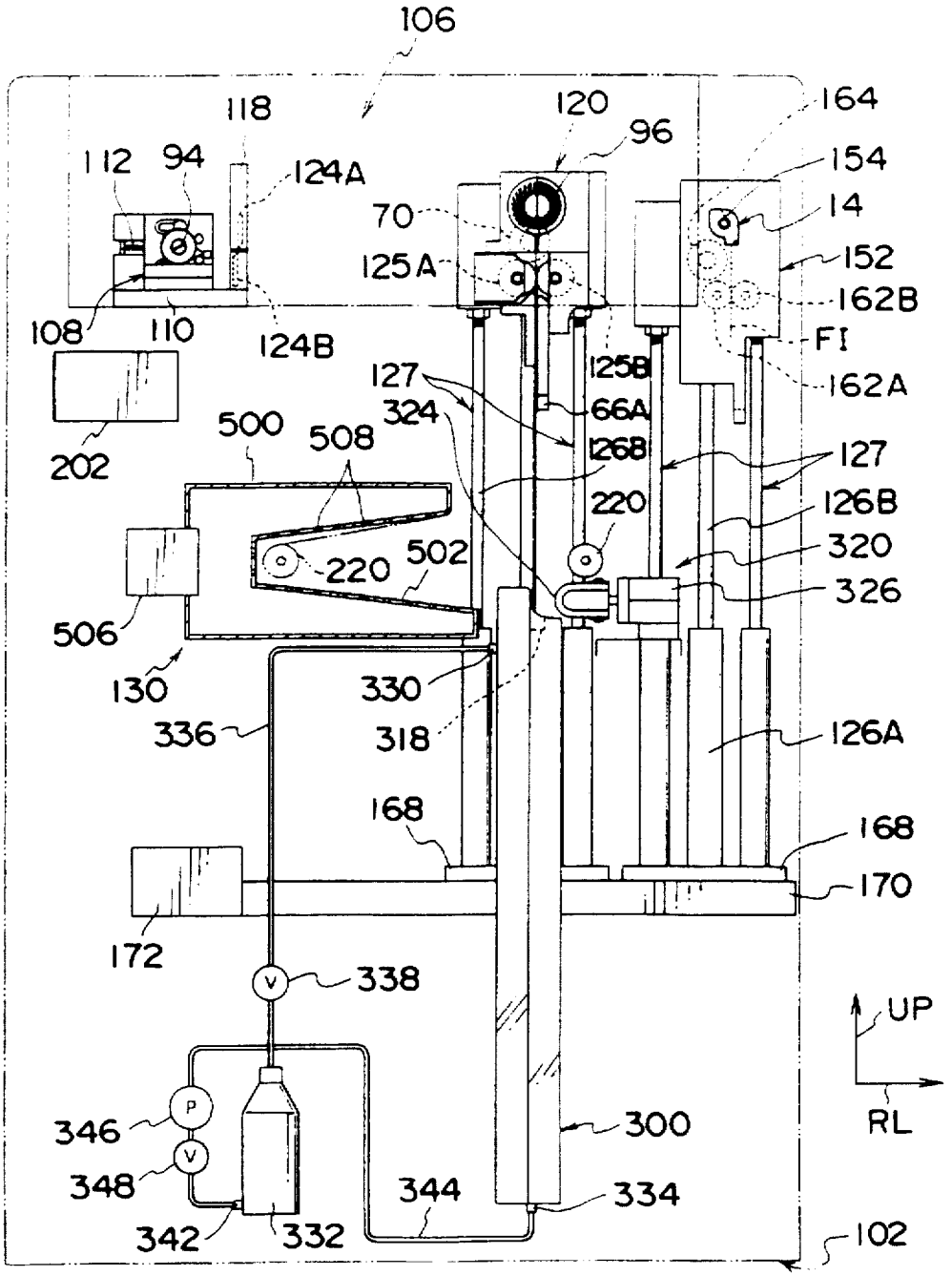
FIG. 16 is a view showing a key section of the processing according to Embodiment 2 of the present invention.
Figure 17:
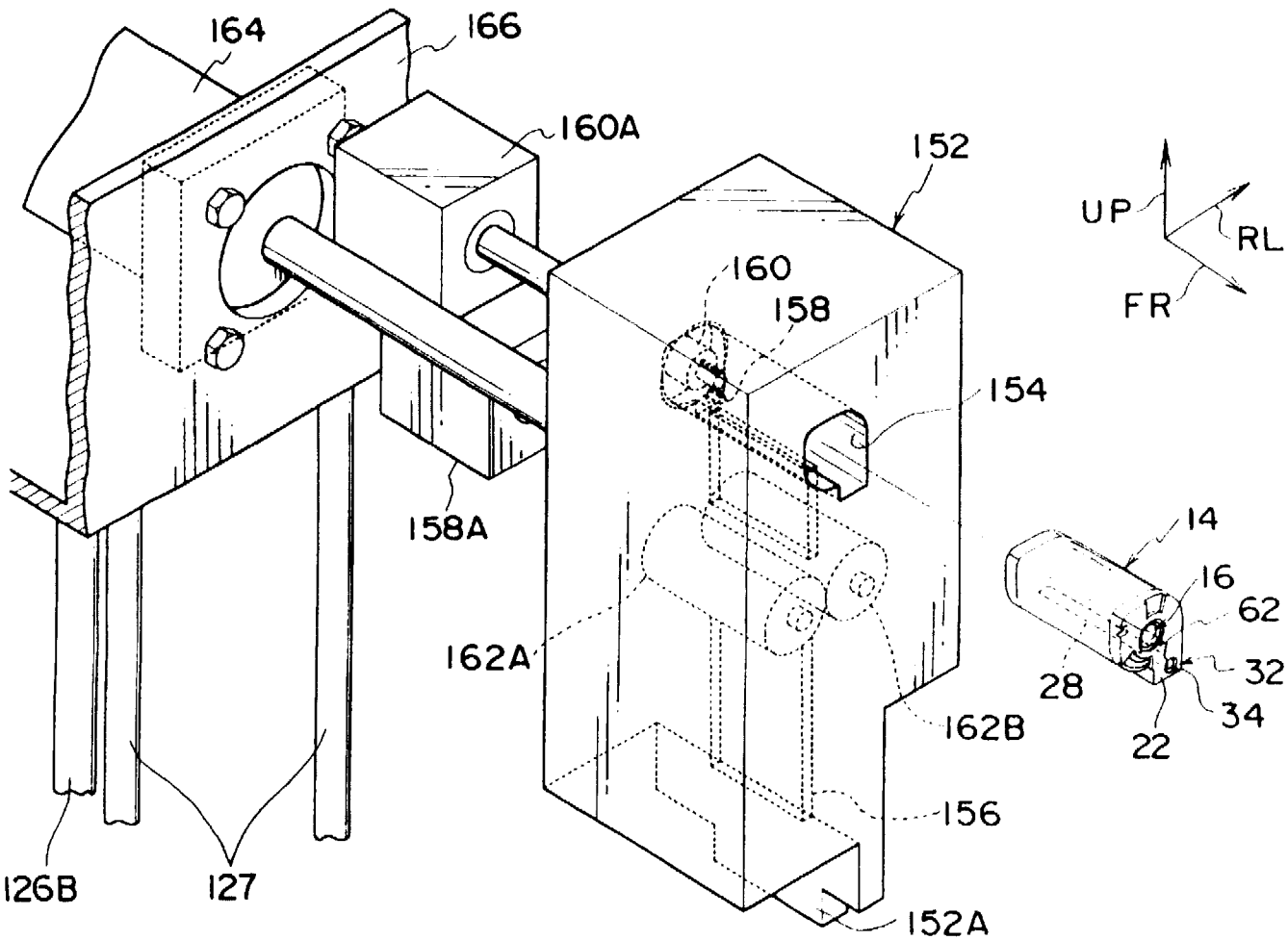
FIG. 17 is a perspective view showing the second loading section shown in FIG. 16.
Figure 18:
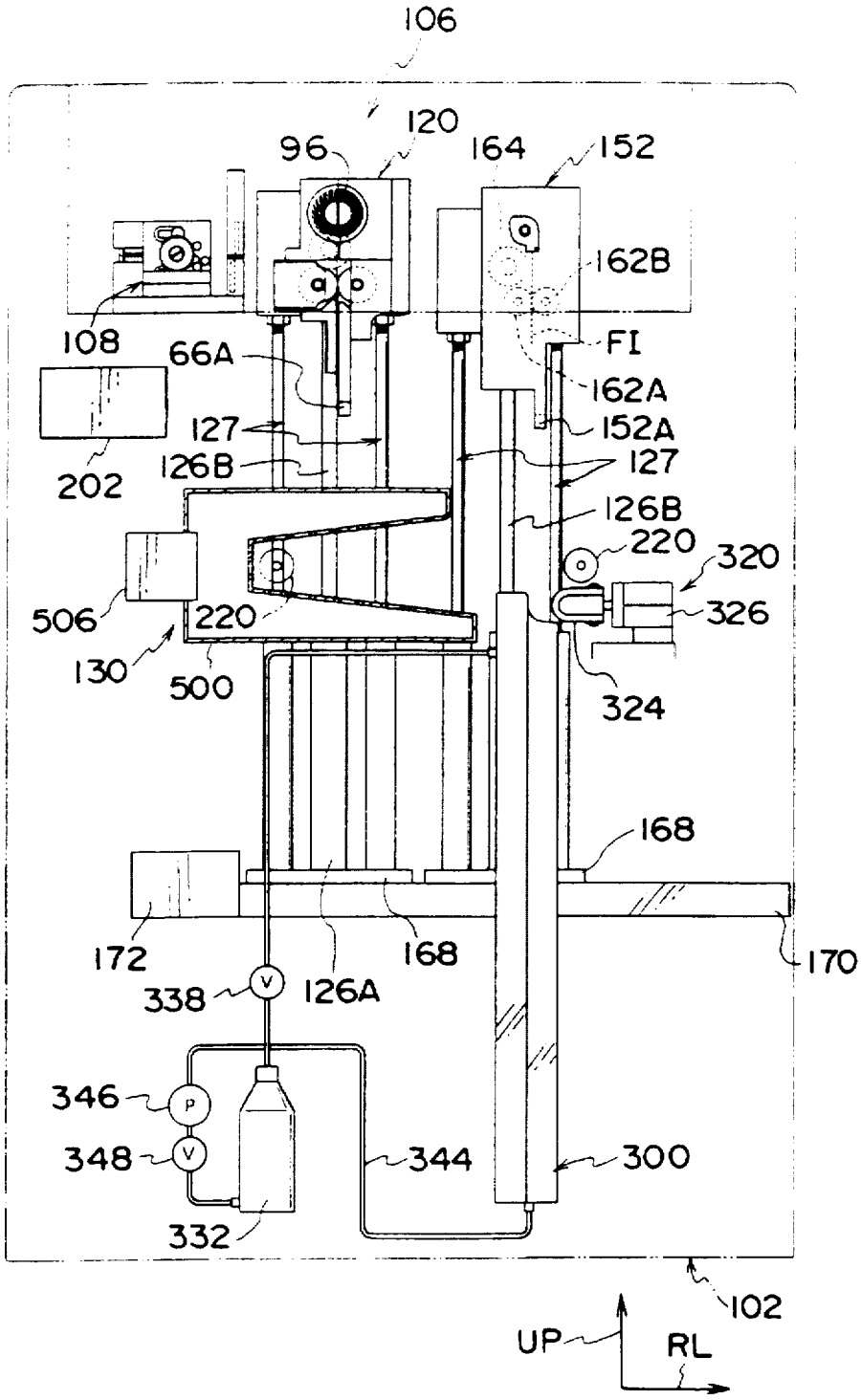
FIG. 18 is a view showing the state where the second loading section shown in FIG. 17 has been moved by a moving unit.

As shown in FIG. 16 to FIG. 18, in Embodiment 2 of the present invention, a second loading section 152 according to the fourth aspect is provided at a position opposite to the loading section 106. It should be noted that the same reference numerals are assigned to the same components as those shown in FIG. 1 and detailed description thereof is omitted herein.

As shown in FIG. 17, a recessed section 154 for loading a cartridge 14 therein is formed in the second loading section 152. The recessed section 154 is formed with the same form as the external form of the cartridge 14.

A second film container according to the present embodiment is the cartridge 14 for APS as shown in FIG. 17. Next description is made for configuration of this cartridge 14. It should be noted that a cartridge 94 according to this embodiment is the first film container described in claim 4, and the loading section 106 is the first loading section described in claim 4. Although not shown herein, a select button for selecting which of the 135-size film 96 and a film F1 for APS is to be developed is provided on a front panel 102A shown in FIG. 1.

As shown in FIG. 17, a projecting section 22 projecting in the tangential direction is formed on the cartridge 14. A slit-formed insertion port 28 is formed at a tip of this projecting section 22. This insertion port 28 is closed with a door not shown herein, and light is prevented from coming into the cartridge 14. Also a spool shaft 16 with the final edge section of the film FI fixed thereon is provided in the cartridge 14, and both edges of this spool shaft 16 in the axial direction thereof are rotatably supported.

A door shaft is rotatably born by the projecting section. This door shaft 32 rotates together with a door not shown herein, and the door rotates together with the door shaft 32 with the insertion port 28 closed. It should be noted that key holes 34 for engagement with a unit for rotating the door shaft 32 (door driver 158 described later) are formed at both edges of the door shaft 32. A label not shown herein is adhered to an external peripheral surface of the cartridge 14. Two stages of bar code each including various types of data such as a cartridge ID (ID number), a film type, a number of photographed images (a number of image frames) or the like are printed on this label.

Also a key hole 62 is formed on an edge face of the spool shaft 116 in the cartridge 14, and when the spool shaft 16 is engaged in this key hole 63, a driving force is delivered to the spool shaft 16.

As described above, configuration of this cartridge 14 (including the outer appearance) is different from configuration of the cartridge 94 (Refer to FIG. 1) for the 135-size film 96 described above. For this reason, configuration of the loading section 152 is different from that of the intermediate cartridge 120.

A shown in FIG. 16, perforation not shown for clearly showing positions of image frames are formed on the film FI at one edge section in its lateral direction at a specified space, and this perforation is used for positioning image frames when such an operation as exposure or printing is executed.

Also a bar code not shown herein and corresponding to a bar code on a cartridge is formed on the film FI. This bar code indicates a frame number of each image frame, a producer's name, a type of film or other data, and the bar code is formed as a latent image in the production stage for the film FI, and is changed to a visible image when developed.

As shown in FIG. 17, in the recessed section 154 of the loading section 152, a projecting section 22 (insertion port 28) of the cartridge 14 is formed so that it extends downward. Also in the loading section 152, a slit 156 through which the film 96 in the cartridge 14 can be inserted or taken out therethrough is provided at a position opposite to the insertion port 28 of the cartridge 14 accommodated in the recessed section 154. In a portion of this slit 156 in the side of loading section 152, a pair of rollers 162A, 162B for feeding out the film FI to the side of tip (lower edge) 152A of the loading section 152 or to the contrary side are arranged at positions opposite to each other.

The left side roller 162A is rotatably supported, while the right side roller 162B is jointed to the motor 164. It should be noted that the control unit 202 determines a feed rate of the film FI by counting the number of pulses from the motor 164.

In the loading section 152, a chucking unit not shown herein and having a door driver for opening and closing a door 30 of the cartridge 14 and a spool driver 160 for rotating the spool shaft 16 is provided at a position opposite to the key hole 34 formed in the door shaft 32. Motors 158 and 160A are jointed to the door driver 158 and the spool driver 160 respectively. It should be noted that, although the door driver 158 and motor 158A are arranged in the rear side in FIG. 17, they should originally be arranged in the front side.

Although not shown in the figure, the spool driver 160 is provided also in the front side. Usually the door driver 158 shown in FIG. 17 and the other spool diver not shown in the figure are saved at a position away by a specified range from the cartridge 14.

When the switch 74 shown in FIG. 1 is turned ON, the door driver 158 and the other spool driver move toward the cartridge 14 by a specified range. For this reason, the door driver 158 engages in the key hole 34 of the door shaft 32, while the spool driver 160 engages in the key hole 62 of the spool shaft 16.

The door driver 158 and spool driver 160 are rotated by the motors 164 and 160A respectively, and a key (projection) for engaging in a key hole is formed on a side face of the shaft.

It should be noted that the motor 164 is mounted on an L-shaped bracket 166, and a second loading section 152 is supported via this motor 166 by the bracket 166. Also there is provided only one unit of roller 220 for the processing tank 300 as well as for the extruding section 210 (Refer to FIG. 5) respectively. For this reason, there is provided the moving unit described later, which moves tips of the film 96 accommodated in the loading section 106 and film FI accommodated in the loading section 152 to positions each opposite to the film insertion port 318 of the processing tank 300.

As shown in FIG. 16, the processing tank is previously positioned at a position where the film insertion port 318 thereof opposes to the tip 66A of the guide plate 66 when the intermediate cartridge 120 is rotated clockwise by 90 degrees. Namely, the positions shown in FIG. 16 are the initial ones for the loading section 106 and loading section 152.

As shown in FIG. 16 and FIG. 18, the loading section 106 and loading section 152 are fixed via the intermediate cartridge carrier 126 shown in FIG. 5 to the slider 168. This slider 168 is jointed to a gear constituting a portion of the moving unit but not shown herein. This gear is jointed to the motor 172, and when this motor rotates, the gear rotates to move the slider 168 right and left. It should be noted that a wire, a sprocket, a belt, a hydraulic mechanism or the like may be used as the moving unit according to the present invention.

Next description is made for actions in the present embodiment. It should be noted that the case where the 135-size film 96 is developed is the same as that described in reference to the embodiment shown in FIG. 1 and description thereof is omitted herein.

In this embodiment, the cartridge for APS is inserted into the recessed section 154 of the loading section 152. A select button for the film FI for APS not shown herein is operated. Then the motor 172 rotates, and as shown in FIG. 18, the slider 168 moves toward the left side.

The loading section 152 stops at a position where the insertion/passage port 28 of the cartridge 14 (namely, the slit 156 of the loading section 152) opposes to the film insertion port 318 of the processing tank 300. The subsequent operations are the same as those in the embodiment shown in FIG. 1, so that description thereof is omitted herein.

It should be noted that, when all the processing such as operations for developing and drying the film FI are over, the door driver 158 shown in FIG. 17 presses to a position where the cartridge 14 can be picked up from the recessed section 154 of the loading section 152. As a tool for picking up this cartridge 14, an air cylinder, a spring, a solenoid or the like may be provided.

Also in this embodiment, data of a type of the film FI or 96 (including data on a manufacturer, color or monochrome, negatives, reversal or the like) and drying conditions for each type of film may previously be stored in the control unit 202, and the drying conditions may be set according to the conditions for drying according to the film type read from bar code of the cartridge as well as from that of the cartridge 94.

In the present embodiment, the first loading section 106 and second loading section 152 are provided, so that both the 135-size film 96 and APS film FI can be developed in the same processing tank 300 in a common photosensitive material processing apparatus, which eliminates the necessity for providing separate photosensitive material processing apparatuses and also enables cost reduction as well as installation at a small space.

Embodiment 3

Figure 19:
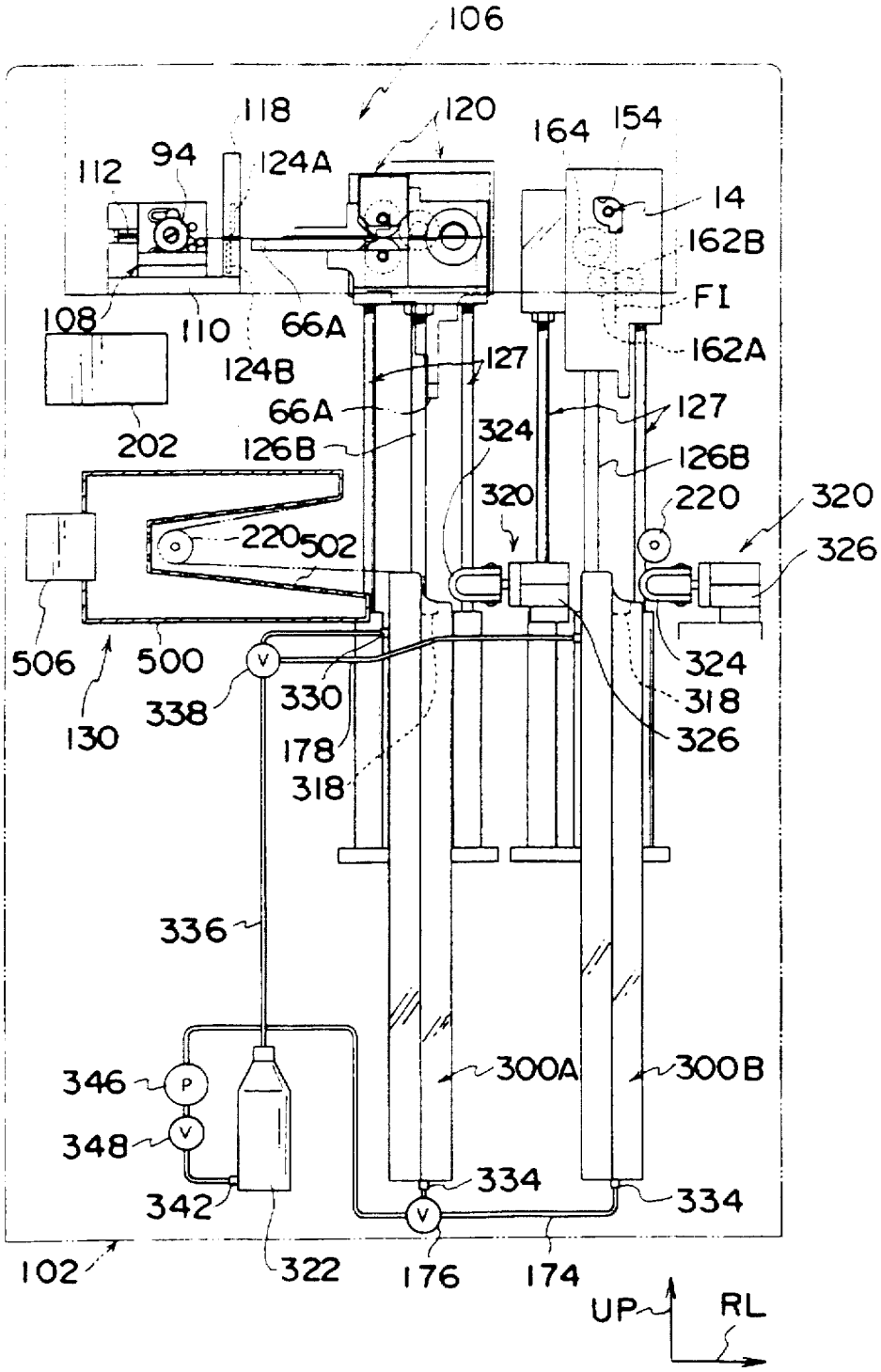
FIG. 19 is a view showing a key section of the processing according to Embodiment 3 of the present invention.

As shown in FIG. 19, in Embodiment 3 of the present invention, processing tanks 300A and 300B are provided for the first loading section 106 and second loading section 152 respectively. It should be noted that the same reference numerals are assigned to the same components as those in FIG. 16, and detailed description thereof is omitted herein.

As shown in FIG. 19, in its embodiment, as the processing tanks 300A and 300B are provided for the first loading section 106 and second loading section 152 respectively, so that also the extruding sections shown in FIG. 5 are provided for the tanks respectively.

Piping 174 is connected via an electromagnetic valve 176 (3-port 2-position switching valve) to pair of the tanks 300A, 300B and to the piping 344. It should be noted that the processing tank 300B is jointed via piping 17 to the electromagnetic valve 338 (3-port 2-position switching valve in this embodiment).

In this embodiment, the film 96 loaded in the first loading section and the film FI loaded in the second loading section are developed and processed in the processing tanks 300A and 300B respectively. Other actions and effects are the same as those in the example shown in FIG. 16, and description thereof is omitted herein.

In each of the embodiments described above, a printer may be provided in the processor 100, and in this case, images on the film may be read with such a device as a CCD and printed by a color printer based of the ink-jet system, heat-sensing system, or the like, and further a print of each image may be obtained by processing ordinary developing paper, and the method of obtaining a print is not limited to the methods described above.

Although the above description of the present embodiment assumed a case where the number of processing tanks was two, three or more processing tanks may be provided so that three or more strings of film can be developed simultaneously.

Embodiment 4

Figure 34:
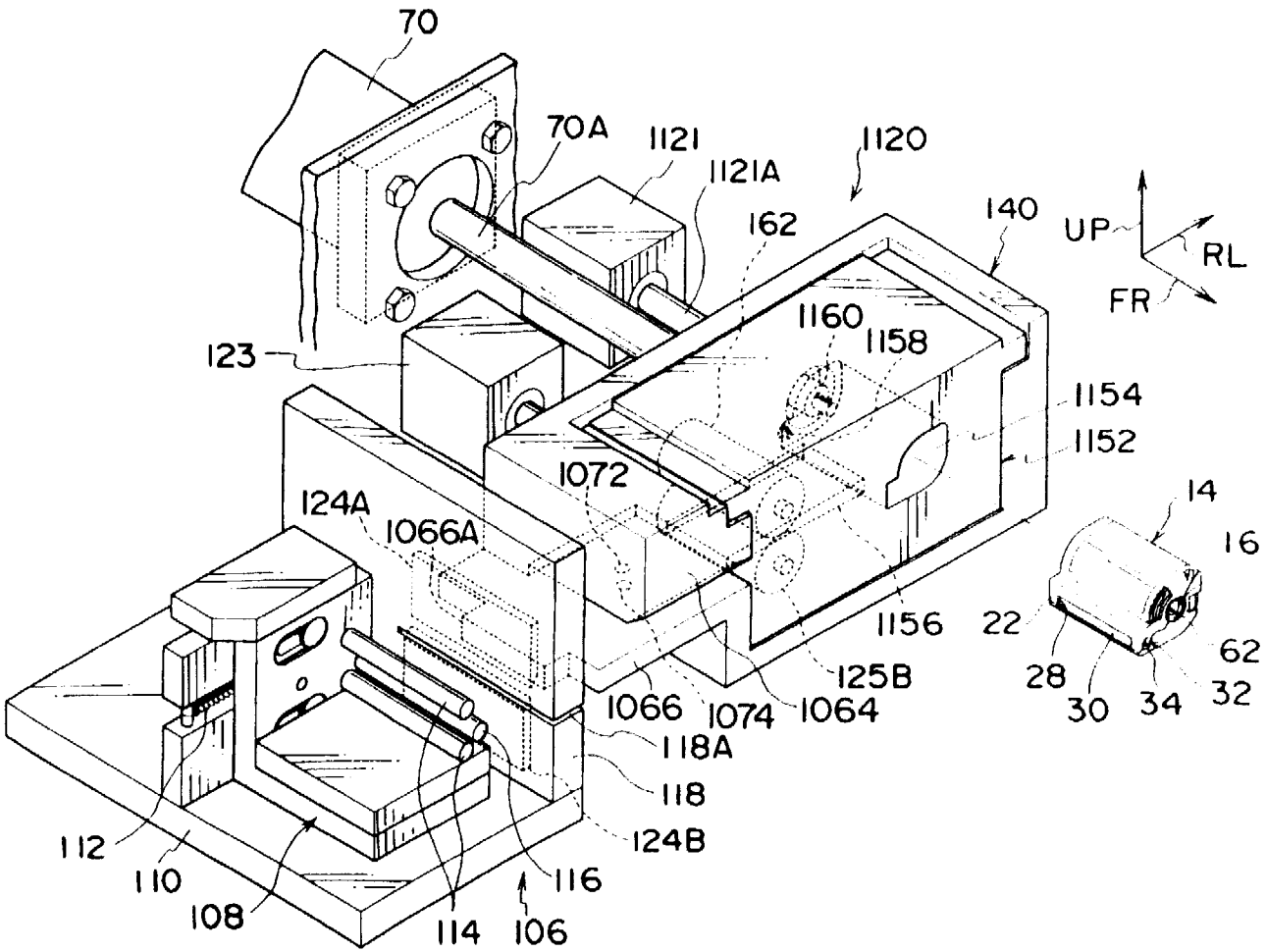
FIG. 34 is a perspective view showing the state where the second loading member has been mounted on the mounting tool shown in FIG. 3.

The processor 100 according to Embodiment 4 of the present invention shown in FIG. 20 to FIG. 36 develops the first film 96 having the 135-size as well as the second film FI accommodated in the cartridge 14 for the PAS film shown in FIG. 34 and locked on the second spool shaft 16. It should be noted that the same reference numerals are assigned to components corresponding to those in Embodiment 1, and description thereof is omitted herein.

Figure 22:
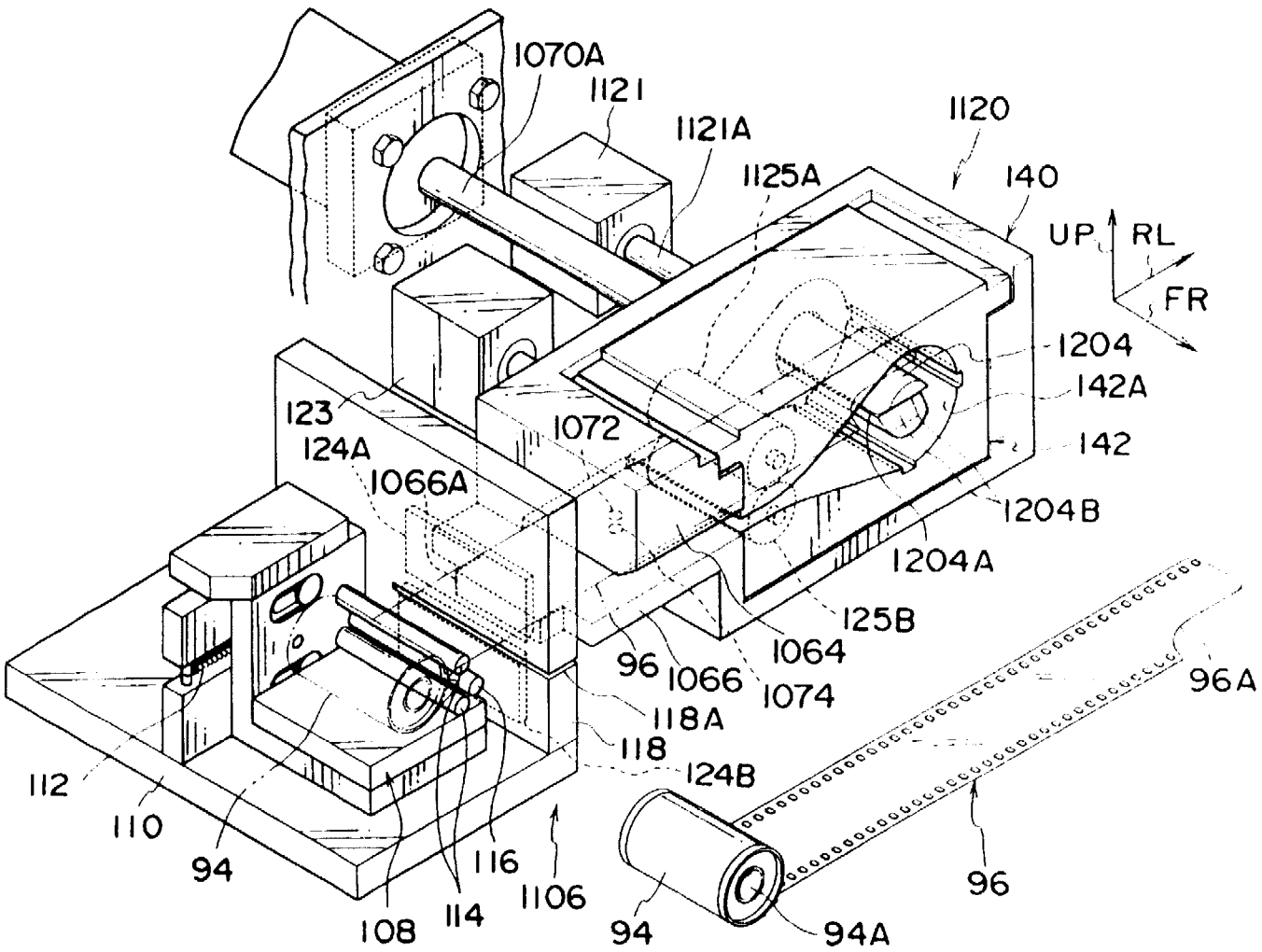
FIG. 22 is a perspective view showing a key section of the first loading member shown in FIG. 20.
Figure 35:
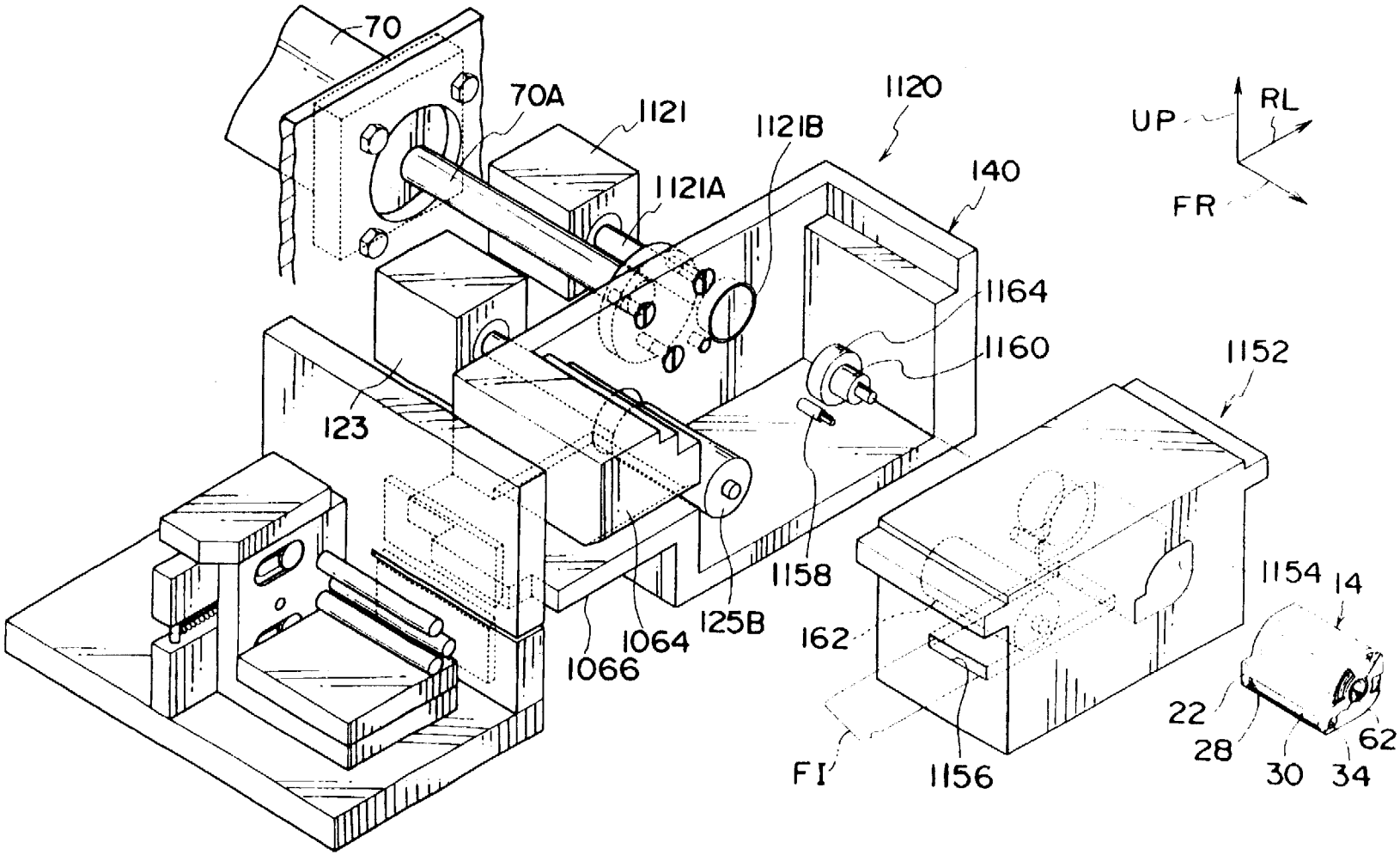
FIG. 35 is a perspective view showing the state where the loading member shown in FIG. 34 has been removed from the mounting base.
Figure 36:
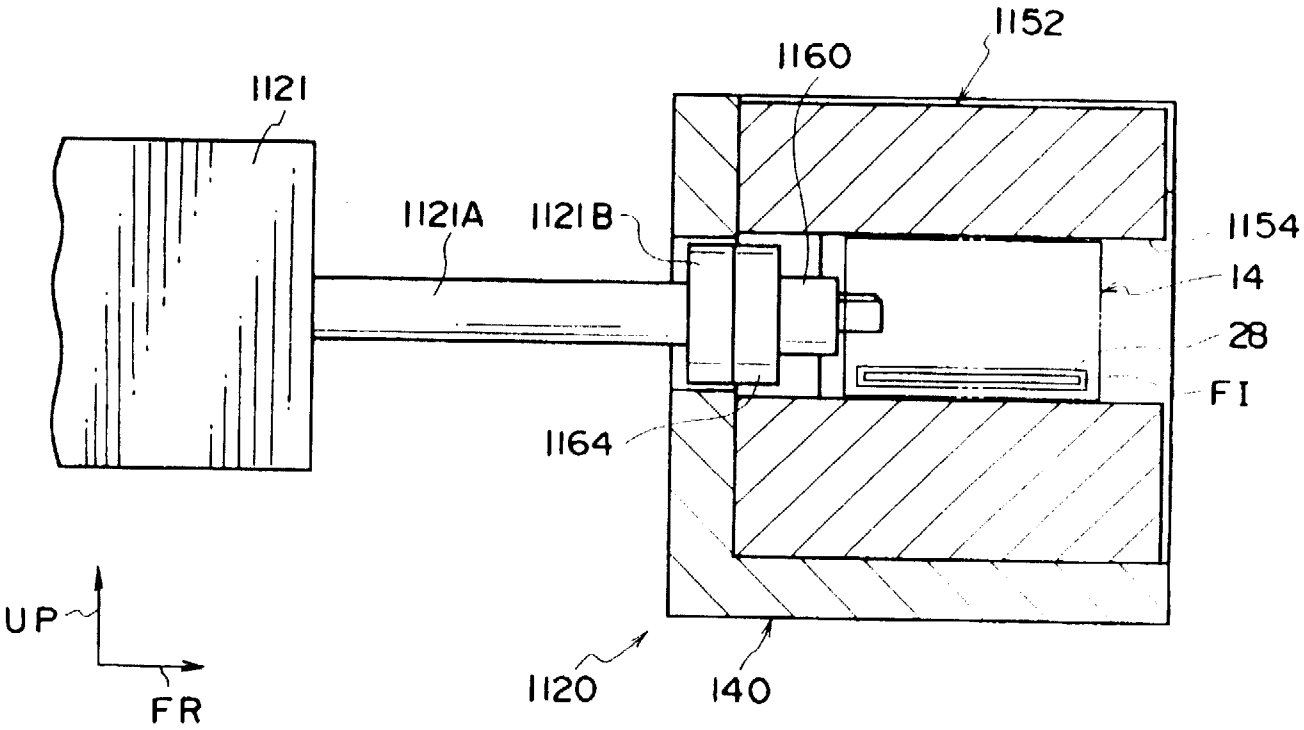
FIG. 36 is a cross-sectional view showing the state where a cartridge has been loaded on the loading member shown in FIG. 35.

As shown in FIG. 22, an intermediate cartridge 1120 according to this embodiment comprised a mounting base 140, and a first loading member detachably loaded on this mounting base 140 or a second loading member 1152 shown in FIG. 35. As a locking unit for locking the loading member 1142 or 1152 to the mounting base 140, for instance, a tightening unit such as a bolt not shown herein or a fixing unit such as a lock or a magnet may be used.

Figure 26:
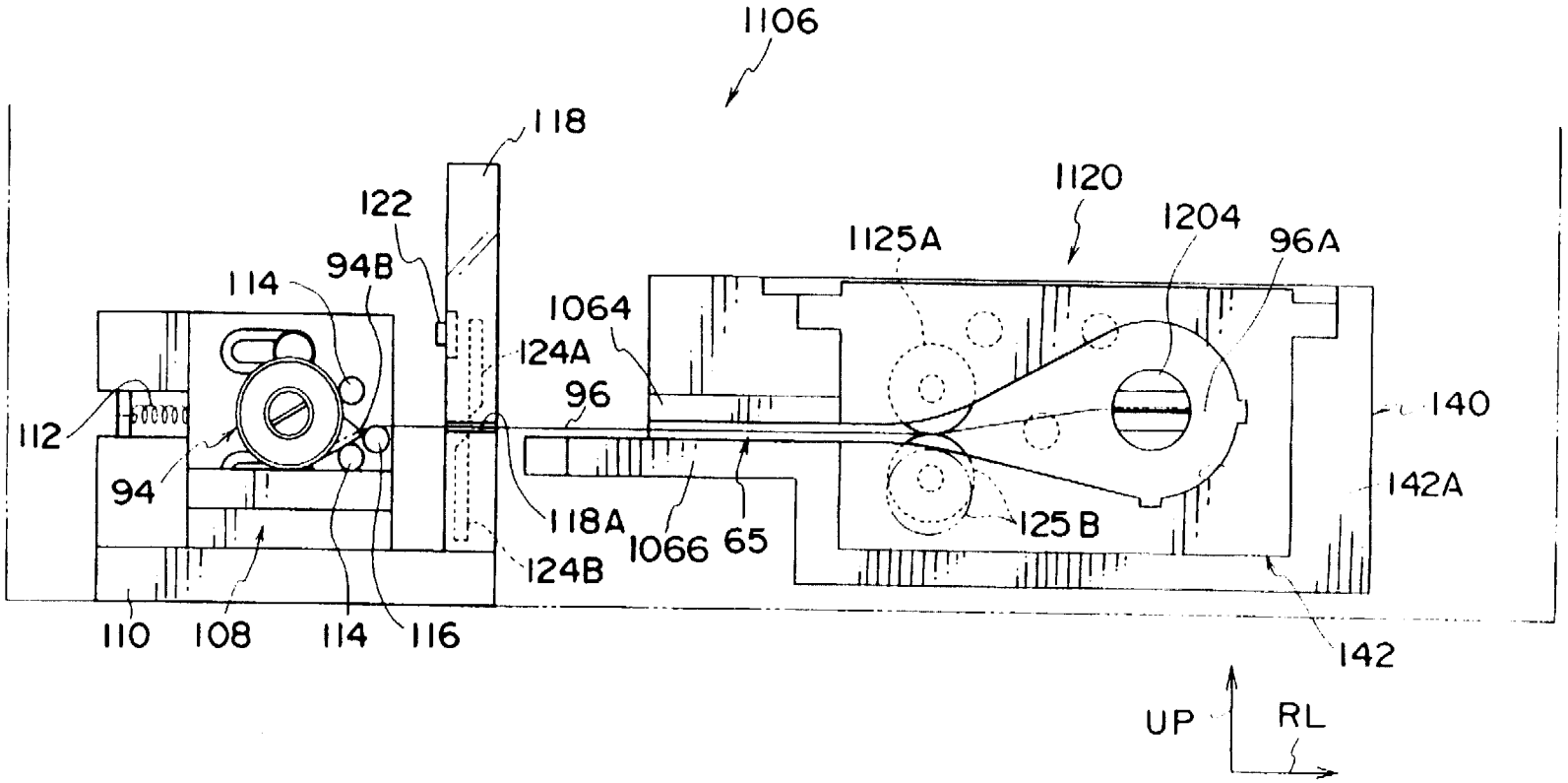
FIG. 26 is a front view showing a key section of the loading member shown in FIG. 22.

As shown in FIG. 26, a pair of guide plates 1064, 1066 facing to each other are provided on the mounting base 140 at positions opposite to a lacked section 118A of the partitioning plate 118 with a specified space 65 therebetween.

Figure 23:
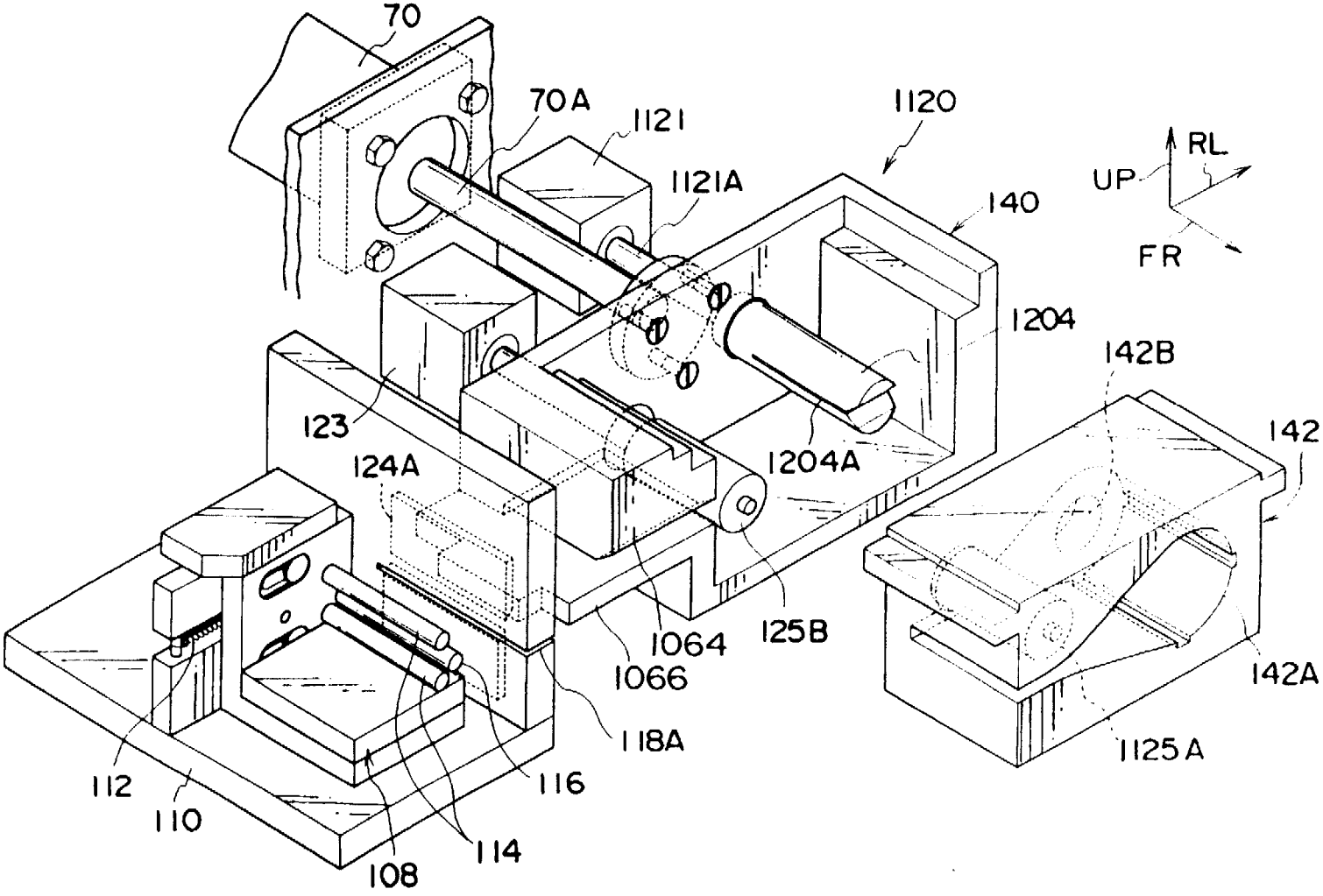
FIG. 23 is a perspective view showing the state where the loading member shown in FIG. 22 has been removed from a mounting base.

As shown in FIG. 22, the rollers feeding out the film 96 to the left side from an intermediate spool shaft 1202 and to the contrary side from the intermediate spool shaft 1204 are provided on the mounting base 140 and loading member 42 respectively. Namely, as shown in FIG. 23, a roller 1125A is rotatably supported by the loading member 142, while the roller 125B is provided in the mounting base 140. Further, as shown in FIG. 24, the roller 125 is inserted into a hole 140A formed on the mounting base 140 and is jointed to a motor 123 which rotates in the regular and reverse directions.

The motor goes up and down according to movement of a lifting member (not shown herein) such as a rack-and-pinion and a motor connected to this pinion. Namely the motor goes up when a switch 76 or switch 77 described later is pressed, and goes down when a switch 122 is turned ON.

Figure 24:
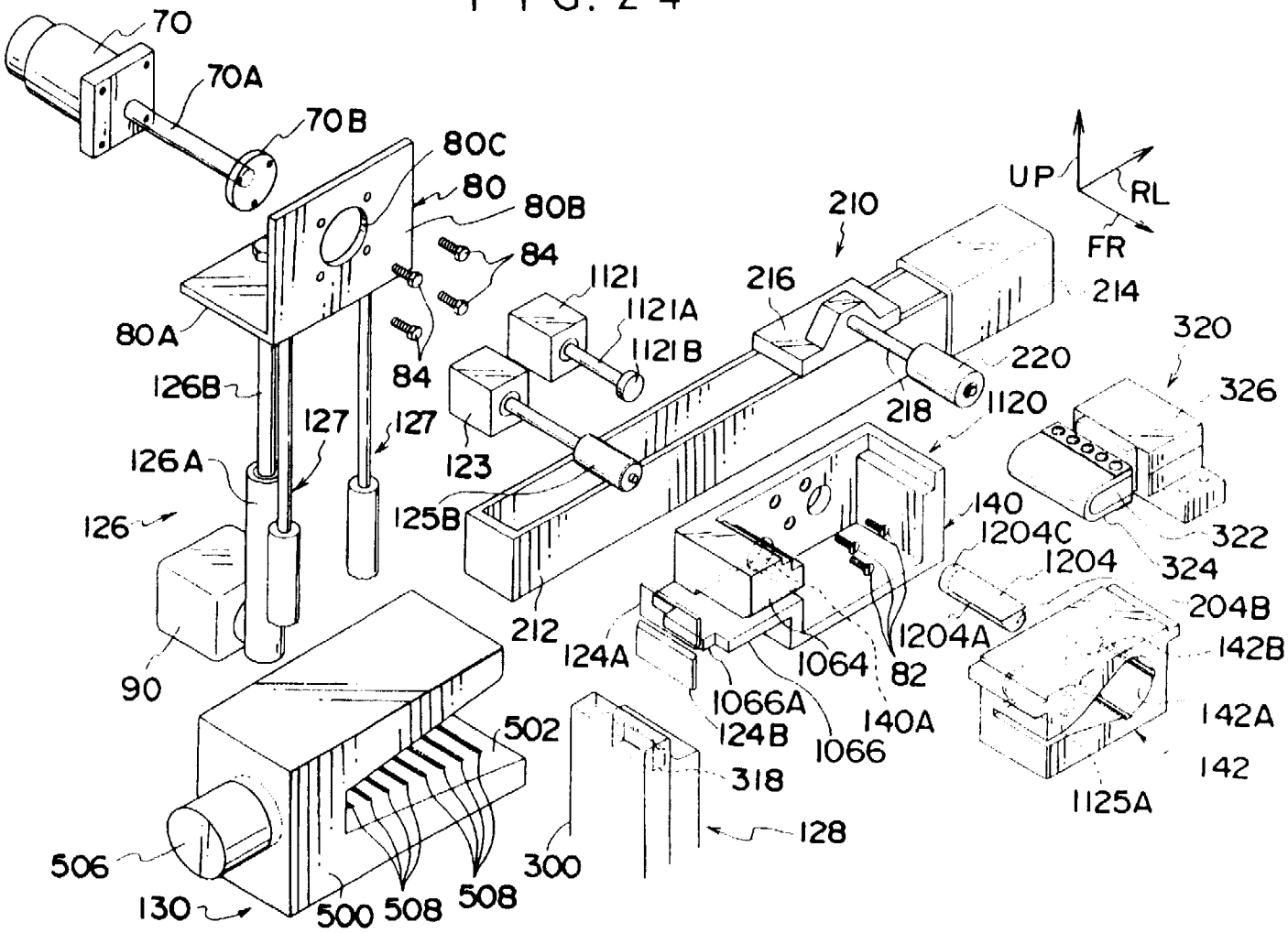
FIG. 24 is a dissolved perspective view showing a key section of the processor.

As shown in FIG. 23 and FIG. 24, the intermediate spool shaft 1204 is inserted into a hole 142B formed on the first loading member 142 and also removably jointed to a motor shaft 1121A of a motor 1121. Namely a magnet 1204C having the same diameter as that of the intermediate spool shaft 1204 is provided as a jointing unit at a rear side from the intermediate spool shaft 1204.

Provided at a tip of the motor shaft 1121A is a magnet 1121B as a linking unit corresponding to the magnet 1204C for the intermediate spool shaft 1204. In the magnets 1204 and 1121B, N pole and S pole are magnetized respectively so that zones adjoining each other in the peripheral direction have a different polarity respectively. And, the N pole of the magnet 1204 and pole S of the magnet 1121B are faced to each other to magnetically position and fix the magnets 1204 and 1121B on the same axial line.

Figure 25:
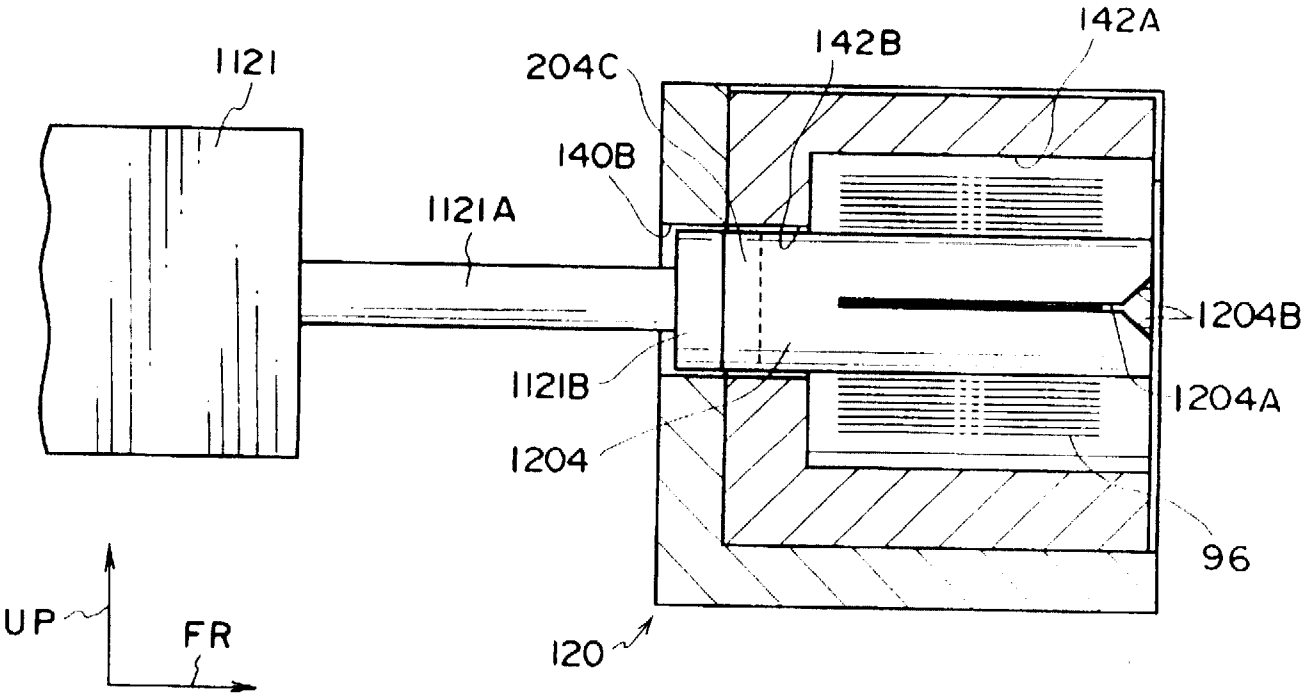
FIG. 25 is a cross-sectional view showing the state where a film has been wound around the intermediate spool shown in FIG. 21.

Namely, the magnet 1121B is, as shown in FIG. 25, is inserted into a hole 140B formed on the mounting base 140, and magnetically position and fix the intermediate spool shaft 1204 on the same axial line. The motor 1121 rotates in the regular and reverse directions, and also rotates in synchronism to the motor 123 for the roller 125B.

It should be noted that, in this invention, such a tool as, for instance, a bolt or a pin for linkage may be used in place of a magnetic unit, as the linking unit for linking the intermediate spool shaft 1204 to the motor 1121A.

Also as shown in FIG. 23, formed on the intermediate spool shaft 1204 is a slit 1204A slightly longer than thickness of the film 96 and the slit 1204A linearly extends on the center line of the intermediate spool shaft 1204. The film 96 is inserted through this slit 1204A, and a locking unit is provided in the slit 1204A for positioning and locking the film 96 inserted therethrough.

Figure 27:
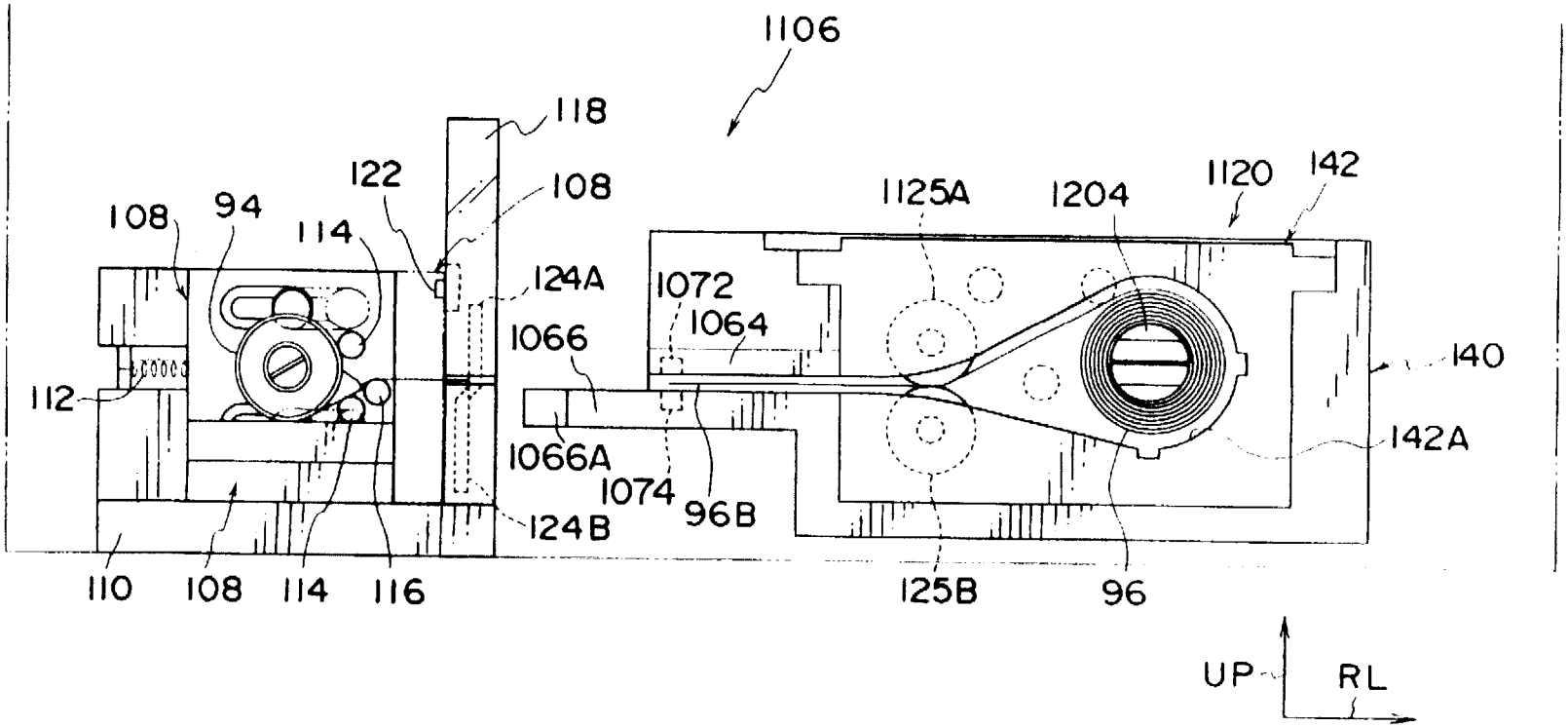
FIG. 27 is a front view showing the state where a rear edge section of the film wound around the intermediate spool shaft shown in FIG. 26 has been cut off.
Figure 28:
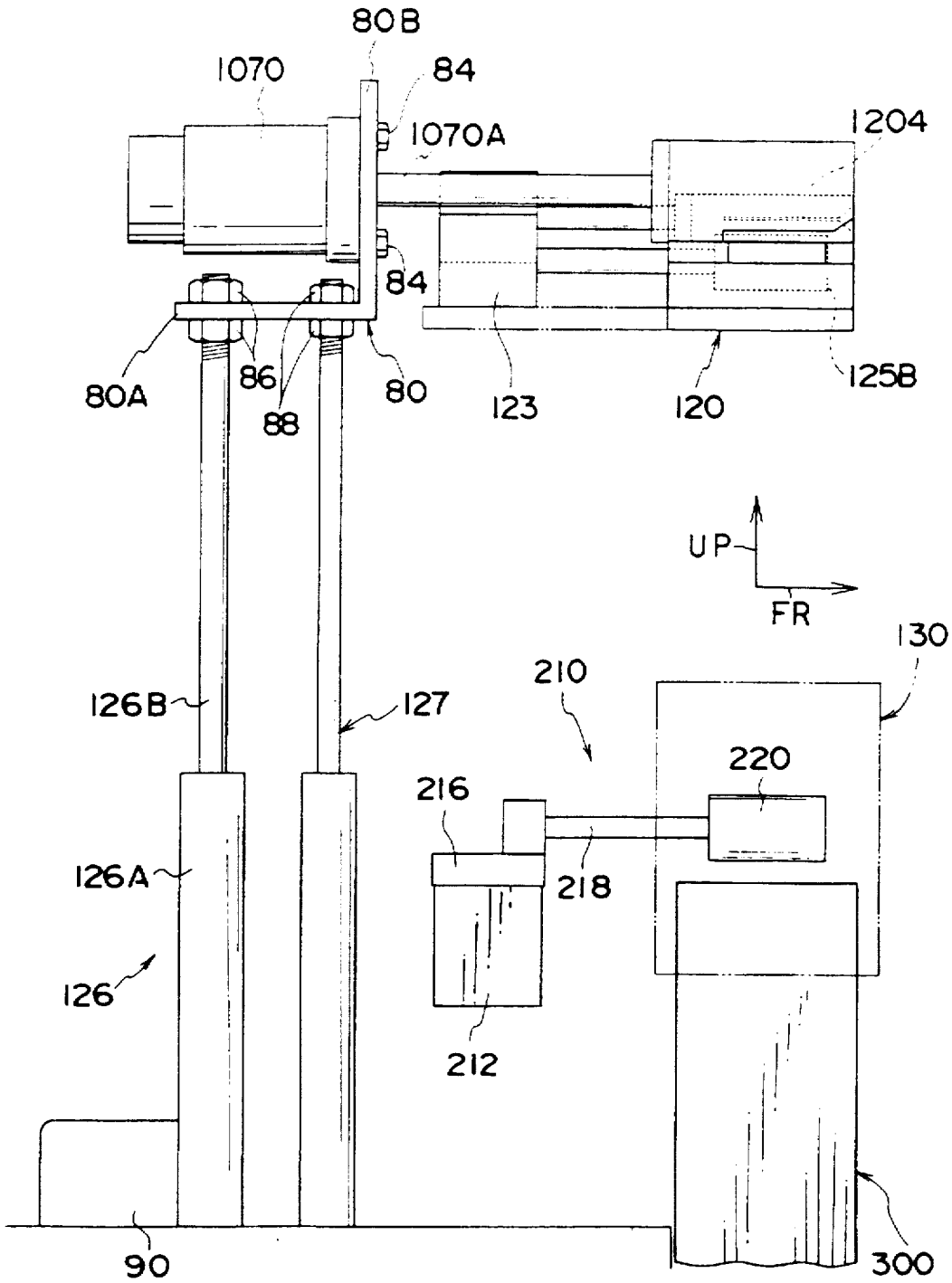
FIG. 28 is a left side view shown a key section of the processor shown in FIG. 28.

As shown in FIG. 26, a tip of the film 96 is positioned on the intermediate spool shaft 1204 by the locking unit not shown herein, and when the intermediate spool shaft 1204 rotates in this state, as shown in FIG. 27, the film 96 is wound around the intermediate spool shaft 1204.

As shown in FIG. 26, a substantially round hole 142A is formed around the intermediate spool shaft 1204, and a left side of this hole 142A is diagonally formed in succession to the clearance 65. As shown in FIG. 27, the hole 142A is an escape for winding and retaining the film 96. As shown in FIG. 22, a tapered guide face 1204B is formed in a front edge section (tip) of the intermediate spool shaft 104 at a position opposite to the slit 1204A. This guide face 1204B facilitates insertion of the film 96 into the slit 1204B.

Figure 20:
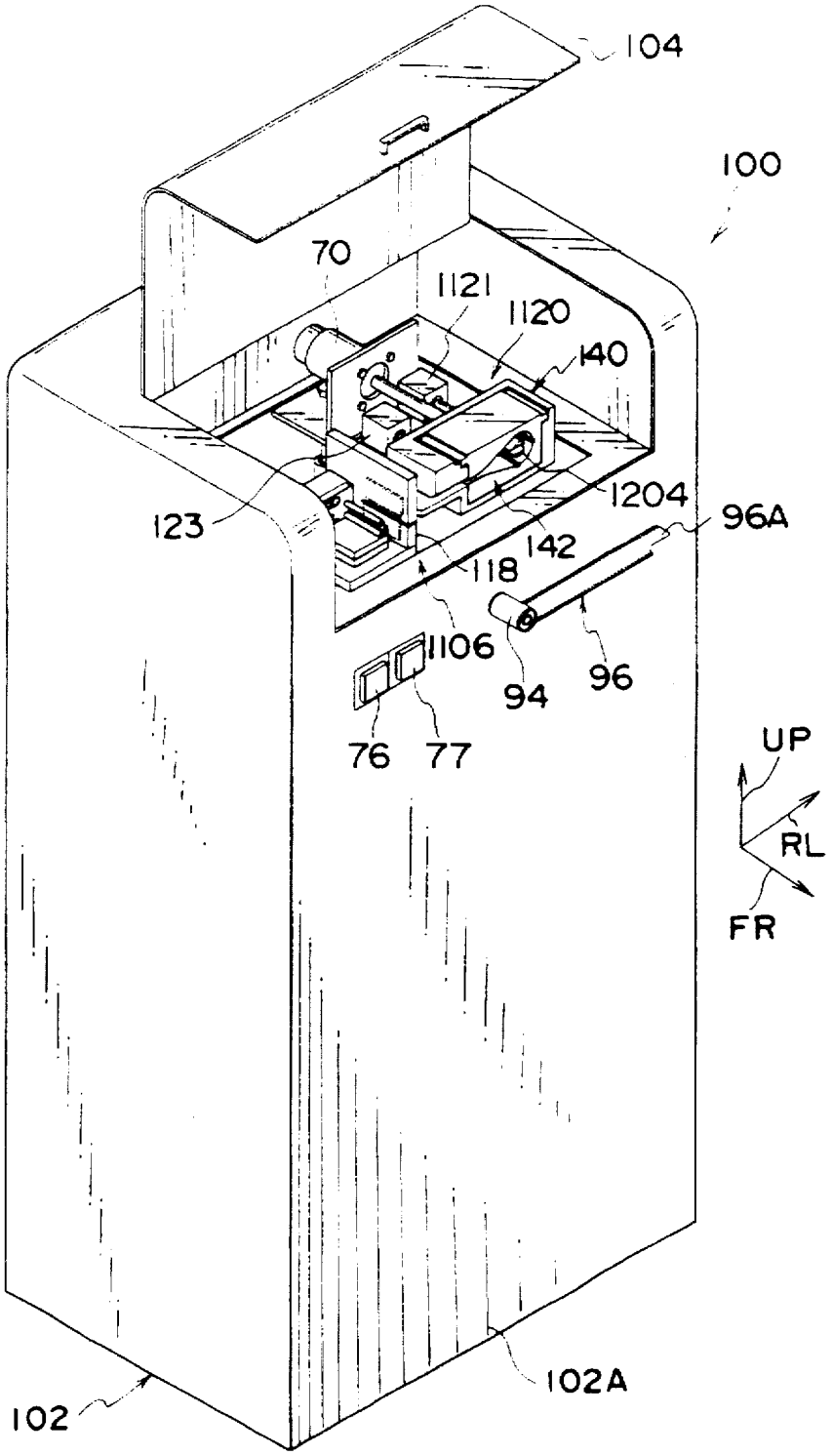
FIG. 20 is a general perspective view showing the processor according to Embodiment 4 of the present invention.
Figure 21:
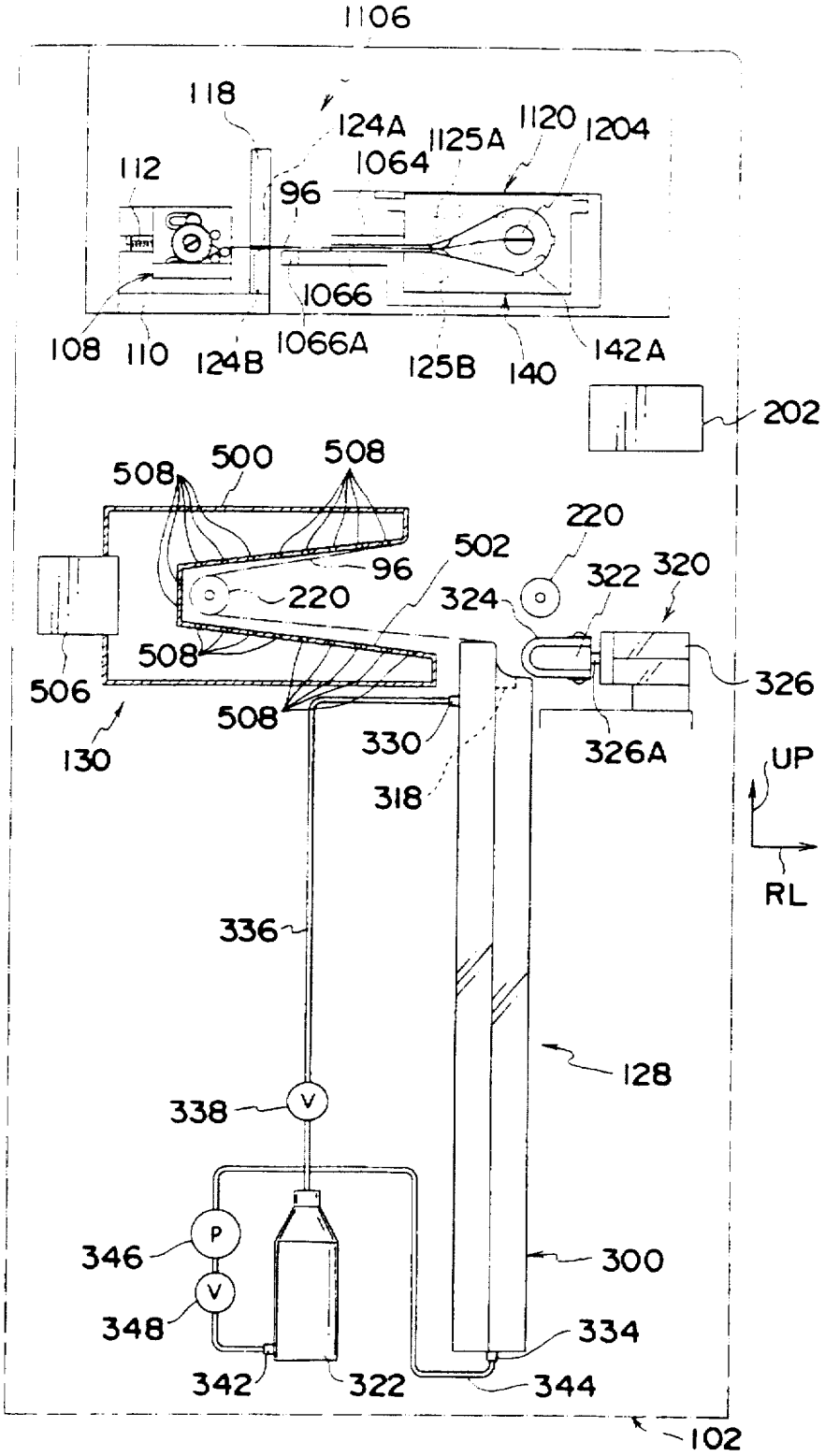
FIG. 21 is a cross-sectional view showing a key section of the processor shown in FIG. 20.
Figure 29:
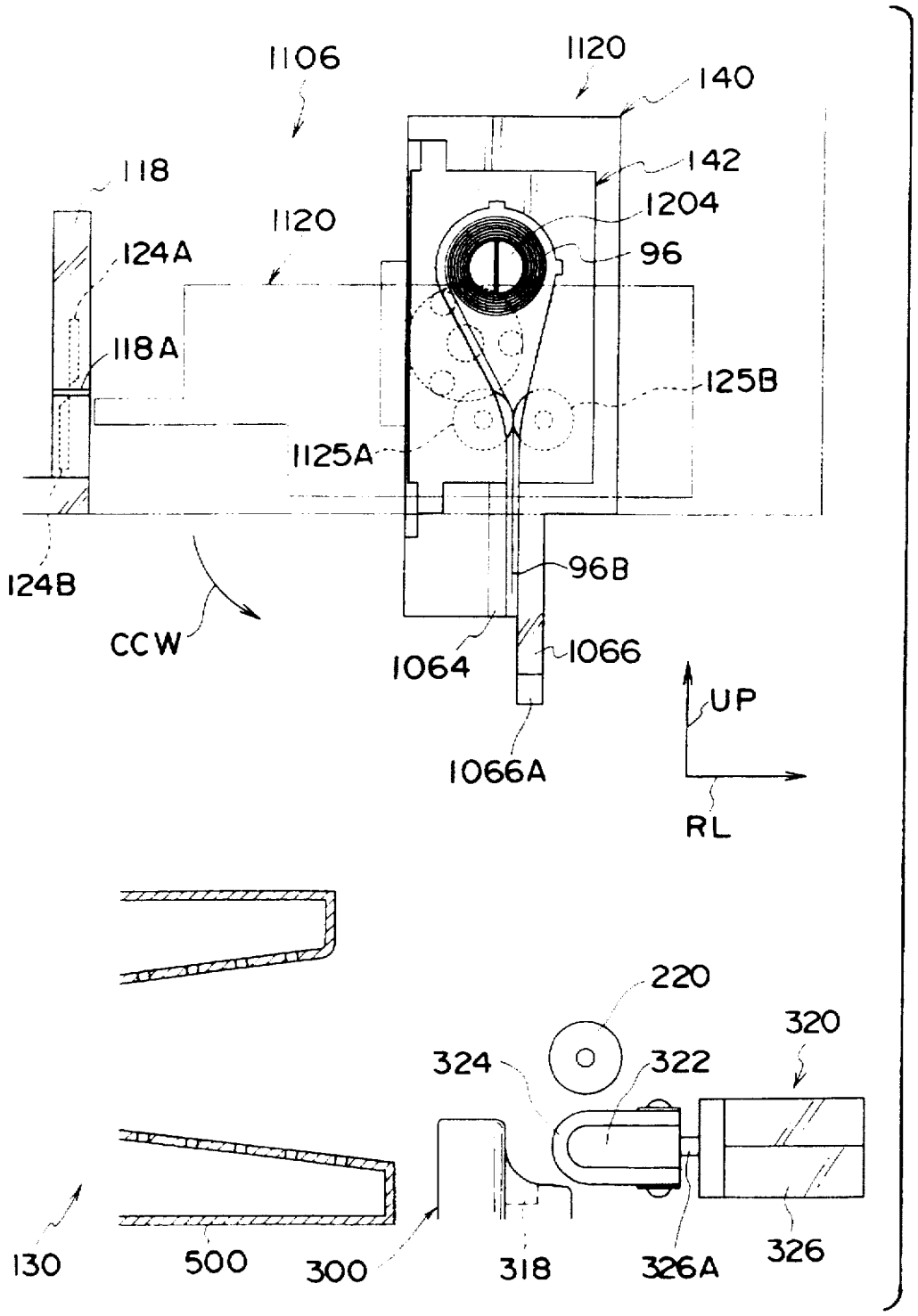
FIG. 29 is a view showing the state where the intermediate cartridge shown in FIG. 2 has been rotated.
Figure 30:
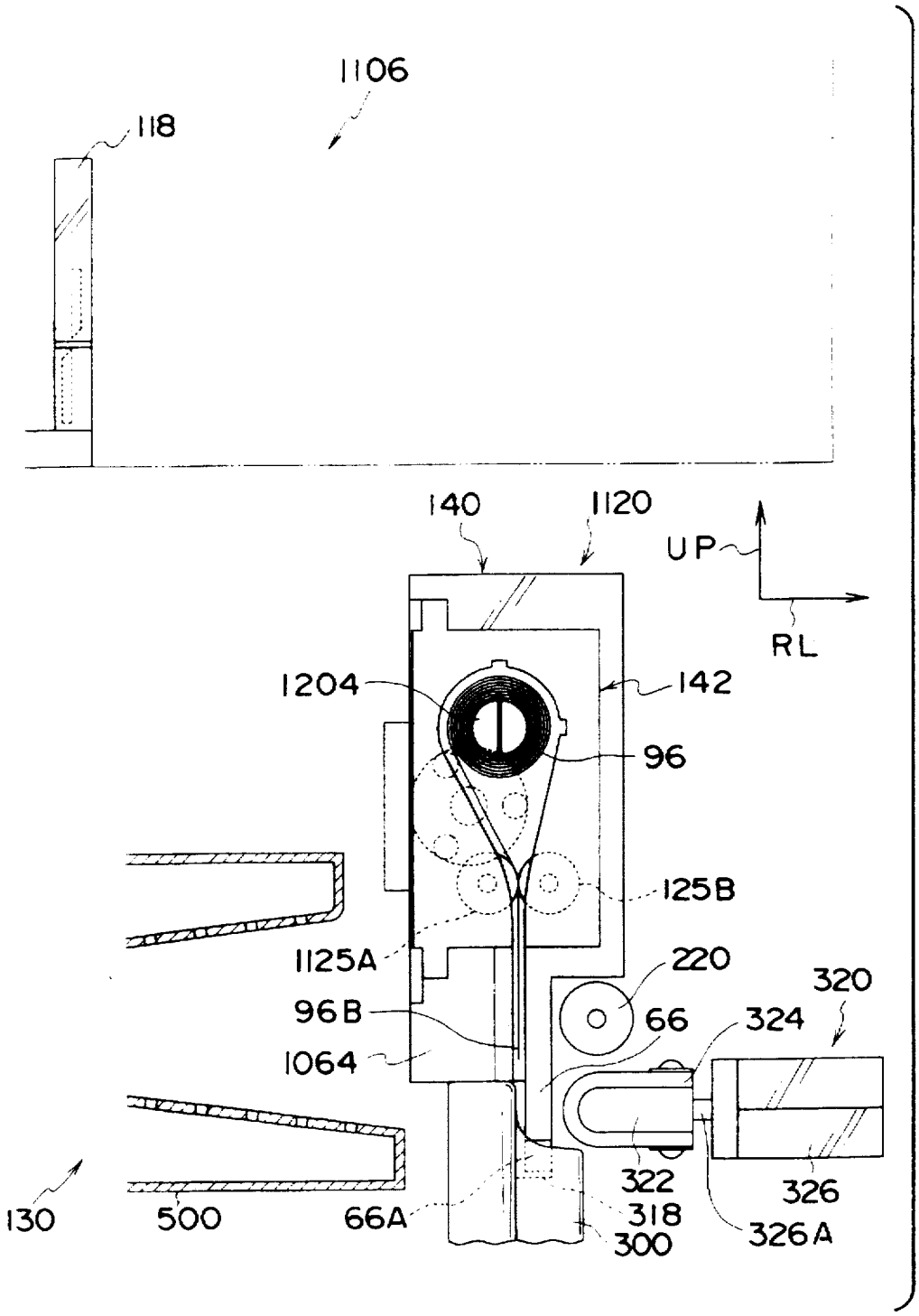
FIG. 30 is a view showing the state where the intermediate cartridge shown in FIG. 29 went down.
Figure 31:
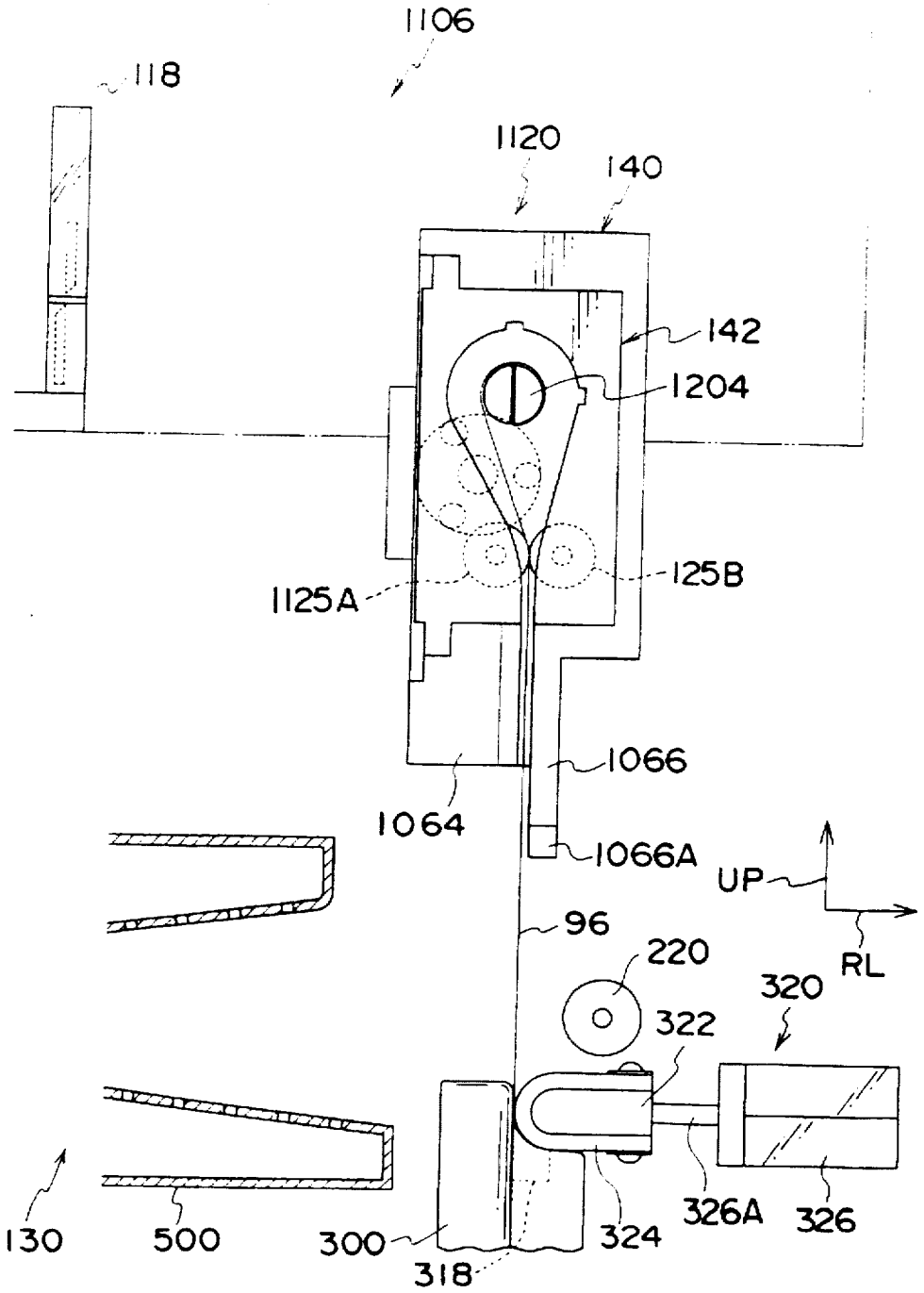
FIG. 31 is a view showing the state where the intermediate cartridge shown in FIG. 30 went up slightly and the processing tank has been closed.
Figure 32:
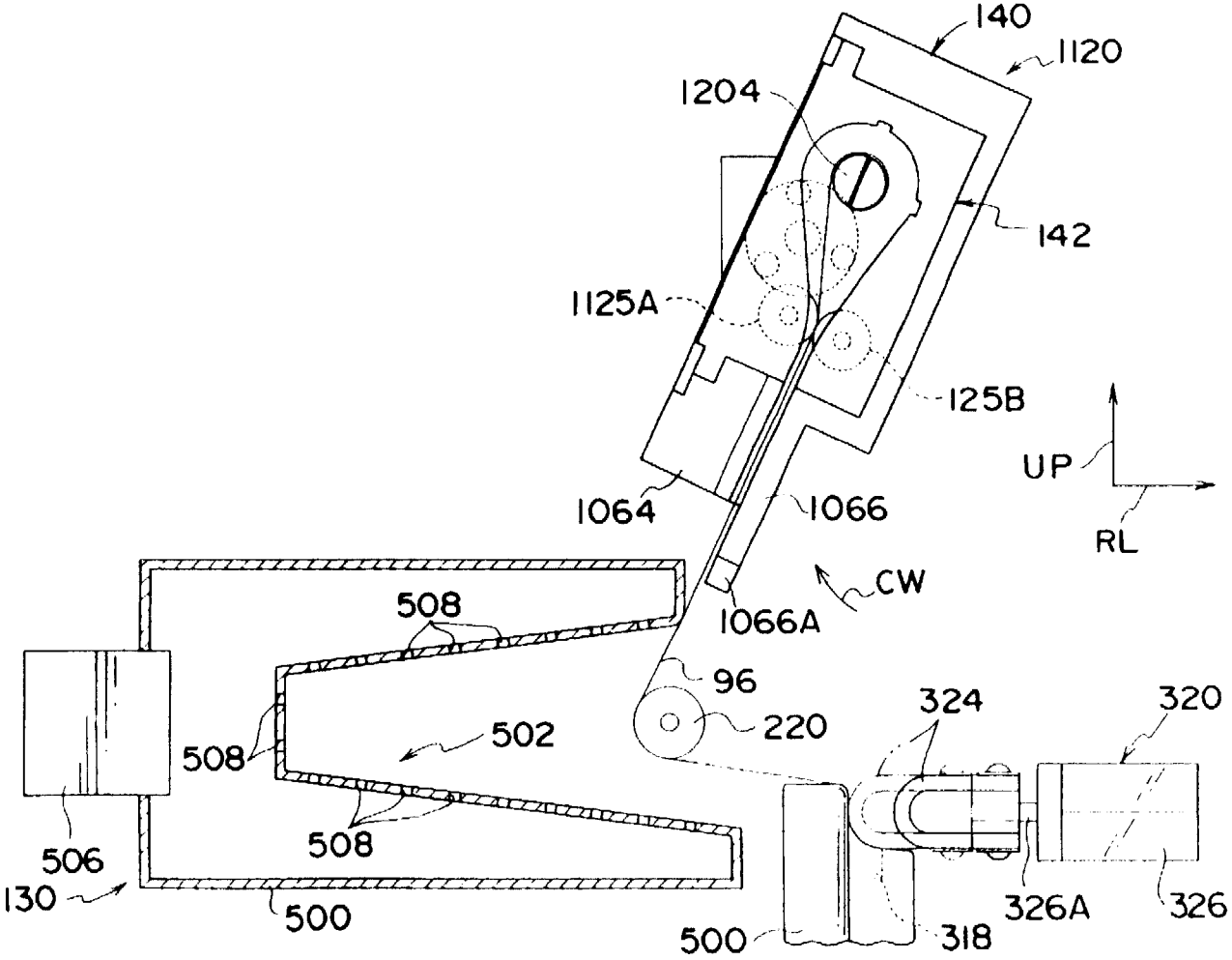
FIG. 32 is a view showing the state where the intermediate cartridge shown in FIG. 31 has been rotated slightly and the film has been slightly withdrawn by a roller from the processing tank.
Figure 33:
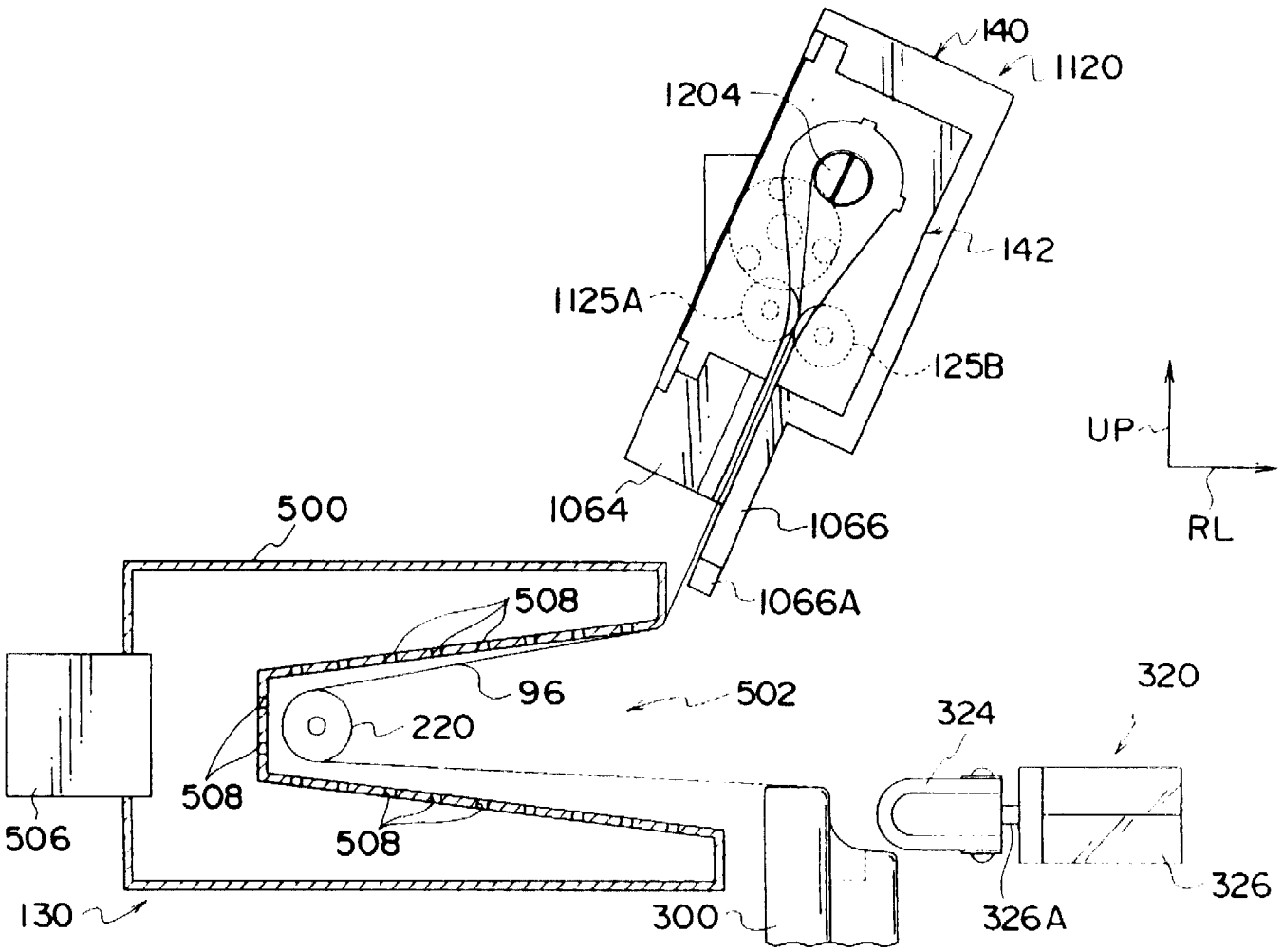
FIG. 33 is a view showing the state where the film shown in FIG. 32 is withdrawn by the roller from the processing tank and is dried.

As shown in FIG. 20 and FIG. 21, the intermediate cartridge 1120 is connected to a motor shaft 1070A of a motor 70, and when this motor 70 rotates, the intermediate cartridge 1120 rotates counterclockwise (in the direction indicated by arrow mark CC) by 90 degrees as shown in FIG. 29.

As shown in FIG. 34 and FIG. 35, a second loading member 1152 for loading thereon the cartridge 14 for APS as a second film container is removably is mounted on the mounting base 140. A recessed section 1154 for inserting the cartridge 14 for ASP is provided in this loading member 1152, and this recessed section has the same external form as that of the cartridge 14.

As shown in FIG. 34, the recesses section 1154 of the loading member 1152 is formed so that a thrusting section 22 (insertion/passage port 28) oppose to a tip 1066A of the loading member 1152. Also a slit 1156, through which the film 96 inside the cartridge 14 is inserted or taken out is provided at a position opposite to the insertion/passage port 28 of the cartridge 14. In the side of this slit 1156 close to the loading member 1152, a roller 162 for feeding out the film FI to the tip 1066A side of the loading member 1152 or to the contrary side is provided so that it can rotate against the roller 125B.

As shown in FIG. 35, the loading member 1152 has a door driver 1158 for opening and closing a door 30 of the cartridge 14 provided at a position opposite to a key hole 34 of the door shaft 32 and a spool driver 1160 as a linking unit for rotating the spool shaft 16. This spool driver 1160 has a magnet 1164 corresponding to the magnet 1121B, and this magnet 1164 and the magnet 1121B in the side of motor 1121 are magnetically positioned and fixed on the same axial line (Refer to FIG. 6).

The driver 1158 is provided in the rear side in FIG. 34 and FIG. 35, but originally it should be provided only in the rear side. Further the driver 1158 is connected to a motor not shown herein.

It should be noted that, in this embodiment, the intermediate spool shaft 1204 is not always required to be provided in the intermediate cartridge 1120, and for instant the film 96 may be wound into the hole 142A in the state where the intermediate spool shaft 1204 has been removed from the magnet 1121B.

Provided on the guide plates 1064 and 1066 for the intermediate cartridge 1120 are a light-emitting element 1072 and a light-receiving element 1074 in the side of the partition plate 118 (in the left edge side) opposite to the film 96. When light beam from this light-emitting element 1072 is supplied to the light-receiving element 1074, the control unit 202 determines a position of a rear edge 96B of the film 96 (Refer to FIG. 27).

As shown in FIG. 20, a switch 77 is provided in the right side from the switch 76 on the front panel 102A, and this switch 77 is used for a series of processing including the operations for developing and drying the second film FI for APS.

When the switch 77 is pressed down, the motor 70 rotates, and then the motors, 1121, 123 rotate with the film FI withdrawn from the cartridge 14 and subjected to the processings for development and drying as described later.

Inside the section indicated by an imaginary line in FIG. 21, an intermediate cartridge carrier 126 (Refer to FIG. 28), development processing section 128, and drying section 130 corresponding to those in Embodiment 1 are provided. Detailed description thereof is omitted herein.

(Operation)

Next description is made for operation in this embodiment.

The following description of this embodiment assumes a case a case where the 135-size film 96 is developed. A user opens the cover 104 as shown in FIG. 20, connects the magnet 1204C of the intermediate spool shaft 1204 shown in FIG. 24 to the magnet 1121B of the motor 1121 by means of magnetism, and also inserts the loading member 142 shown in FIG. 23 into the mounting base 140 for setting therein. It should be noted that the subsequent operations are the same as those in Embodiment 1 as shown in FIG. 26 to FIG. 33, so that description thereof is omitted herein.

Next description is made for a case where the APS film FI is developed. As shown in FIG. 35, the user connects the door driver 1158 to a motor not shown herein, and also connects the magnet 1164 of the spool driver 1160 to the magnet 1121B of the motor 1121 by means of magnetism. Further, as shown in FIG. 23, the loading member 1152 is inserted into the mounting base 140 for setting therein, and the cartridge 14 for APS films is inserted into the recessed section 1154 of the loading member 1152 (Refer to FIG. 36).

Then the user closes the cover 104 shown in FIG. 20, and operates the switch 77, when the motor 70 starts rotating. The subsequent operations are the same as shown required when the 135-size film 96 is developed, so that description thereof is omitted herein.

In this embodiment, the 135-size film 96 is wound from the cartridge 94 around the intermediate spool shaft 1204 of the loading member 142 and is retained in the loading member 142, and the film 96 is inserted in this state from the loading member 142 into the processing tank 300 for development, and further the cartridge for ASP films can be loaded in the loading member 1152 for development of the film FI.

In other words, in this embodiment, either one of the loading member for loading the 135-film 96 and the loading member 1152 for loading the cartridge 14 (film FI) for APS can be loaded in the mounting base, so that the roller 125, motor 1121, and other components can be shared for both types of film, which enables size reduction of a photosensitive material processing apparatus.

Embodiment 5

Figure 37:
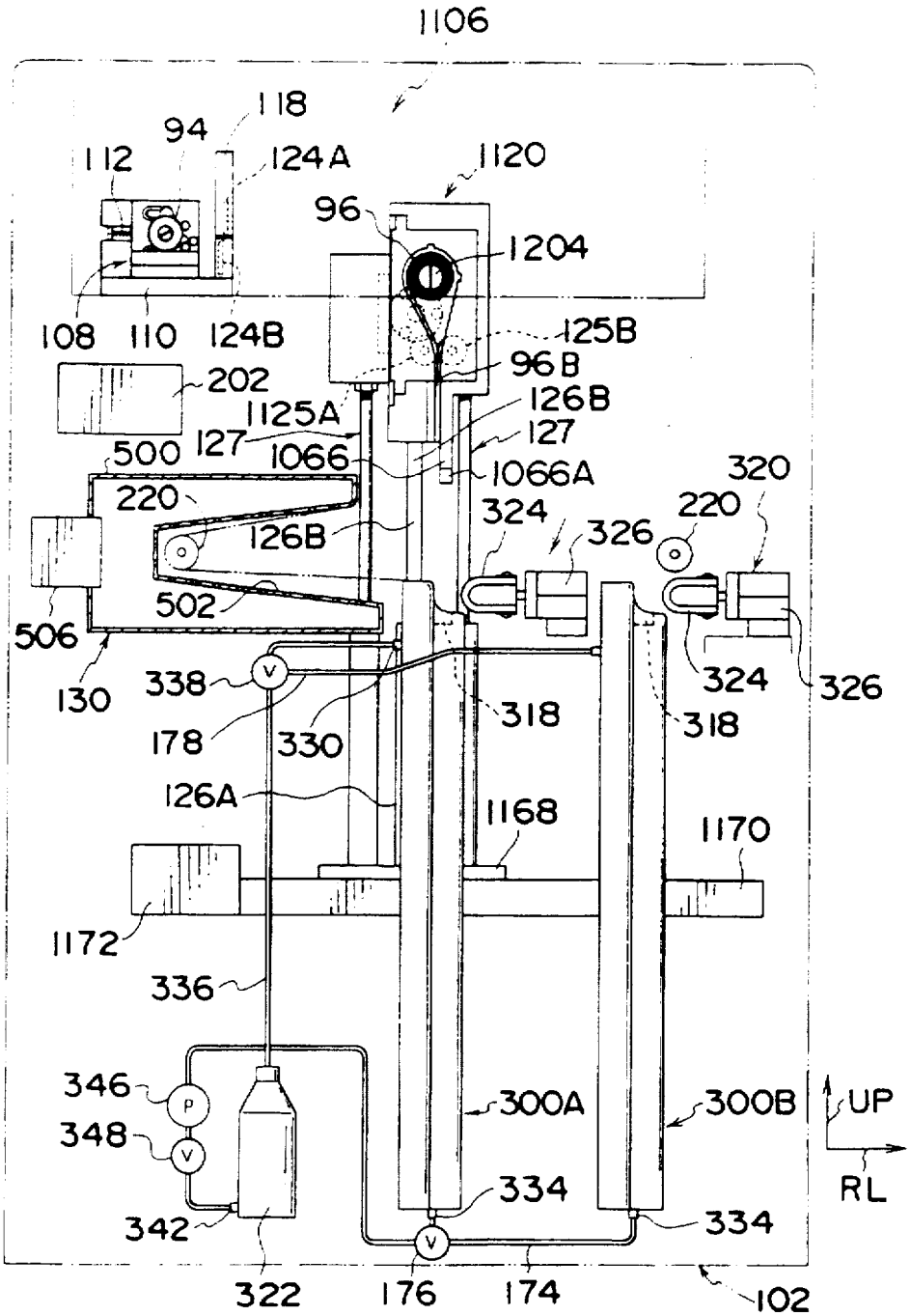
FIG. 37 is a view showing a key section of a processor according to Embodiment 5 of the present invention.
Figure 38:
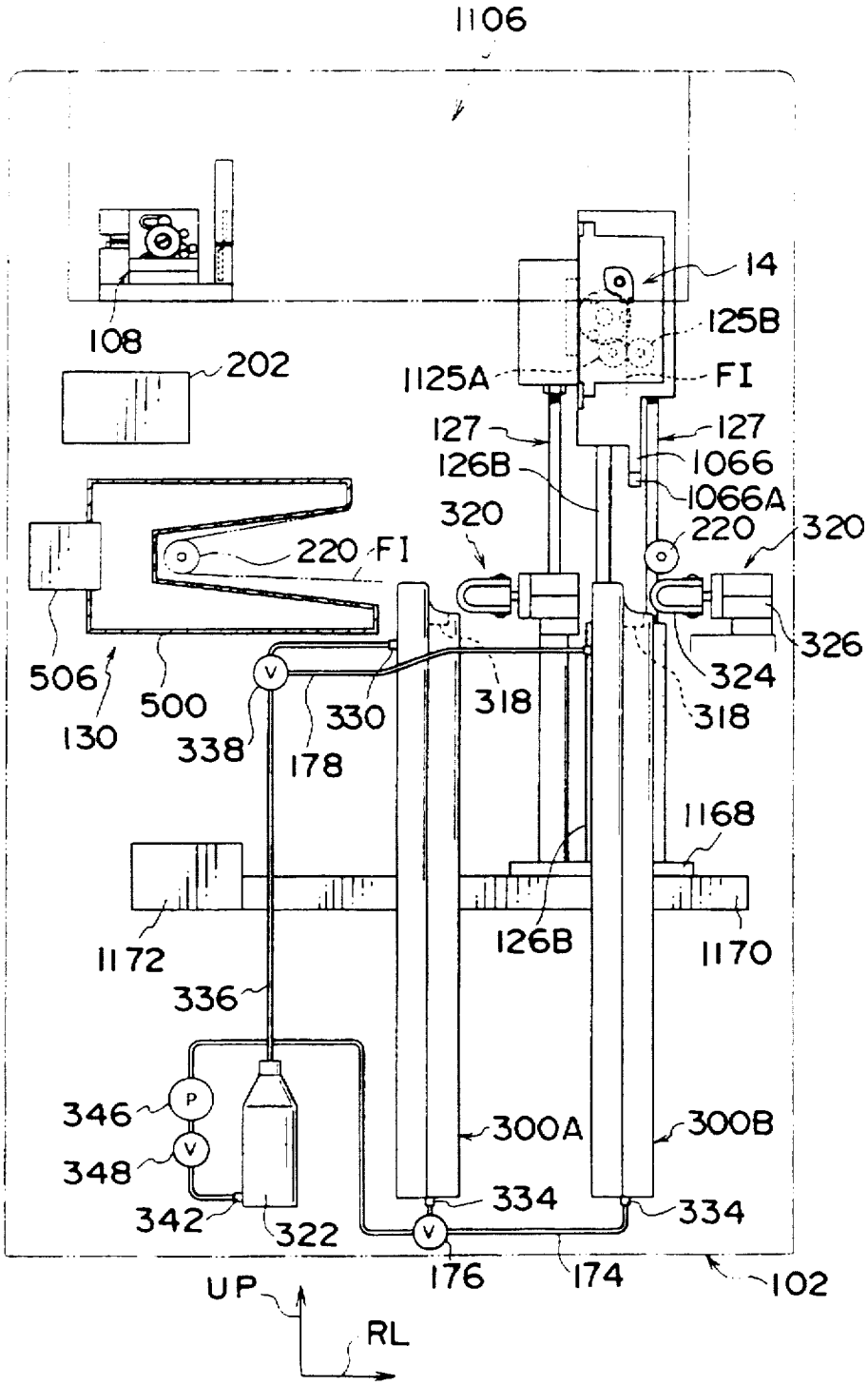
FIG. 38 is a view showing the state where the intermediate cartridge shown in FIG. 37 has been moved by a moving unit.

A shown in FIG. 37 and FIG. 38, in Embodiment 5 of the present invention, width of the 135-size film 96 is different from that of the APS film FI as described above, so that a pair of processing tanks 300A, 300B corresponding the film widths of the 135-size film 96 and FI film respectively are provided. It should be noted that the same reference numerals are assigned to those in Embodiment 3 and description thereof is omitted herein.

In this embodiment, there is only one mounting base 140, and for this reason a moving unit as described below is provided to position the mounting base 140 at a position opposite to an film insertion port 318 of the processing tank 300A or 300B.

As shown in FIG. 37 and FIG. 38, the loading members 142 and 1152 are fixed via the intermediate cartridge carrier 126 shown in FIG. 24 to the slider 1168. This slider 1168 is linked to a gear not shown herein and constituting a portion of the moving unit. This gear is linked to the motor 1172, and when the motor 1172 rotates, the gear rotates and the slider 1168 moves right and left.

In this embodiment, the film 96 loaded in the first loading member 1142 and the film FI loaded in the second loading member 1152 are positioned at positions opposite to film insertion ports 318 of the processing tanks 300A and 300B for developing the films therein. Other operations and effects are the same as those in Embodiment 4, so that description thereof is omitted herein.

In this embodiment, the 135-size film 96 and film FI are inserted to the processing tanks 300A, 300B each with width corresponding to the two types of film respectively, so that two edge sections of each of the film 96 and film FI in the lateral direction thereof are guided by the two side portions of the internal wall surfaces 302 of the processing tanks 300A, 300B more accurately.

It should be noted that, although the above description of Embodiment 5 assumed a case where the intermediate cartridge 1120 is moved by a moving unit, the processing tanks 300A, 300B maybe moved to positions each opposite to the intermediate cartridge 1120.

Embodiment 6

Figure 39:
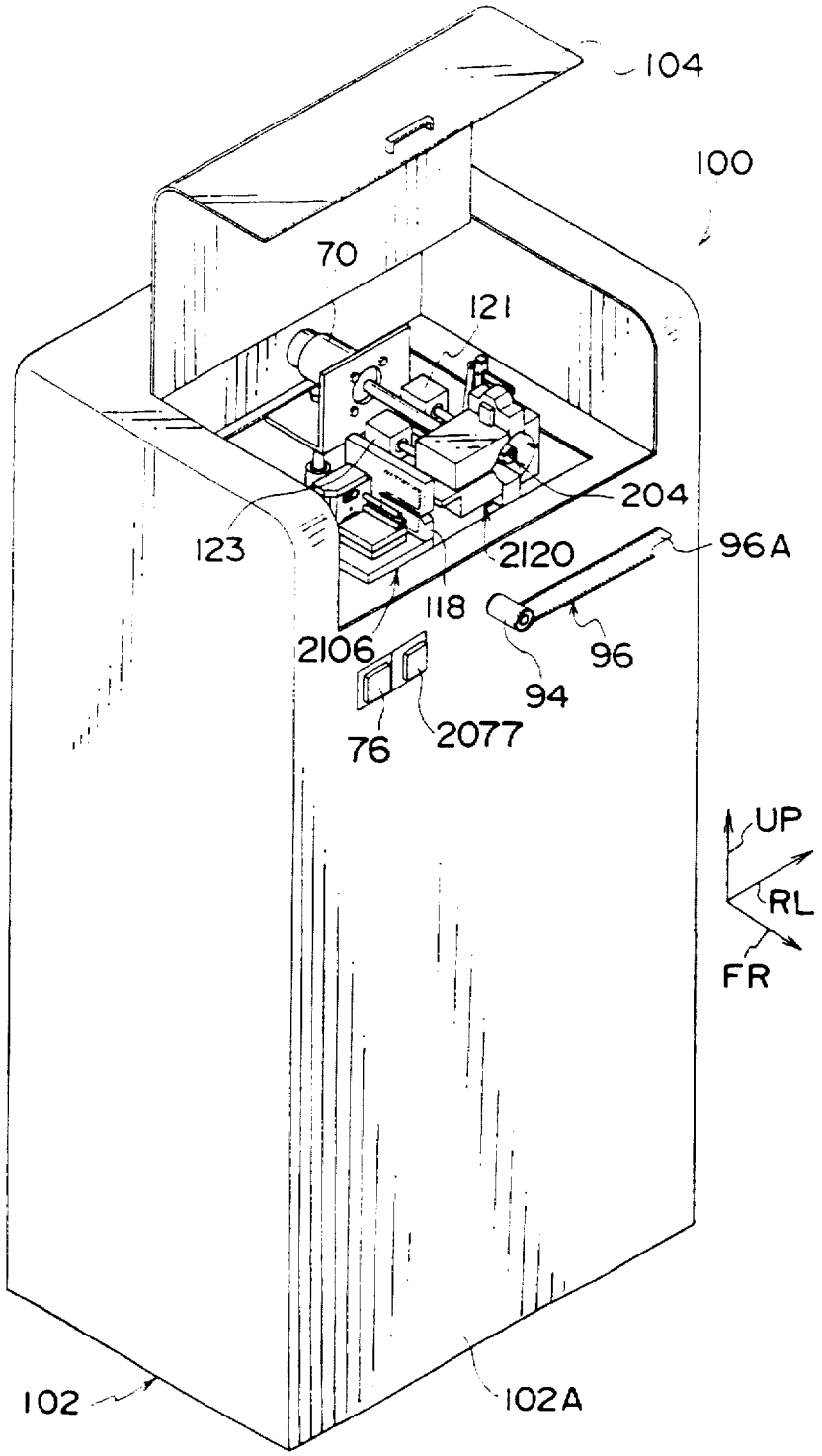
FIG. 39 is a general perspective view showing a processor according to Embodiment 6 of the present invention.
Figure 40:
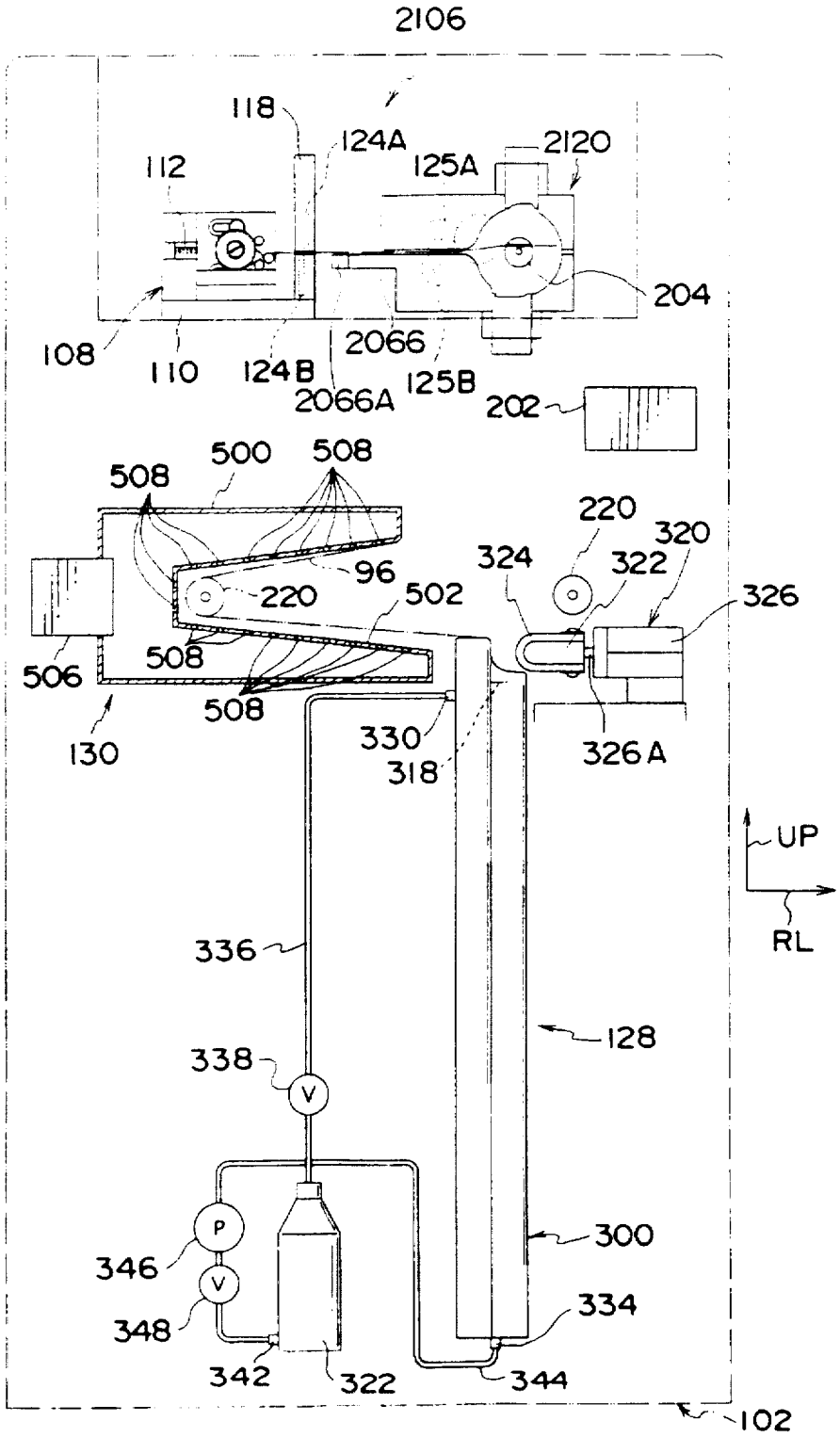
FIG. 40 is a cross-sectional view showing a key section of the processor shown in FIG. 39.

Embodiment 6 of the present invention is shown in FIG. 39 to FIG. 54, as shown in FIG. 39 and FIG. 40, an intermediate cartridge 212 is provided in a loading section 2106 in the an upper section of the casing 102. It should be noted that the same reference numerals are assigned to the same components as those in Embodiment 1 and detailed description thereof is omitted herein.

Figure 41:
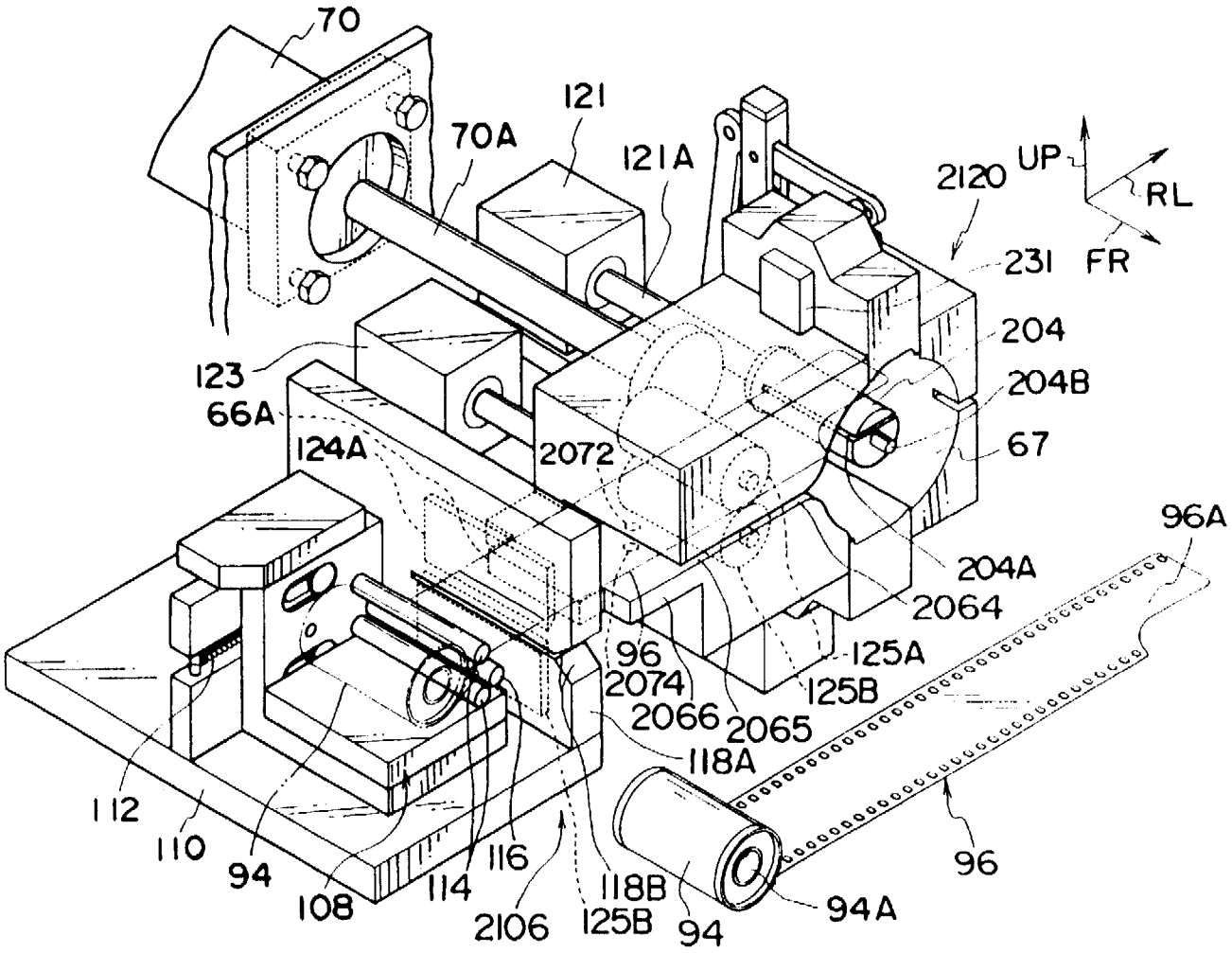
FIG. 41 is a perspective view showing a key section of the intermediate cartridge shown in FIG. 39.
Figure 42:
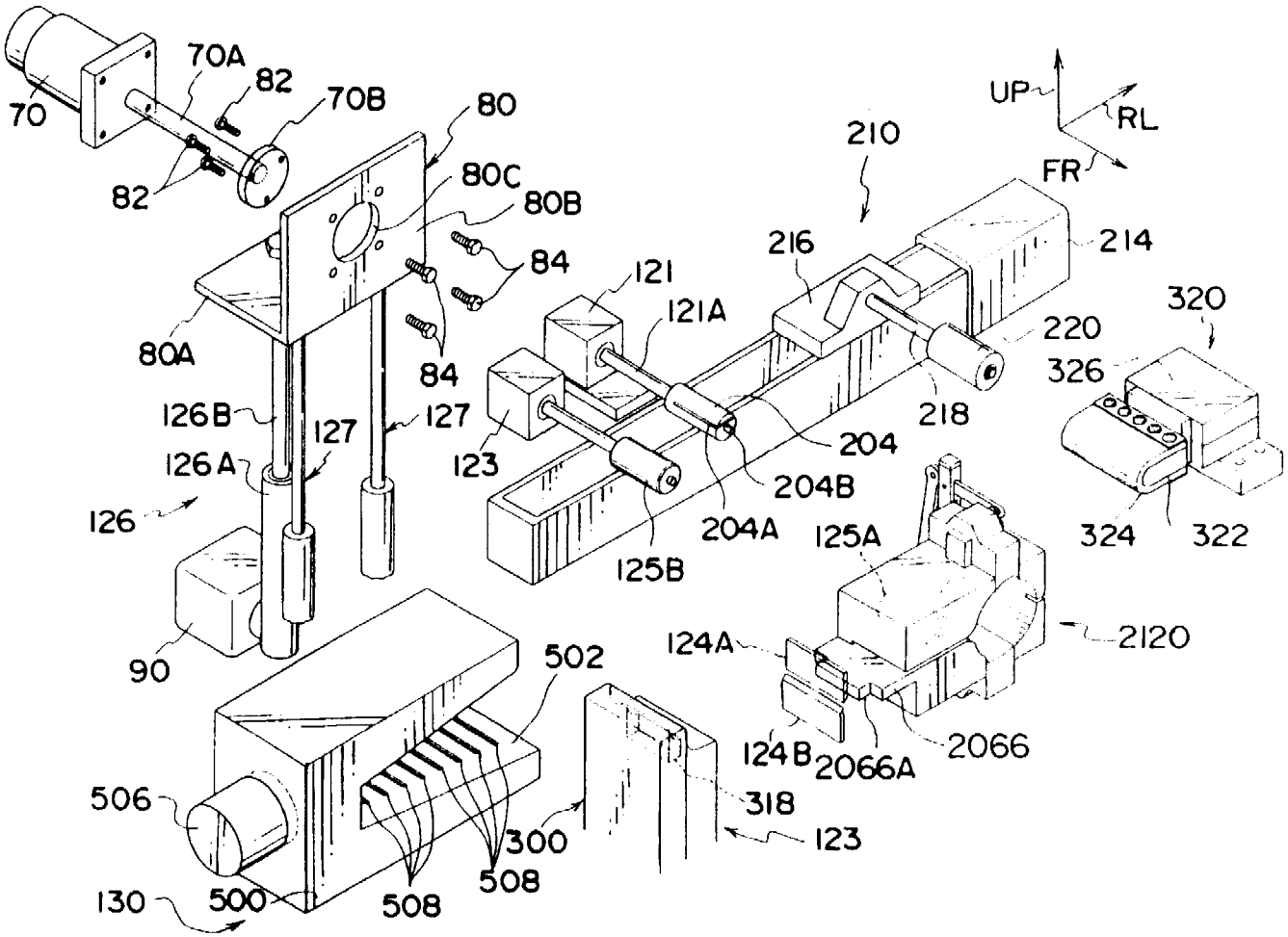
FIG. 42 is a dissolved perspective view showing a key section of the processor.

As shown in FIG. 41, at a front edge face of the intermediate spool shaft 204, a projecting section 204B engaging the spool shaft 16 of the cartridge 14 for APS is provided and projects forward. Namely, the intermediate spool shaft 204 winds up the 135-size film 96 therearound and also functions as a spool driver for rotating the spool shaft 16 of the cartridge 14. It should be noted that a slit 2065 slightly longer as compared to thickness of the film 96 is provided in the left front side of the upper section 2120 as well as of the lower section 2120B of the intermediate cartridge 2120. This slit 2065 is formed in succession from a front edge face of the intermediate cartridge 2120 and the film 96 can be inserted into the slit 2065.

Figure 43:
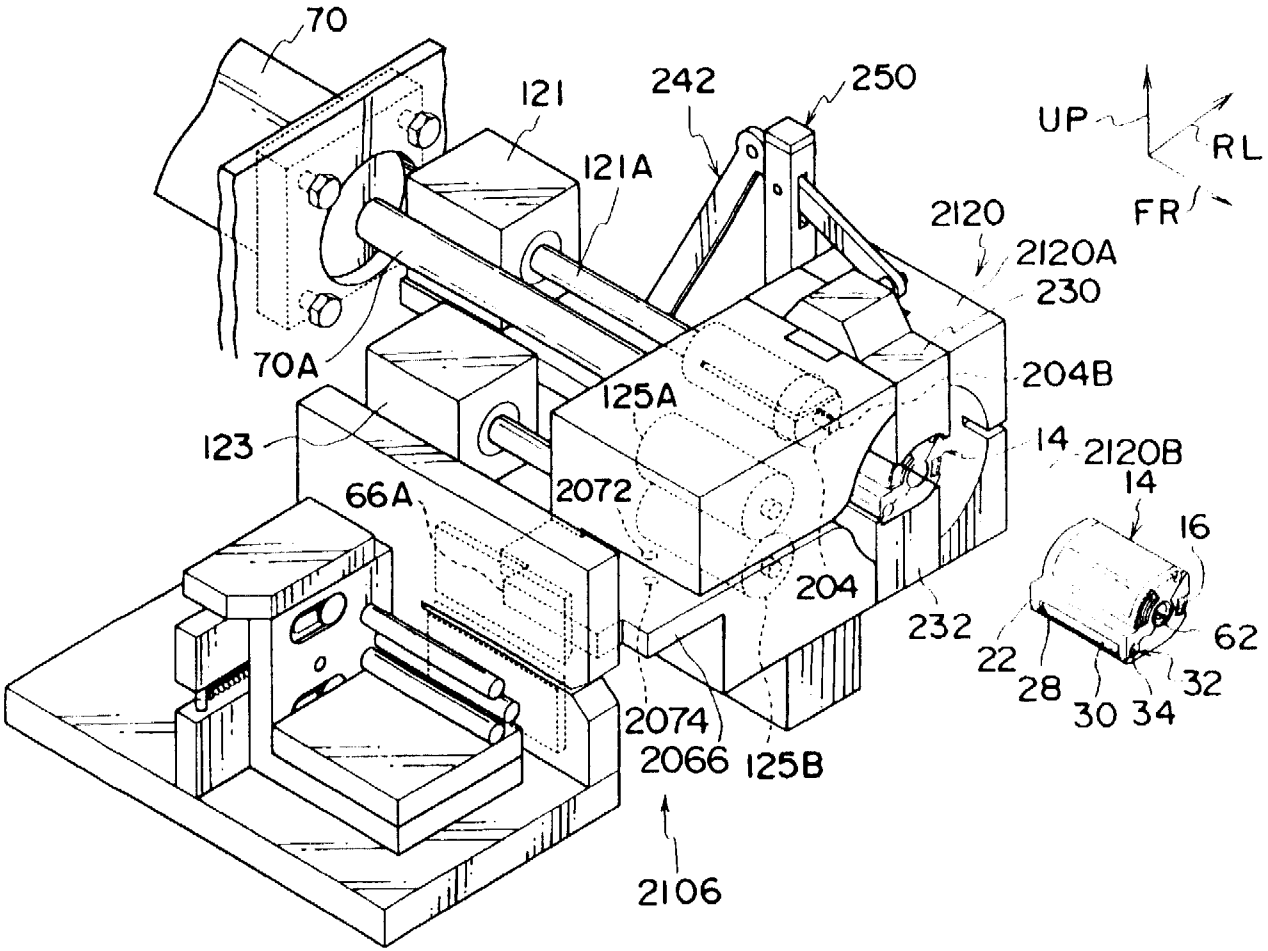
FIG. 43 is a perspective view showing the state where the APS type of cartridge is loaded in the intermediate 1 cartridge shown in FIG. 41.
Figure 44:
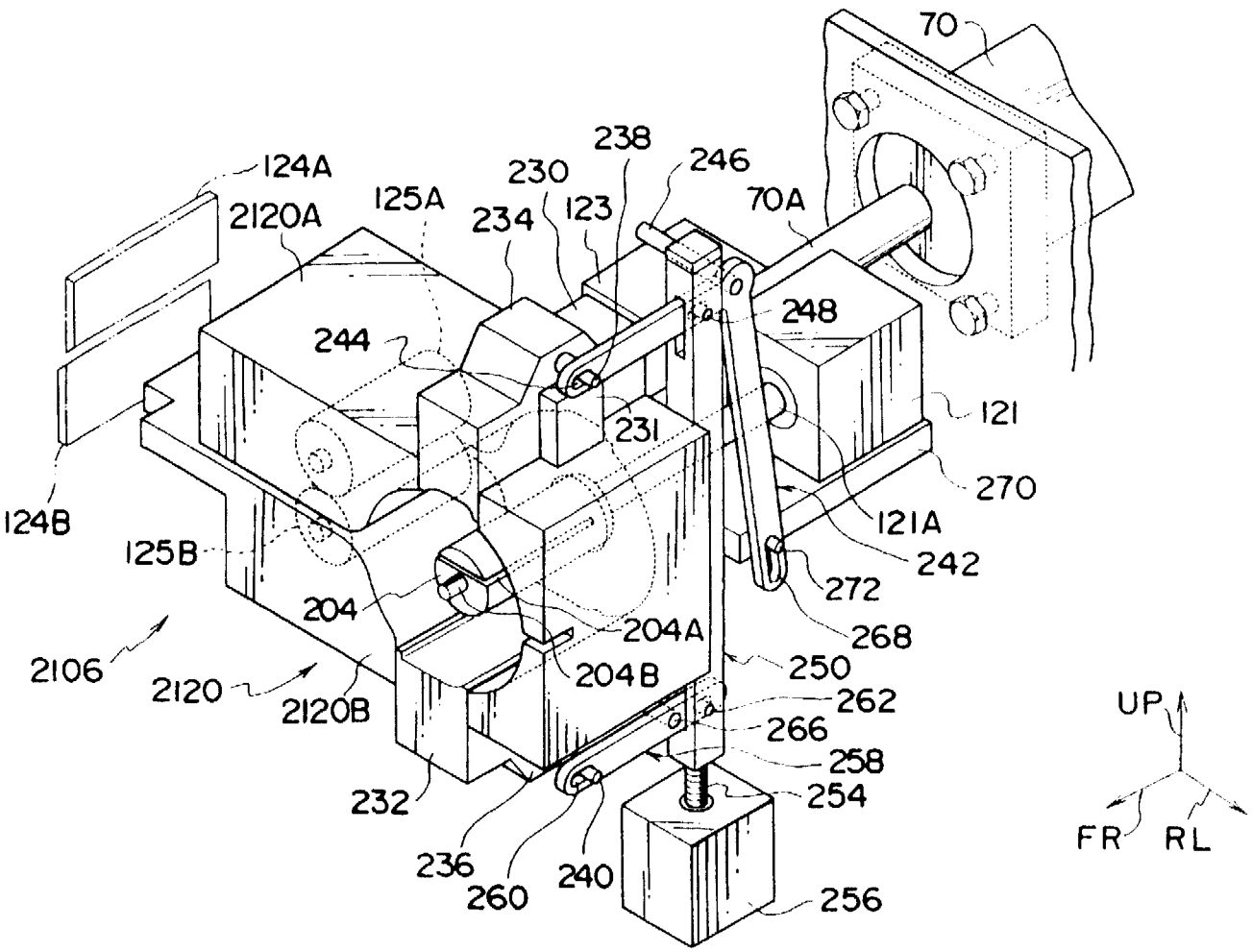
FIG. 44 is a perspective view showing a key section of a moving unit of the holding member shown in FIG. 43.

As shown in FIG. 43 and FIG. 44, holding members 230 and 232 each as a retainer are provided in the upper section 2120A and lower section 2120B of the intermediate cartridge 2120 respectively, and the holding member 230 is provided in the upper section 2120A, while the holding member 232 is provided in the lower section 2120B. The holding members 230 and 232 can move up and down independently, and are provided at positions along a radial direction of the intermediate spool shaft 204 up and down from a center line thereof.

Namely, a hole 67 of the intermediate cartridge 2120 is formed by the upper section 2120A and lower section 2120B of the intermediate cartridge 2120 as well as by the holding members 230, 232, and a shape of faces of the holding members 230 and 232 opposing to each other correspond to an external form of the cartridge 14 when the projecting section 22 (insertion/passage port 28) of the cartridge 14 is positioned at a position opposite to the tip 2066A .

Figure 47:
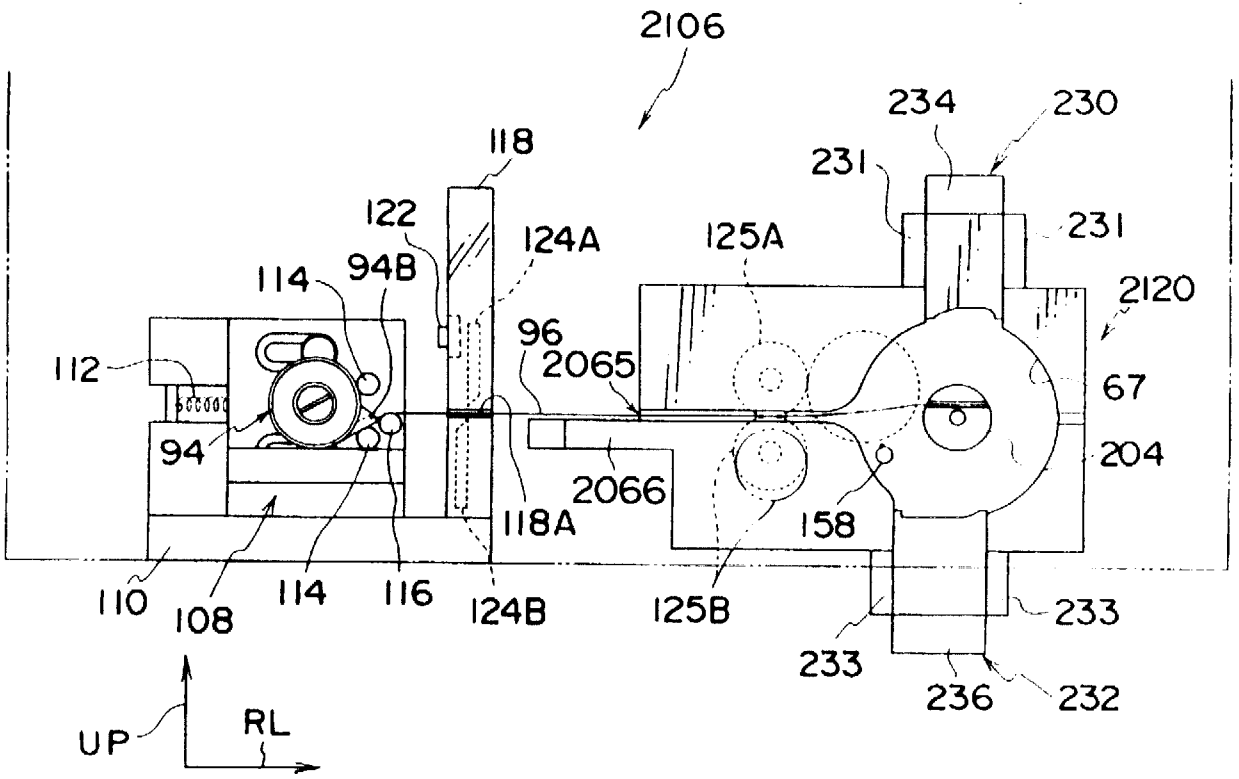
FIG. 47 is a front view showing the state where a cartridge has been mounted on the mounting member shown in FIG. 41.
Figure 48:
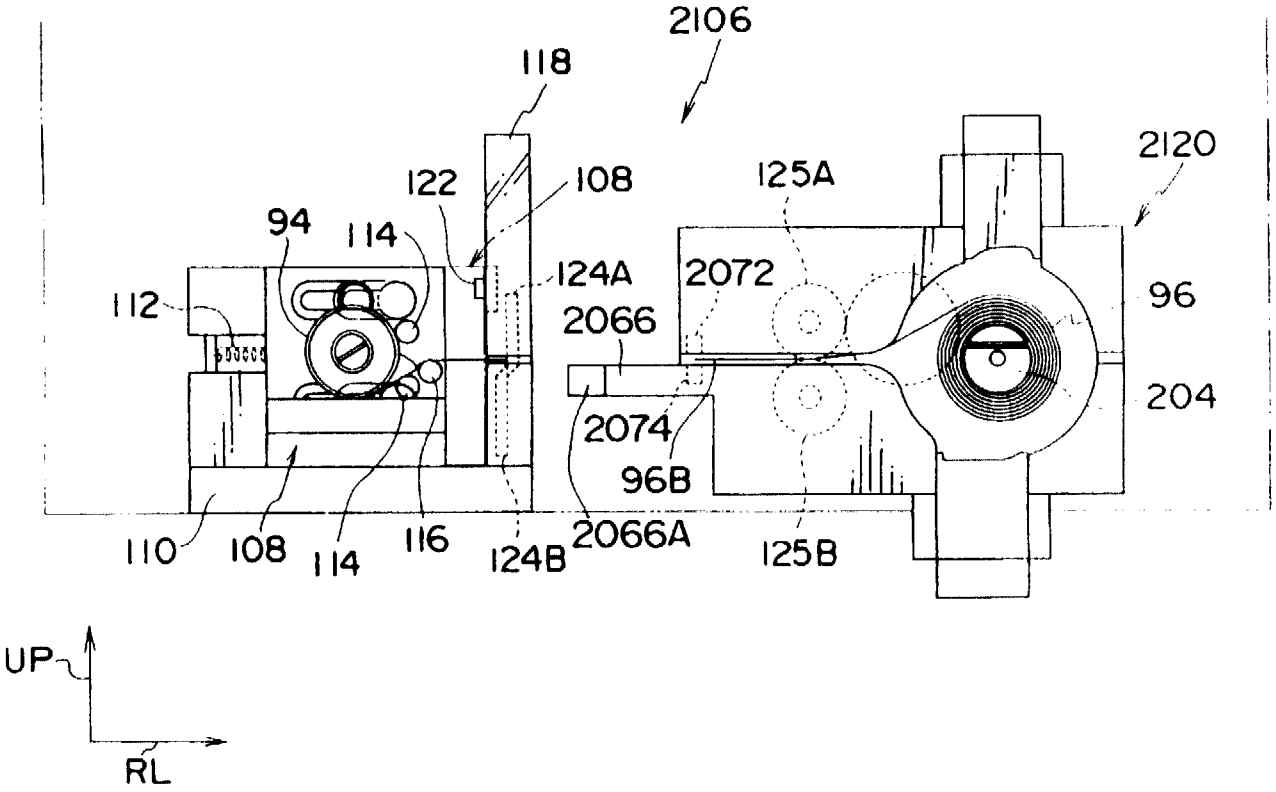
FIG. 48 is a front view showing the state where a rear edge section of the film wound around the spool shaft shown in FIG. 47 has been cut off.
Figure 49:
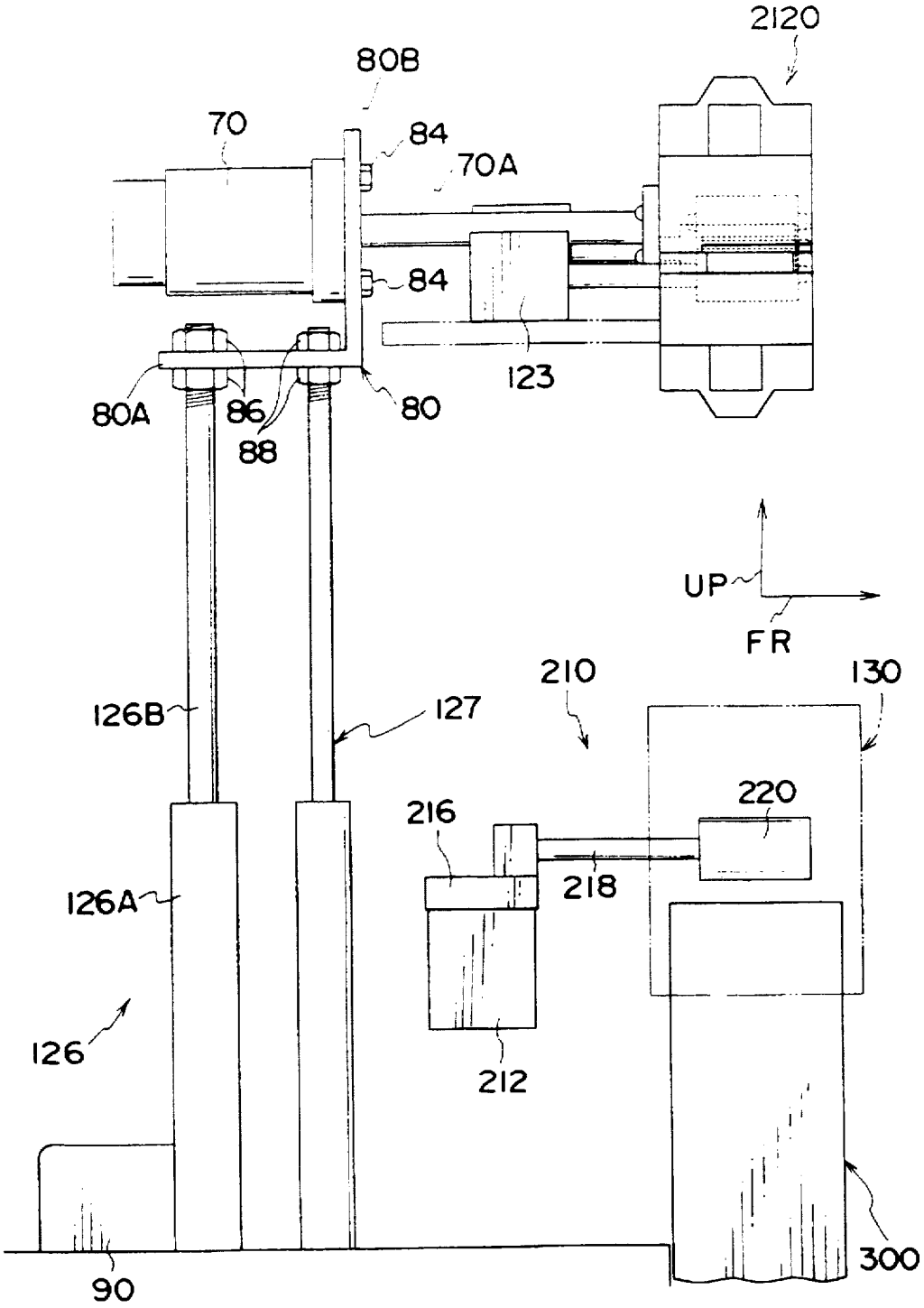
FIG. 49 is a left side view showing a key section of the processor shown in FIG. 40.
Figure 50:
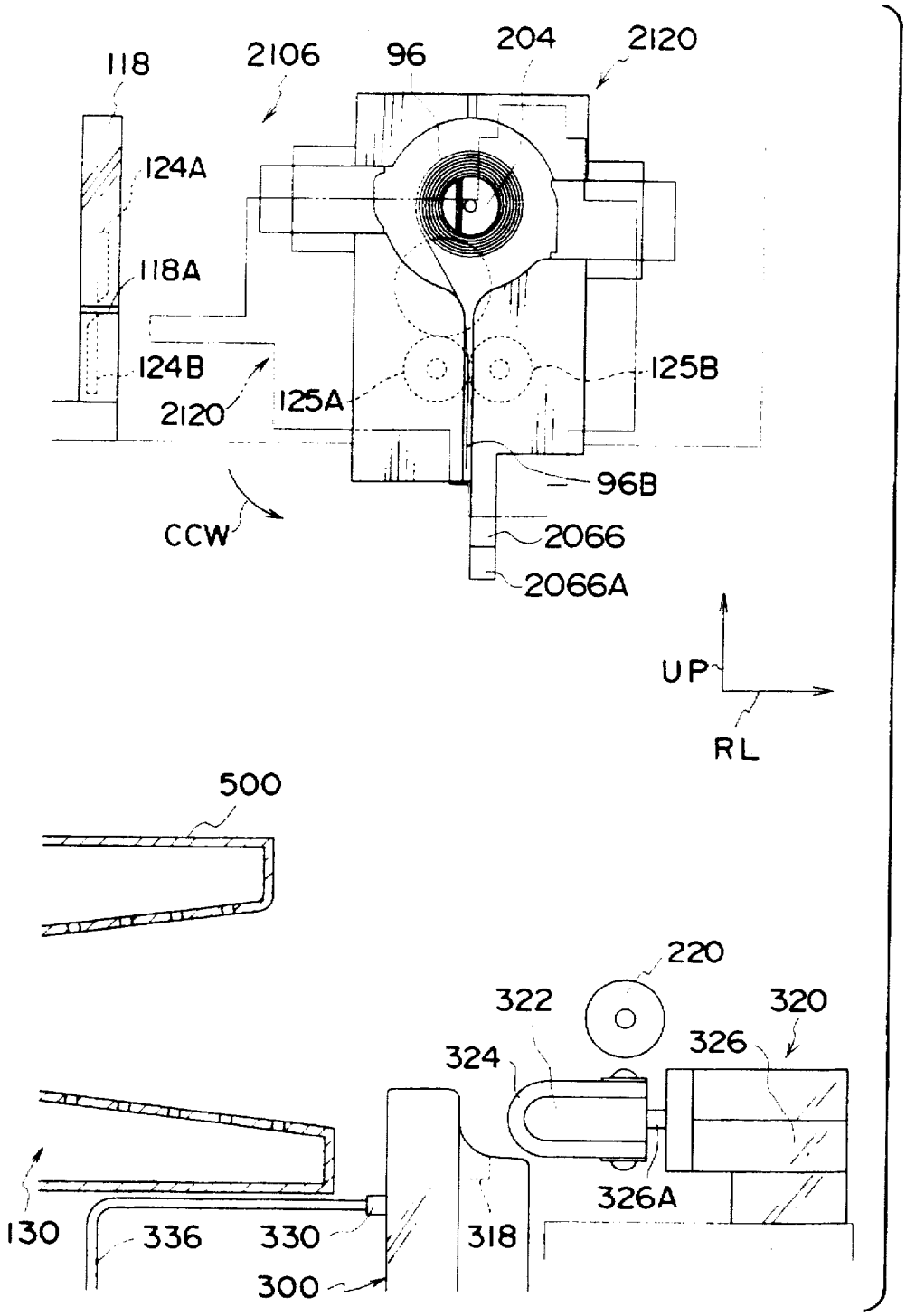
FIG. 50 is a view showing the state where the intermediate cartridge shown in FIG. 40 has been rotated.
Figure 51:
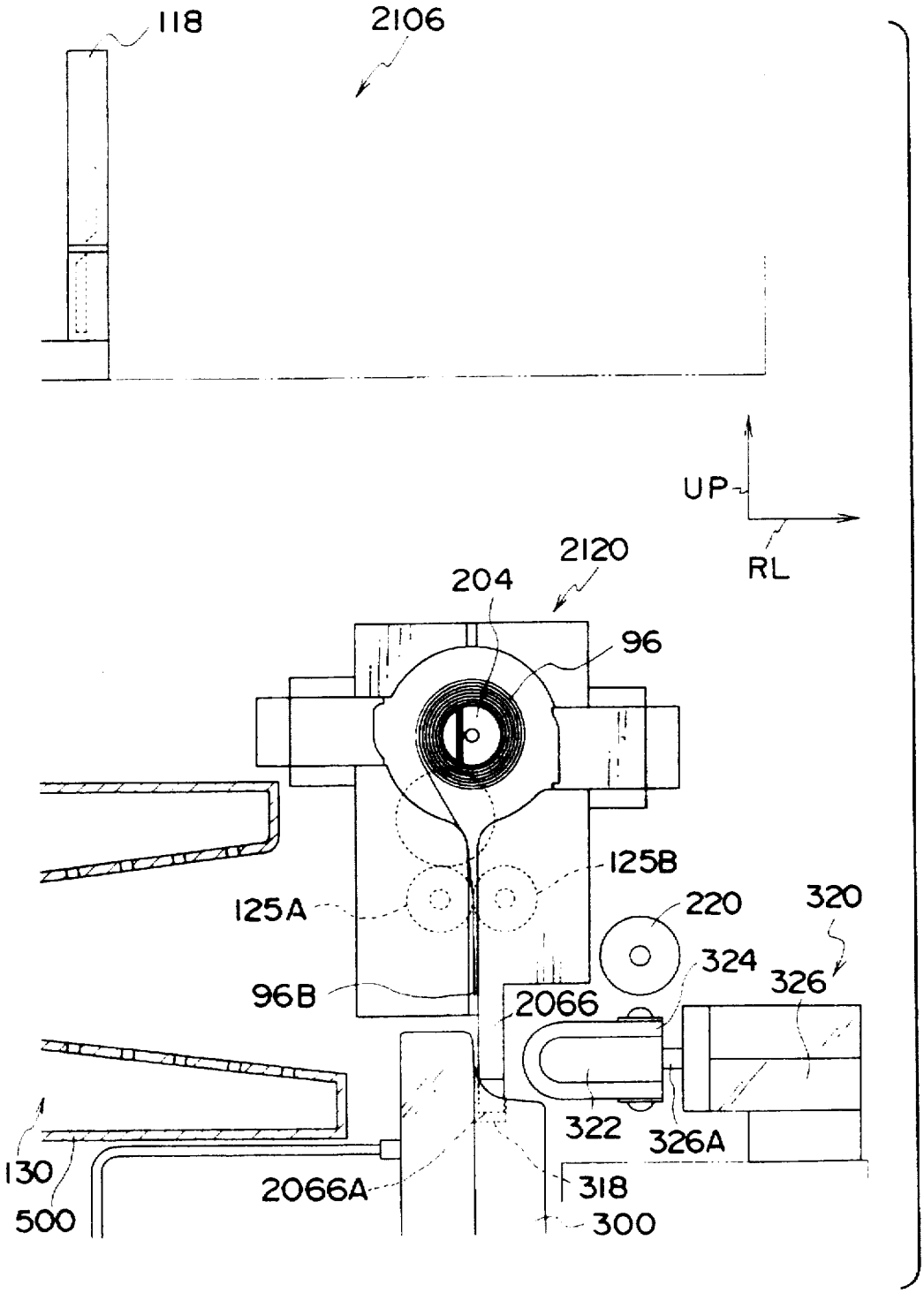
FIG. 51 is a view showing the state where the intermediate cartridge shown in FIG. 50 went down.
Figure 52:
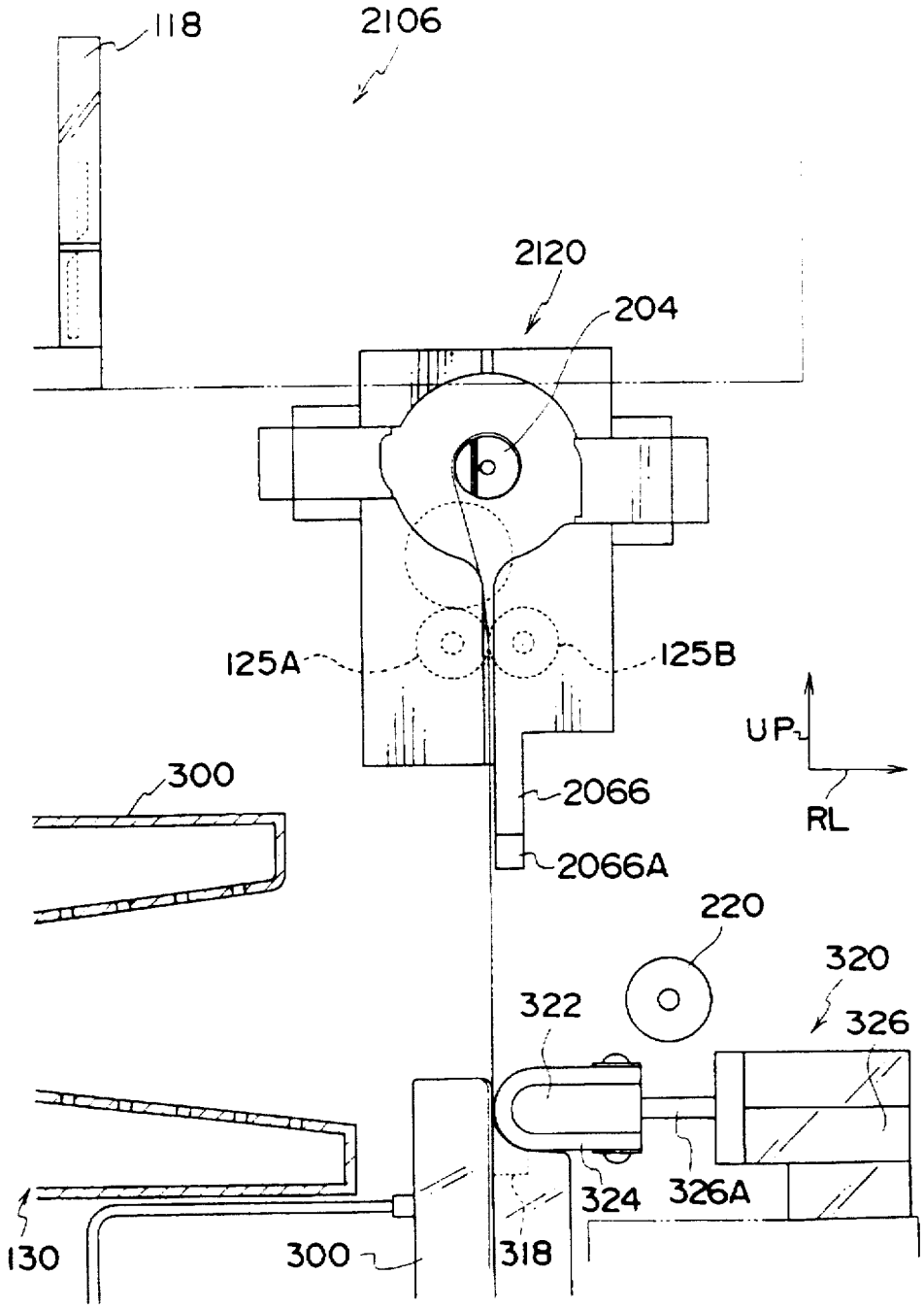
FIG. 52 is a view showing the state where the intermediate cartridge shown in FIG. 51 slightly went up and the processing tank has been closed.
Figure 53:
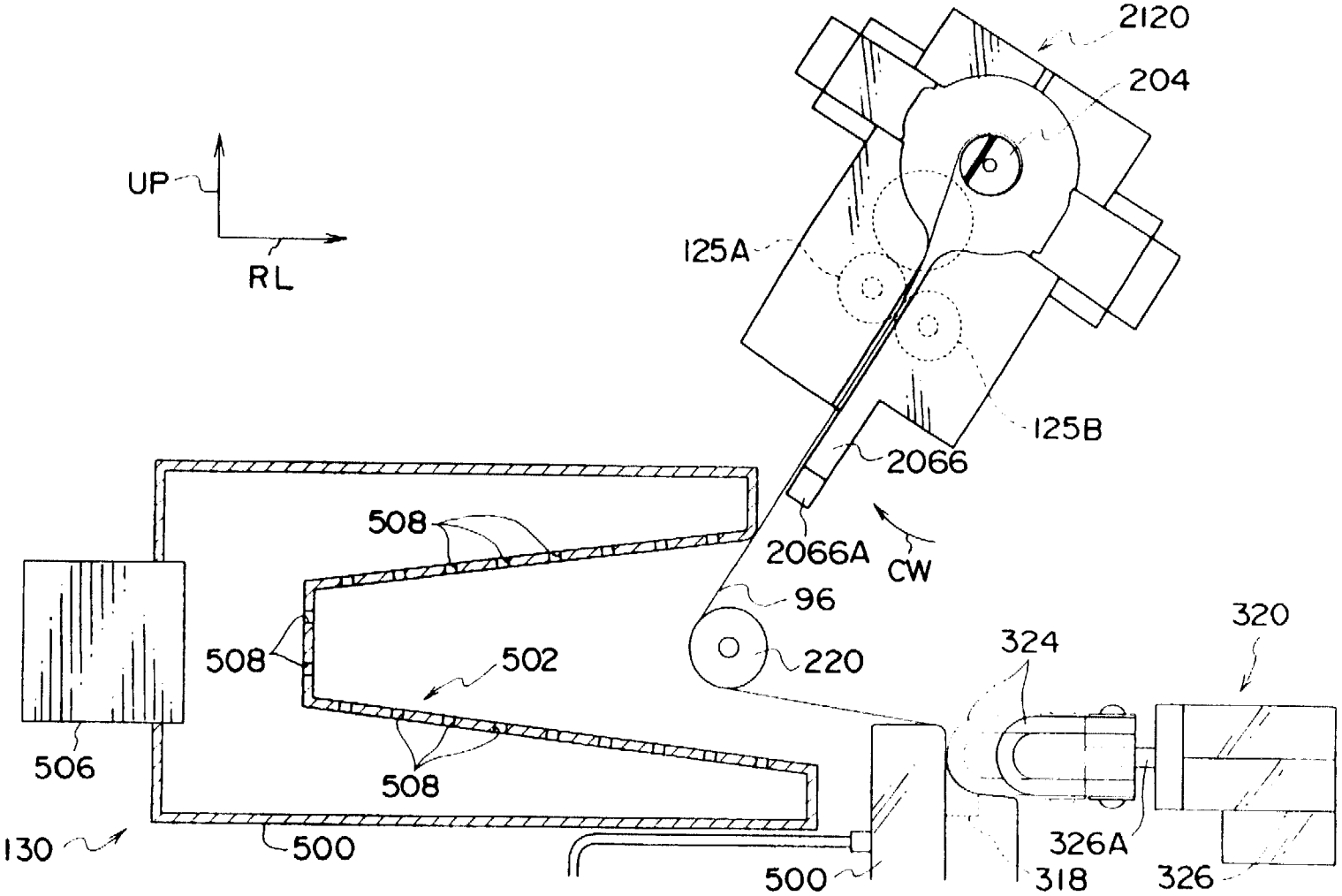
FIG. 53 is a view showing the state where the intermediate cartridge shown in FIG. 52 was slightly rotated and the film has been slightly withdrawn by the roller from the processing tank.
Figure 54:
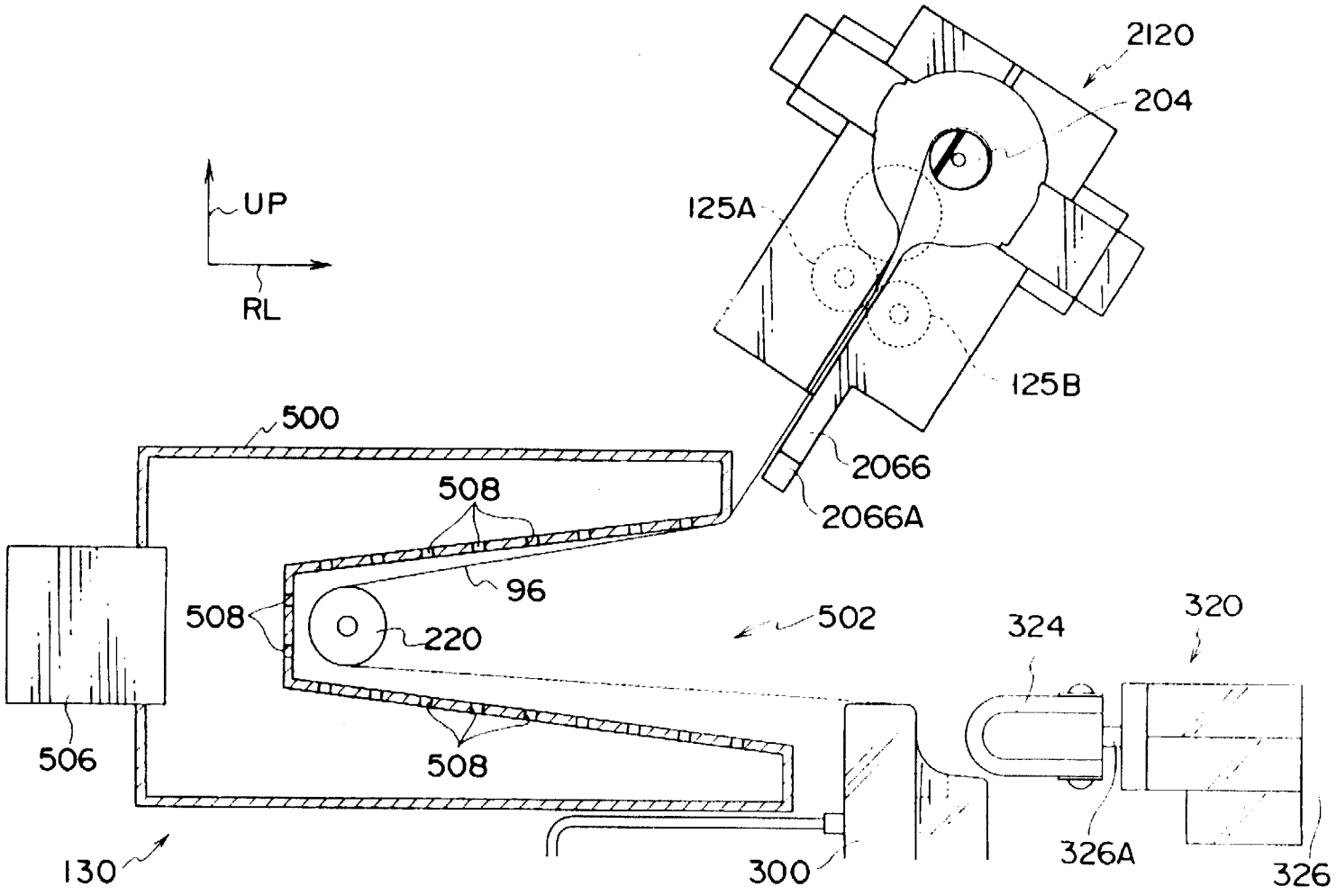
FIG. 54 is a view showing the state where the film shown in FIG. 53 is withdrawn by the roller from the processing tank and is dried.

Further, as shown in FIG. 41, when the 135-size film 96 is wound around the intermediate spool shaft 204, the holding members 230 and holding member 232 shown in FIG. 47 are moved to the side contrary to the center line of the intermediate spool shaft 204. When the cartridge 14 is set in the intermediate cartridge 2120, as shown in FIG. 43, the holding members 230 and 232 are moved to the enter line of the intermediate spool shaft 204 to hold the cartridge 14 therebetween.

Figure 45:
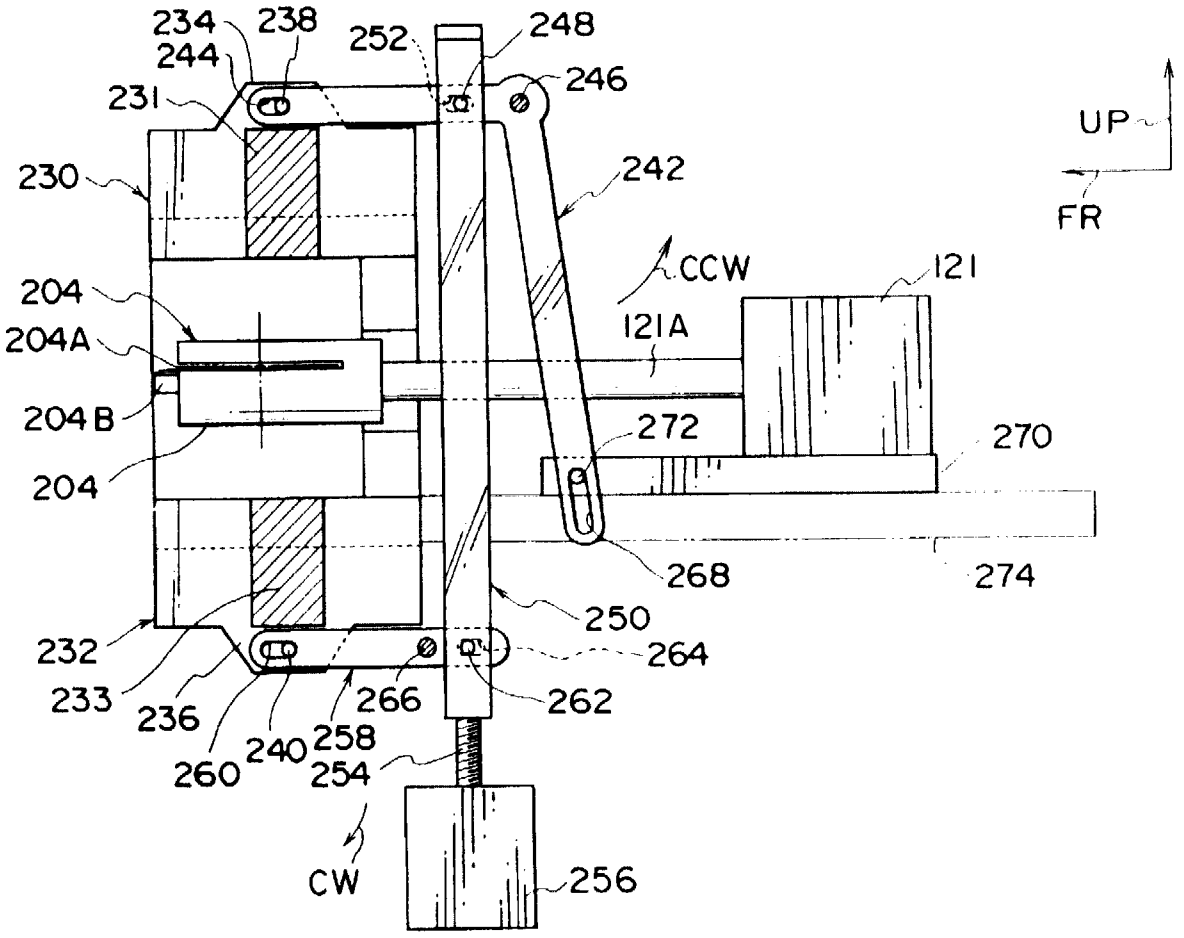
FIG. 45 is a cross-sectional view showing a key section of the holding member shown in FIG. 44.

Next description is made for configuration of a transfer unit linked to the holding member 230 as well as to the holding member 232 with reference to FIG. 44 and FIG. 45. In this embodiment, transfer of the holding members 230 and 232 are synchronized to that of the intermediate spool shaft 204 by using a link mechanism, but synchronism is not always required. It should be noted that the transfer unit according to the present embodiment may be connected, in addition to the link mechanism, to a drive source (such as a motor, a linear motor, a solenoid, an air cylinder, a hydraulic cylinder or the like) for discretely driving the holding members 230, 232 and the intermediate spool shaft 204.

Projecting sections 234 and 236 each projecting to the side contrary to the center line of the intermediate spool shaft 204 are formed on the holding members 230 and 232 respectively at a substantially central position in the front side-to-rear side direction. The projecting sections 234 and 236 have column-shaped pins 238 and 240 each projecting rightward on the right side face thereof respectively.

As shown in FIG. 45, the pin 238 is engaged in a long hole 244 formed at one edge section of a substantially L-shaped rod 242, and this long hole 244 is formed with the longitudinal direction thereof extending in the front side-to-rear side direction.

A support 246 is fixed to an angular section of the rod 242, and the rod 242 rotates around this support 246. A pin 248 is provided at a position closer to the support shaft 246 and projects rightward. This pin 248 is engaged in a long hole 252 formed in an angular column-shaped operating lever 250, and a motor 256 is linked via a screw section 254 to the lower section of this operating lever 250.

The pin 240 is engaged in a long hole 260 formed at a front edge section of a linear rod 258, and the long hole 260 is formed with the longitudinal direction extending along the front side-to-rear side direction.

A pin projecting rightward is provided at a rear edge section of the rod 258, and this pin 262 is engaged in a long hole 264 formed under the operating lever 250. A supporting shaft 266 is linked to a section between the pin 262 and long hole 260 at a position closer to the pin 262. When the motor 256 starts rotating and the operating lever moves up and down, the rod 242 and the rod 252 rotates around the supporting shafts 246 and 266 respectively. In association with rotation of the rods 242 and 258, the holding member 230 and holding member 232 moves up and down.

A long hole 268 is formed at a lower edge which is the other edge of the rod 242, and this long hole 268 is formed with the longitudinal direction extending along the longitudinal direction of the lower edge section. A pin 272 formed on a slider 270 with the motor 121 mounted thereon is engaged in the long hole 268. The slider 270 can move back and forth against the base 274 fixing the intermediate cartridge 2120 (Refer to the imaginary line in FIG. 45).

Accordingly, when the motor 256 starts rotating, the holding members 230 and 232 move up and down, and also the slider 270 moves in association with rotation of the motor 256 to move the intermediate spool shaft 204 back and forth.

It should be noted that, in this embodiment, a ratio of up/down moving range of the holding members 230 and 232 vs moving range of the intermediate spool shaft 204 is set to about 2; 1, but this ratio can be changed arbitrarily. Such a device as a rotary solenoid, or a rotary actuator may be linked to the pin 246 shown in FIG. 45 to rotate the rod 242 and other components, or an air cylinder or a solenoid may be used in place of the motor 256.

In this embodiment, instead of providing separate holding members 230 and 232 as shown in FIG. 41, the upper section 2120A and lower section 2120B of the intermediate cartridge 2120 may be separated from each other, and the upper section 2120A and lower section 2120 are moved up and down by a moving unit. Also, only one of the pair of holding members 230, 232 (upper section 2120A and lower section 2120B) may be made movable.

As shown in FIG. 47, guide pieces 231 and 233 are provided and project in both sides of the holding members 230 and 232 in the lateral direction. Also the holding members 230 and 232 move up and down along the guide pieces 231 and 233.

As shown in FIG. 23, the door driver 158 shown in FIG. 47 and for opening/closing the door 30 of he intermediate cartridge 14 is provided in the intermediate cartridge 2120 at a position opposite to a key hole 34 formed in the door shaft 32. This driver 158 is provided only in the front side and is linked to a motor not shown herein. Also the door driver 158 shown in FIG. 47 and a motor not shown are linked to the slider 270 and can move right and left in association with movement of the slider 270.

When a switch 2077 shown in FIG. 39 is turned ON, the holding members 230, 232, and the intermediate spool shaft 204 move toward the cartridge 14 by a prespecified range. For this reason, the projecting section 204B of the intermediate spool shaft 204 engaged in a key hole 62 of the spool shaft 16, and the holding members 230 and 232 hold the cartridge 14 therebetween.

As shown in FIG. 41, a light-emitting element 2072 and a light-receiving element 2074 are provided on the guide plates 2064 and 2066 for the intermediate cartridge 2120 in the side of the partition wall 118 facing the film 26. When light emitted by this light-emitting element 2072 is supplied to the light-receiving element 2074, the control unit determines a position of a rear edge 96B of the film 96 (Refer to FIG. 48).

Figure 56:
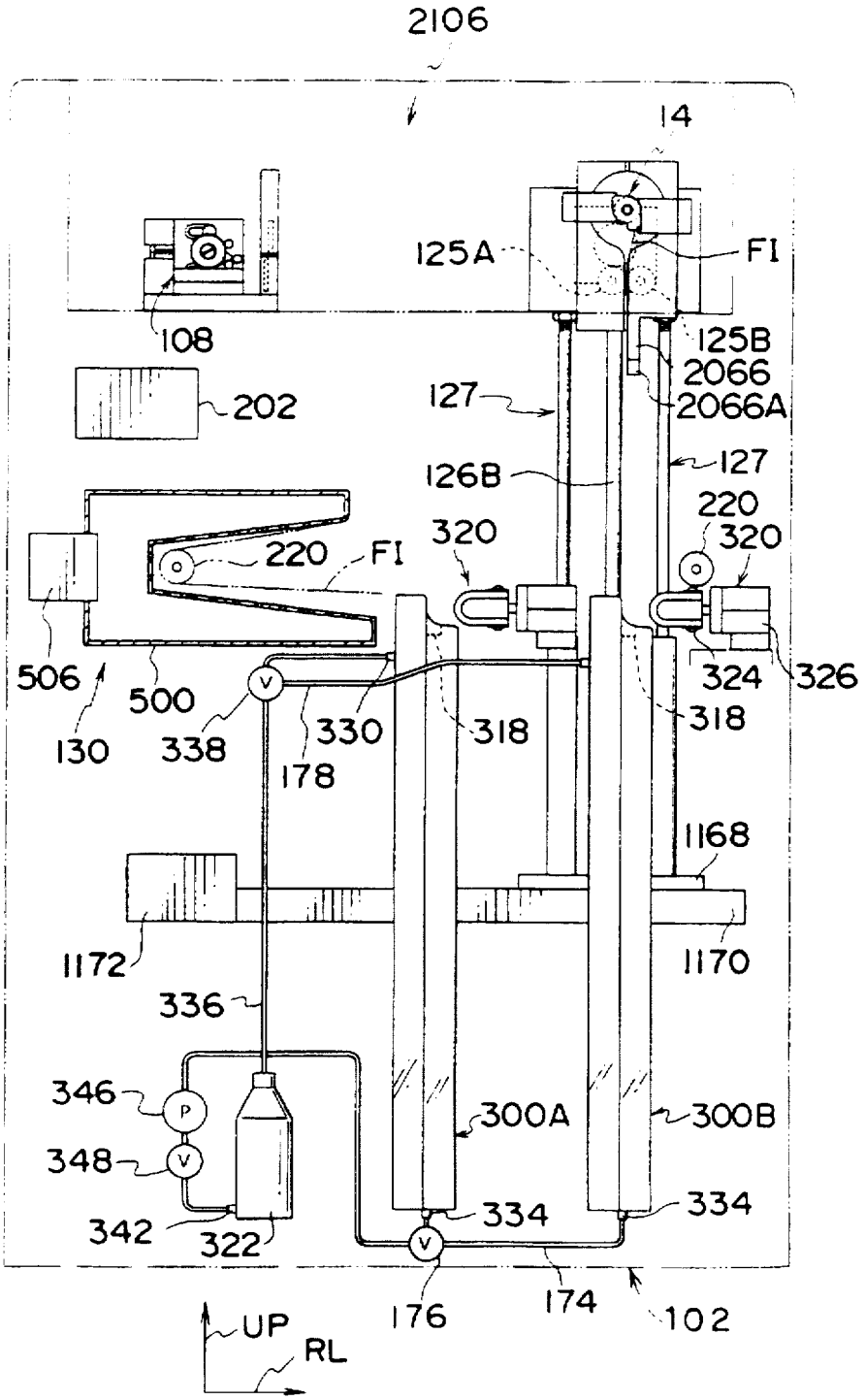
FIG. 56 is a view showing the state where the intermediate cartridge shown in FIG. 55 has been moved by the moving unit.

As shown in FIG. 39, provided in the right side of the switch 76 on the front panel 10 is a switch 2077 enabling a series of operations for developing and drying a second film FI for APS (Refer to FIG. 56). Further provided inside a casing 102 indicated by the imaginary line in FIG. 40 are an intermediate cartridge carrier 126 (Refer to FIG. 42 and FIG. 49), developing section 128, and drying section 130 like those in Embodiment 1. Detailed description is omitted herein.

(Operation)

Next description is made for operation in this embodiment. In this embodiment, a processing sequence for development of the 135-size film 96 is, as shown in FIG. 47 to FIG. 54, the same as that in Embodiment 1, and for this reason description thereof is omitted herein.

Figure 46:
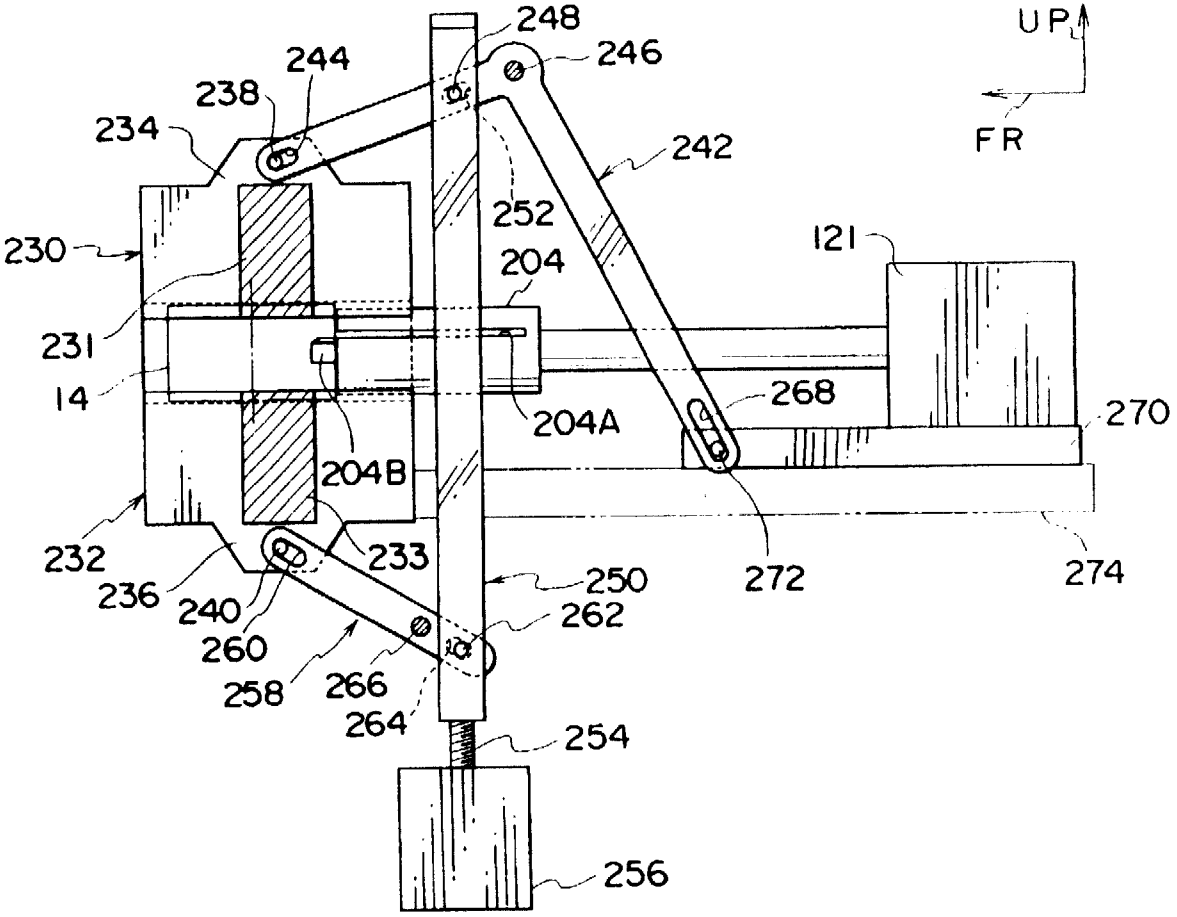
FIG. 46 is a cross-sectional view showing the state where the holding section shown in FIG. 45 has been moved.

Next description is made for a case where an APS film FI is to be developed, the holding members 230 and 232 shown in FIG. 44 and FIG. 45 are moved from the positions in the contrary side from the center line of the intermediate spool shaft 204 to the center line side of the intermediate spool shaft 204 shown in FIG. 43 and FIG. 46.

Namely, when the cartridge 14 is placed on the holding member 232 and the switch 2077 shown in FIG. 39 is operated in this sate, the motor 256 shown in FIG. 44 starts rotating, and the operating lever 250 moved downward. Then the rod 242 rotates counterclockwise around the supporting shaft 246 (in the direction indicated by the arrow mark CCW in FIG. 45), and the rod 258 rotates clockwise around the support shaft 266 (in the direction shown by the arrow mark CCW in FIG. 45). Also as shown in FIG. 46, the slider 270 slides backward in association with rotation of the rod 258, so that the intermediate spool shaft 204 moves backward.

For this reason, the holding members 230, 232 move to the side of center line of the intermediate spool shaft 204 to hold the cartridge 14 therebetween, and a pair of door drivers 158 (Refer to FIG. 47) and the projecting section 204 engages the spool shaft 16 and door shaft 32 respectively. With this series of operations, the cartridge 14 is loaded in a hole 67 of the intermediate cartridge 2120. The subsequent operations are the same as those in development of the 135-size film 96, so that description thereof is omitted herein.

It should be noted that, when all the operations for developing and drying the film FI are finished, the motor 256 shown in FIG. 44 starts rotating to move the operating lever upward with the rods 242 and 258 returned to the original positions shown in FIG. 44 and FIG. 45. Also the intermediate spool shaft 204 pushes the cartridge 15 forward, so that the cartridge 14 can be picked up out of the hole 67.

In this embodiment, the 135 mm-size film 96 is wound up from the cartridge 94 around the intermediate spool shaft 204 of the intermediate cartridge 2120 and retained in the hole 67, and the film can be inserted in this state from the intermediate cartridge 2120 into the processing tank 300, and also the cartridge 14 for APS films can be loaded in the intermediate cartridge 2120 for developing the film FI.

Namely in this embodiment, both the 135-size film 96 and cartridge 14 for APS (film FI) can be loaded in a single intermediate cartridge 2120, so that the intermediate cartridge 2120, roller 125B, motor 121, and other related components can be used for development of both types of film, which enables size reduction of a photosensitive material processing apparatus.

Embodiment 7

Figure 55:
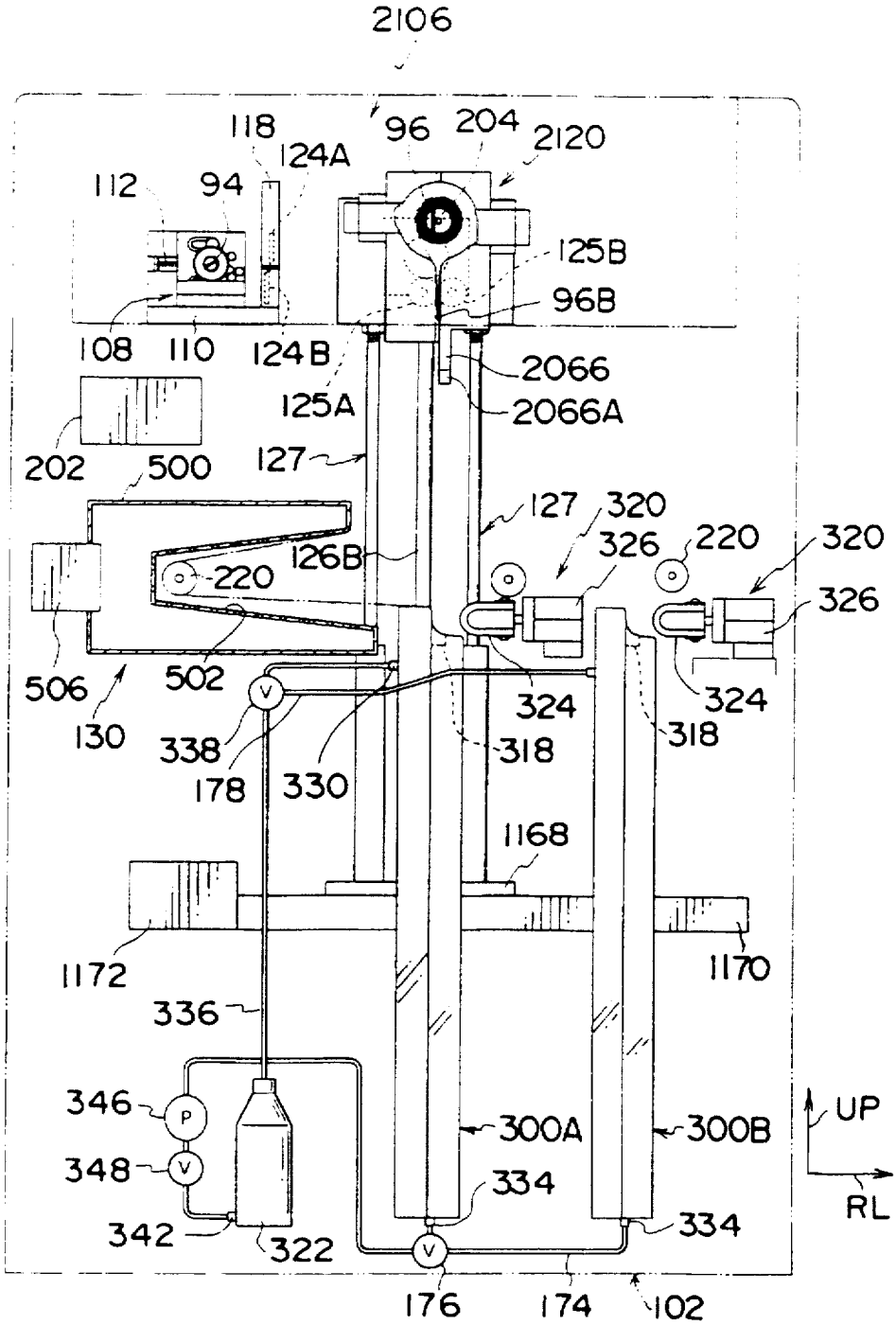
FIG. 55 is a view showing a key section of a processor according to Embodiment 7 of the present invention.

As shown in FIG. 55 and FIG. 56, in Embodiment 7, film width of the 135-size film 96 is different from that of the APS film FI, so that a pair of processing tanks 300A, 300B with widths corresponding to film widths of the film 96 and film FI are provided. It should be noted that this embodiment corresponds to the invention as claimed in claim 10. The same reference numerals are assigned to components corresponding to those in Embodiment 5, and detailed description thereof is omitted herein.

In this embodiment, the film 96 or the film FI loaded in the intermediate cartridge 2120 is located at the film insertion port 318 of the corresponding processing tank 300A or processing tank 300B for developing the film therein, other operations are the same as those in Embodiment 6 shown in FIG. 39, and description thereof is omitted herein.

In this embodiment, the film 96 and film FI are inserted into the processing tanks 300A and 300B with width corresponding to those of the 136-size film 96 and film FI respectively, so that the two edge sections of the film 96 and film FI are guided by the both side sections of the internal walls of the processing tanks 300A and 300B in the lateral direction thereof more accurately.

Embodiment 8

Figure 57:
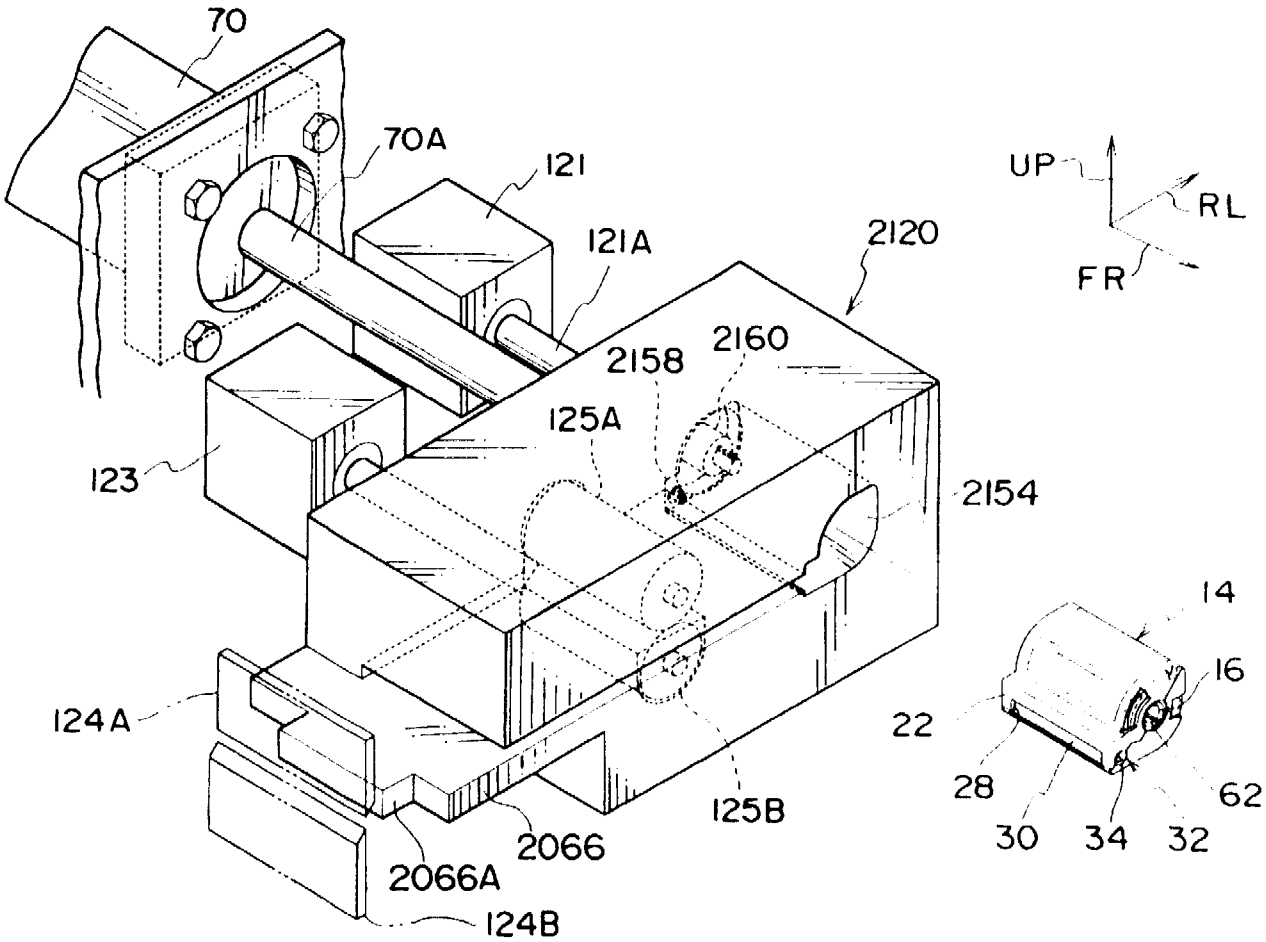
FIG. 57 is a perspective view showing a key section of an intermediate cartridge according to Embodiment 8 of the present invention and also showing the state where the APS type of cartridge is loaded.
Figure 58:
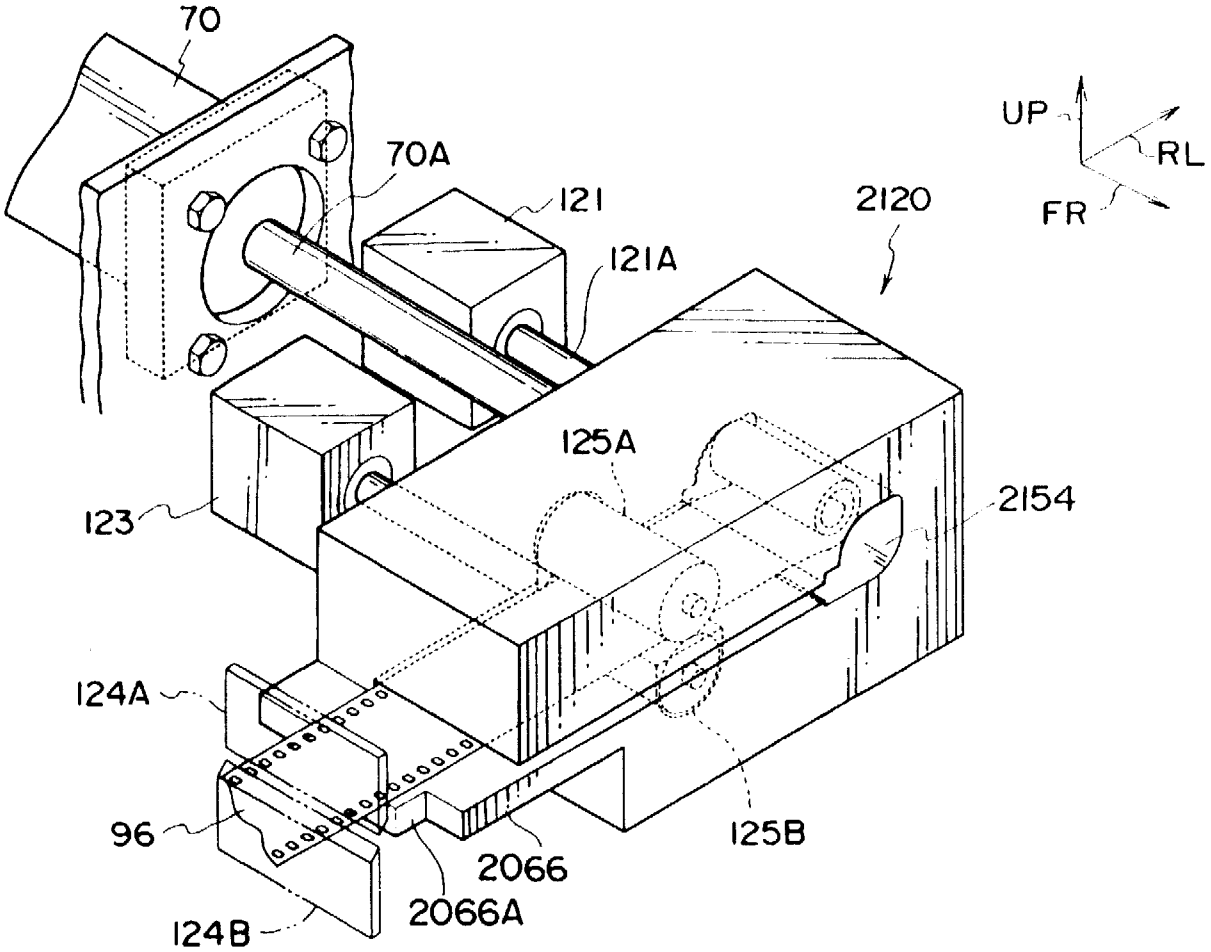
FIG. 58 is a perspective view showing the state where a 135-size film is loaded in the intermediate cartridge shown in FIG. 57.

As shown in FIG. 57 and FIG. 58, in Embodiment 8 of the present invention, the intermediate spool shaft 204 for winding up the 135-film 96 therearound is not provided therein, and only the spool driver 2160 and door driver 2158 are provided, and this embodiment corresponds to the invention as claimed in claim 6. Also it should be noted that the same reference numerals are assigned to the same components as those in Embodiment 6 and detailed description thereof is omitted herein. Also the transfer unit shown in FIG. 41 may be linked to the spool driver 2160 and door driver 2158.

As shown in FIG. 57, a recessed section 2145 for loading the cartridge 14 therein is provided in the intermediate cartridge 2120, and this recessed section 2154 has a form corresponding to an external form of the cartridge 14. When the motor 70 is rotated by 90 degrees, a tip 2066A of the intermediate cartridge 2120 is opposed to the insertion port 318 of the processing tank 300 shown in FIG. 50.

On the other hand, to retain the 135-size film 96 in the intermediate cartridge 2120, the film 96 is wound up into the recessed section 2154. In this case, as shown in FIG. 58, the film 96 is wound into the hole 142A of the intermediate cartridge 2120 because of the tendency of the film 96 for rolling up and is locked therein. When the motor 70 rotates by 90 degrees, the tip 2066A of the intermediate cartridge 2120 is set at a position opposite to the insertion port 318 of the processing tank 300 shown in FIG. 50. Other actions and effects are the same as those in Embodiment 6, so that description thereof is omitted herein.

Embodiment 9

Next description is made for Embodiment 9 of the present invention with reference to FIG. 59 to FIG. 74.

(Processor)

Figure 59:
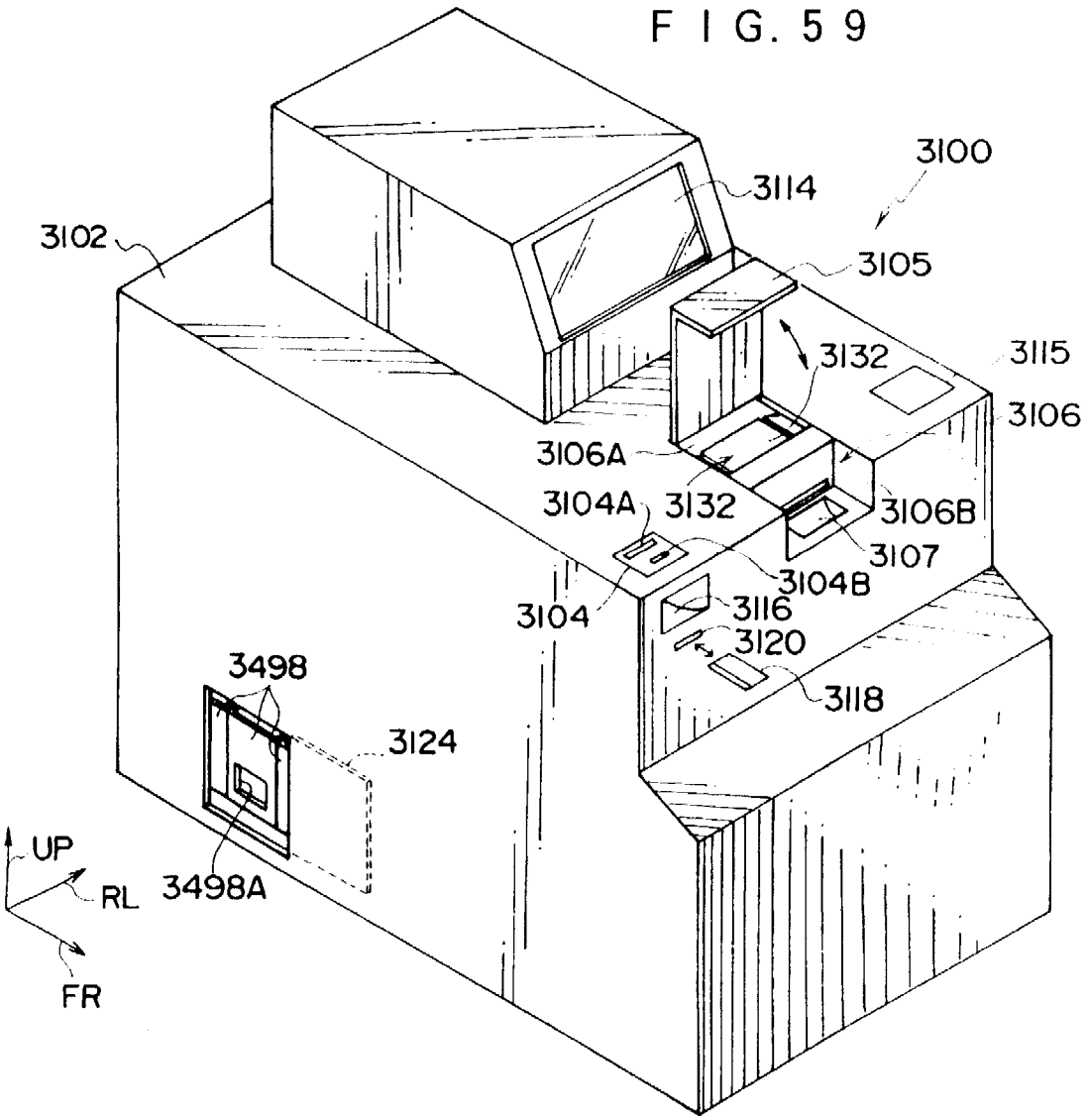
FIG. 59 is a general perspective view showing a processor according to Embodiment 9 of the present invention.

As shown in FIG. 59, a processor as a photosensitive malarial processing apparatus for developing the film FI for APS has a box-shaped casing 3102 for preventing light from coming into inside thereof.

Provided on a top surface of the casing 3102 is a fee paying section 3104 through which a fee for development and/or printing is paid in the left front side thereof. Further provided in this fee paying section 3104 are slit-formed bill insertion port 3104A for inserting bills therethrough and a slit-formed coin insertion port 3104B for injecting coins therethrough.

Also a container loading section 3106 is provided in the right side from the fee paying section 3104, and an L-shaped cover 3105 for covering this container loading section 3106 is rotatably provided.

In the container loading section 3106, a first loading port 3106A for loading the cartridge 14 for APS and a second loading port 3106B for loading the cartridge 94 for 135-size negative film therethrough are provided. The first loading port 3106A is positioned above a drum 3132 having an accommodating magazine 3136 a firs loading section and an intermediate magazine as a second loading section. A recessed section 3107 for loading therein the cartridge 94 is provided in the loading port 3106B, and this recessed section 3107 has a form which allows insertion of the lower section 94B from a lower edge of an inlet/output port 94A of the cartridge 94 for the film 96. When this lower section 94B is loaded in the recessed section 3107, the cartridge 94 is positioned.

Also an opening 3106C is formed in the recessed section 3107 at a position opposite to the inlet/output port 94A of the loaded cartridge 94, and this opening 3106C is longer than width as well as thickness of the film 96. Further provided in the loading port 3106B is an engagement shaft not shown in the figure and for engagement with the spool shaft 98 rotatably supported by the cartridge 94 (It should be noted that a motor not shown is jointed to the engagement shaft), and this engagement shaft slides along the axial direction of the spool shaft 98 after the cartridge 94 is loaded in the recessed section 3107 and engages the spool shaft 98. After this engagement is achieved, the engagement shaft rotates to rotate the spool shaft 98.

Provided in the casing 3102 opposite to the container loading section 3106 are a pair of cutters 3110A, 3110B each as a cutting unit. The upper cutter 3110A can move up and down, while the lower cutter 3110B is fixed at the position shown in FIG. 60. When a main control unit described later detects that the operation for winding up the film 96 around the intermediate spool shaft 3204 is finished (upper state in FIG. 74), the upper cutter 3110A moves downward to cut the film 96 at the rear edge.

Further, provided in the casing 3102 B opposite tot he container loading section 3106 are a pair of rollers 3112A, 3112B for deeding out the film 96 to the intermediate magazine 3114 at the back of the cutters 3110A, 3110B. The upper roller 3112A moves up and down, while the lower roller 3112B is fixed at the position shown in FIG. 60. The roller 3112B withdraws a tip (tongue) 96A of the film 96 in the cartridge 94 with a pair of withdrawing members 3108 described later, and then goes down and rotates to feed out the film 96.

It should be noted that an opening 3106D opposite to the opening 3106C is formed at the back of the rollers 3112A, 3112 B, and the film 96 is carried up to the intermediate magazine 3134.

As shown in FIG. 59, provided on a top surface of the casing 3102 is a display unit 3114 for displaying a message at the back of a container loading section 3106. Also provided in the right side from the container loading section 3106 is an operating unit 3115 having a select button for selecting which of the APD film and 135-size film is to be developed, a start button for starting an operation for winding up the film 96 around an intermediate spool shaft 3204 described later, a start button for starting rotation of the drum 3132 or the like.

On the other hand, provided in the front face of the casing 3102 is a receiving tray for receiving changes and a receipt is provided under the fee-injecting section 3104, and a slit-formed ID card inlet/output port 3120 through which an ID card 3118 is inserted or taken out is provided under the receiving tray 3116.

Provided under the left side face of the casing 3102 is a provided an automatic door 3124 for taking out the cartridge with the film FI having been subjected to development processing accommodated therein and the film 96 already developed therefrom.

Figure 61:
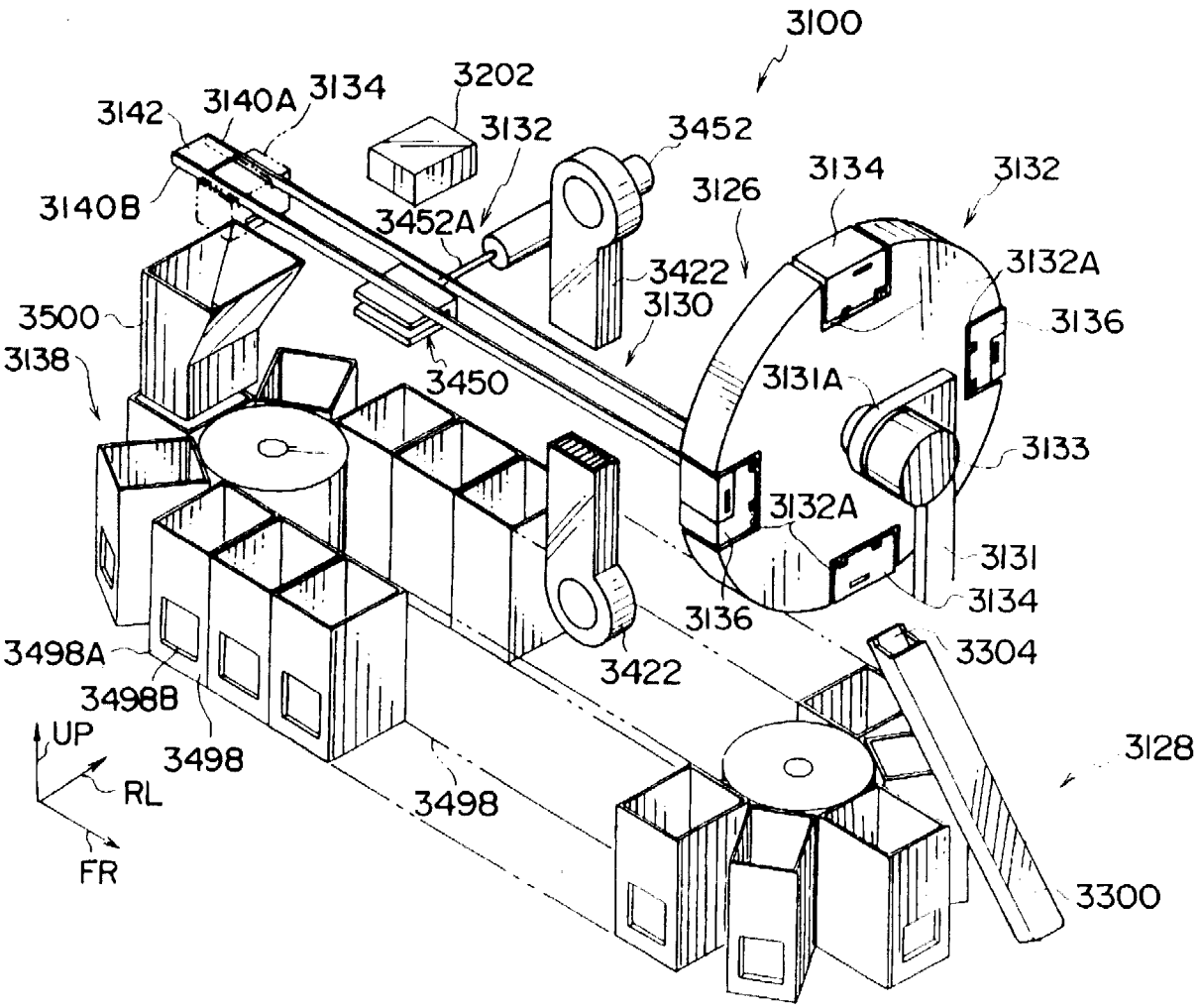
FIG. 61 is a perspective view showing a portion of internal configuration of the processor.

As shown in FIG. 61, a magazine carrier 3126, a developing section 3128, and a drying section 3180 are provided inside the casing 3102 (not shown in FIG. 61).

(Magazine carrier)

Next description is made for configuration of the magazine carrier 3126.

As shown in FIG. 61, the magazine carrier 3126 a pair of guide rails 3140A, 3140B each extending to the depth of the processor 3100 (in a direction contrary to the direction indicated by the arrow mark FR), and a stopper 3142 mounted at a deeper position from these guide rails 3140A, 3140B. The guide rails 3140B extend horizontally, while the guide rails 3140A and 3140B extend in the right-to-left direction at a specified space. One piece of magazine 314 (3136) runs on the guide rails 3140A, 3140B.

As shown in FIG. 61, the drum 3132 transfers the magazines 3134, 3136 from the loading port 3106A to the guide rails 3140A, 3140B. Namely the drum 3132 is provided in the front side from the guide rails 3140A, 340B between a pair of supporting columns 3131. Also the drum 3132 is linked to a motor shaft 3133A provided along the center line thereof, and the drum 3132 rotates in association with rotation of the motor 3133.

Substantially U-shaped locked sections 3132A are provided on an external peripheral surface of the drum 3132 at an angular space of 90 degrees. A pair of intermediate magazines 3134 are provided at positions facing to each other with the center line of the drum 3132 as a center within the lacked portion 3132A, and cartridges 314 for APS are provided at positions opposite to each other with a center line of the drum 3132 as a center within the lacked portion 3132A.

In the drum 3132, a bar code scanner not shown is provided at a position opposite to an accommodating magazine 3136 at its stand-by position, and reads bar code on the cartridge 14 not shown in the figure. The bar code data read with its bar code scanner is transmitted to the main control unit 3202.

(Configuration of magazine)

Figure 62:
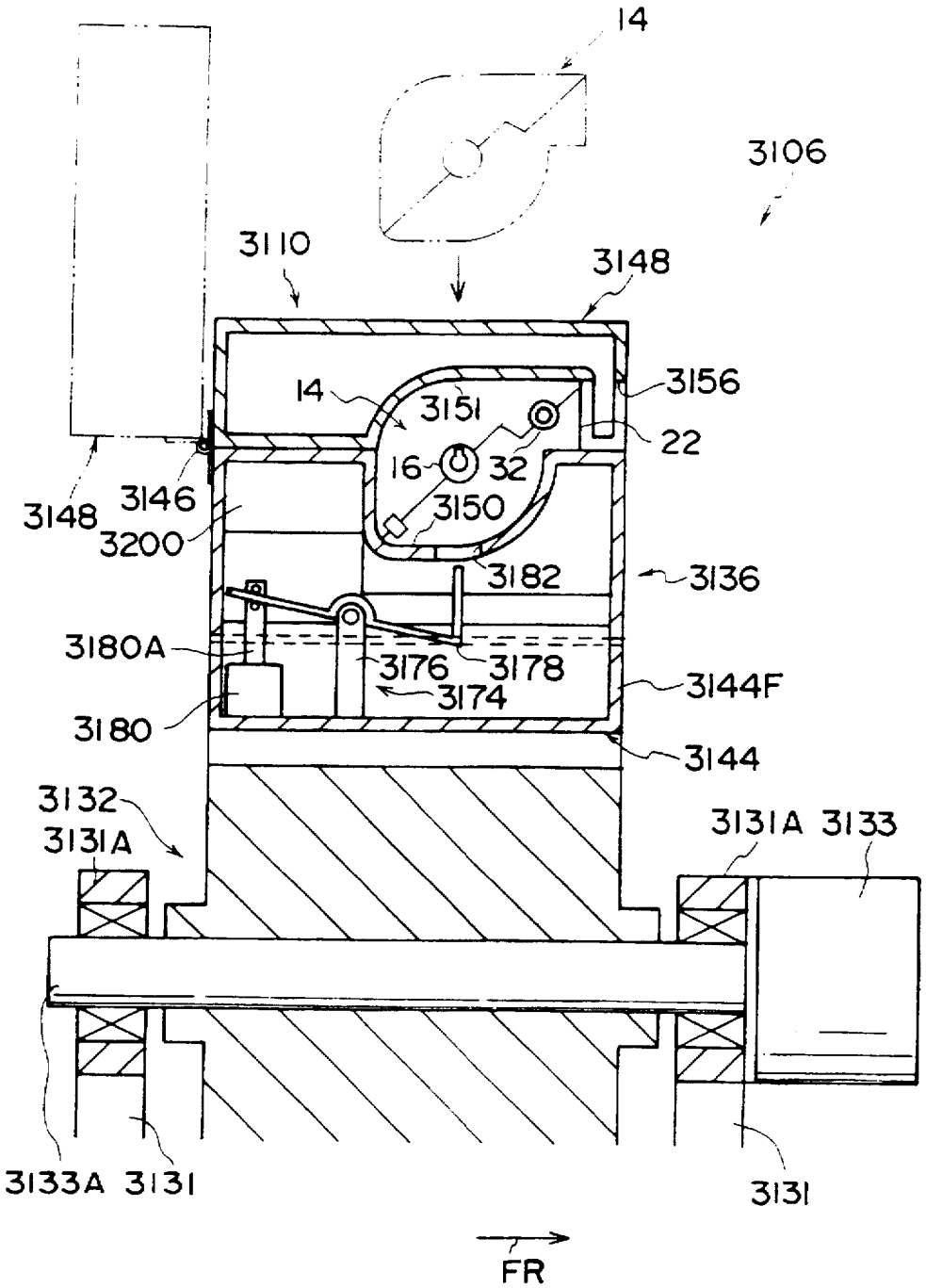
FIG. 62 is a cross-sectional view showing a side face of an accommodating magazine.
Figure 63:
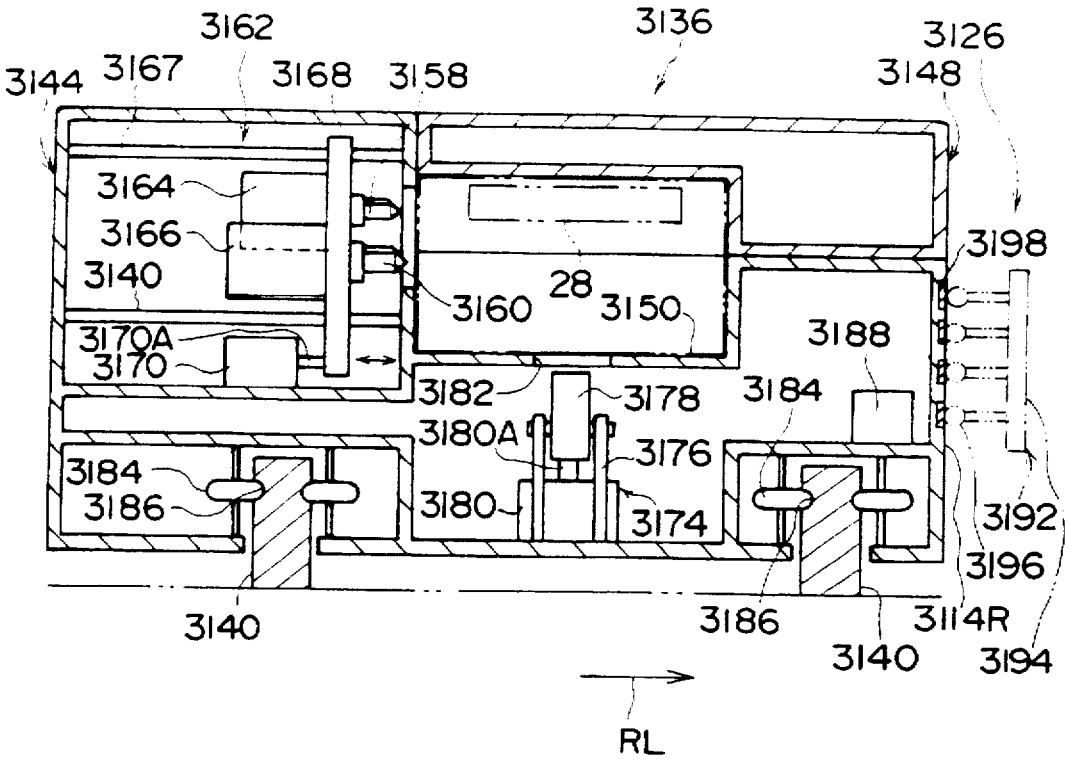
FIG. 63 is a cross-sectional view showing a front face of the accommodating magazine.

At first description is made for configuration of the accommodating magazine 3136 with reference to FIG. 62 and FIG. 63. The accommodating magazine 3136 has a form like a box, and a cover 3148 is attached to a basic body 3144 thereof so that it can freely be opened or closed.

A recessed section for loading the cartridge 14 therein is provided at a substantially central position of the upper section of the basic body 3144. The recessed section 3150 has a form which allows insertion of a lower edge of the projecting section 22 of the cartridge 14.

On the other hand, a recessed section 3151 is formed at a position opposite to the recessed section 3150 of the basic body 3144 in the inner side from the cover 3148. This recessed section has a form which allows insertion of an upper half section of the projecting section 22 of the cartridge 14. With this feature, the cove can be closed only when the cartridge 14 is inserted in the correct orientation, and if the cartridge 14 is inserted in the reverse orientation, the cover 3148 can not be closed.

Also the cover 3148 has a lacked portion 3156 provided in the front side, which allows for the film FI to be inserted into or taken out from the accommodated cartridge 14.

As shown in FIG. 63, provided in the basic body 3144 is a chucking device 3162 having a door driver 3158 for opening or closing a door of the cartridge 14 in the left side from the arrow mark on the cover 3148 and a spool driver for rotating the spool shaft 16.

The door driver 3158 and spool driver 3160 are rotated by motors 3164 and 3166 respectively, and a key (projection) engaging in a key hole is formed on a side face of the shaft. The motors 3164 and 3166 are mounted on a slide block 3168 supported so that it can move along a pair of guide rails 3167 attached to the basic body 3144. It should be noted that the slide block 3168 slides along the axial direction of the spool shaft 16.

A movable iron core 170A of the solenoid 3170 attached to the basic body 3144 is jointed to the slide block 3168, and usually, as shown in FIG. 63, the door drive 3158 and spool driver 3160 are saved at positions away by a specified range from the cartridge 14 as shown in FIG. 63.

When electric power is supplied to the solenoid 3170, the movable iron code 3170A moves by a specified range toward the cartridge 14, tips of the door driver 3158 and spool driver 3160 thrust out from the opening 3172 of the basic body 3144, and the door driver 3158 engages in the key hole 34 of the door shaft 32, while the spool driver 3160 engages in the key hole 62 of the spool shaft 16.

Provided inside the bottom section of the basic body 3144 is an extruding device 3174 for extruding the cartridge 14 from the recessed section 3150.

As shown in FIG. 62 and FIG. 63, the extruding device 3174 has a lever 3178 swingingly supported by a column 3176 provided in the bottom section in the erect posture. A movable iron core 3180A of the solenoid 3180 is jointed to an edge of the lever 3178, and when the movable iron core moves downward, the edge of the lever 3178 thrusts out from a hole 3182 formed on a bottom of the recessed section 3150 to push the cartridge 14.

Also as shown in FIG. 63, the basic body 3144 has a plurality of guide rollers 3184 which can rotate freely, and these guide rollers 3184 engage a groove 3186 formed on a side face of the guide rail 3185 provided inside the basic body 3144 to hold the guide rail 3185. It should be noted that, of the plurality of guide rollers 3184, one is rotated by the motor 3188, and when the motor 3188 starts rotation, the accommodating magazine 3136 can run along the guide rail 3140. It should be noted that a photo-interrupter not shown is attached to the external side of the bottom section of the basic body 3144.

As indicated by the imaginary line in FIG. 63, in the magazine carrier 3126, a power line 3192 for transmitting a control signal and a driving power to the accommodating magazine 3136 is provided along the guide rail 3140. On the power line 3192, four pieces of contactor 3196 are provided at a specified space from each other on a plate-formed member 3194 comprising an insulating body, and two of them are used for signal transmission, while the remaining two are used for power transmission.

It should be noted that a conducting wire 3196 always contacting the contactor 3196 is provided in the embedded state on a side plate 3144R opposite to the contactor 3196 in the basic body 3144 of the accommodating magazine 3136.

This contactor 3196 is connected to an auxiliary control unit 3200 (Refer to FIG. 62) provided inside the basic body 3144. This auxiliary control unit 3200 receives control signals from the main control unit 3202 (Refer to FIG. 61) provided inside the casing 3102 for the processor 3100 via the conducting wire 3196 and contactor 3198. An ID number of the accommodating magazine 3136 is stored in a memory of the auxiliary control unit 3200.

Also provided inside the drum 3132 is a power line (not shown) like the power line 3192, and when the drum 3132 rotates and the power line not shown in the figure is moved to a position opposite and connected to the power line 3192, the motor 3188 starts rotating and the magazine 3136 runs. The solenoid 3170, solenoid 3180, motor 3164, motor 3166, and motor 3188 each provided inside the accommodating magazine 3136 are controlled by the auxiliary control unit 3200. Further the photo-interrupter described above is connected to the auxiliary control unit 3200 and is used to stop the accommodating magazine 3136.

Figure 60:
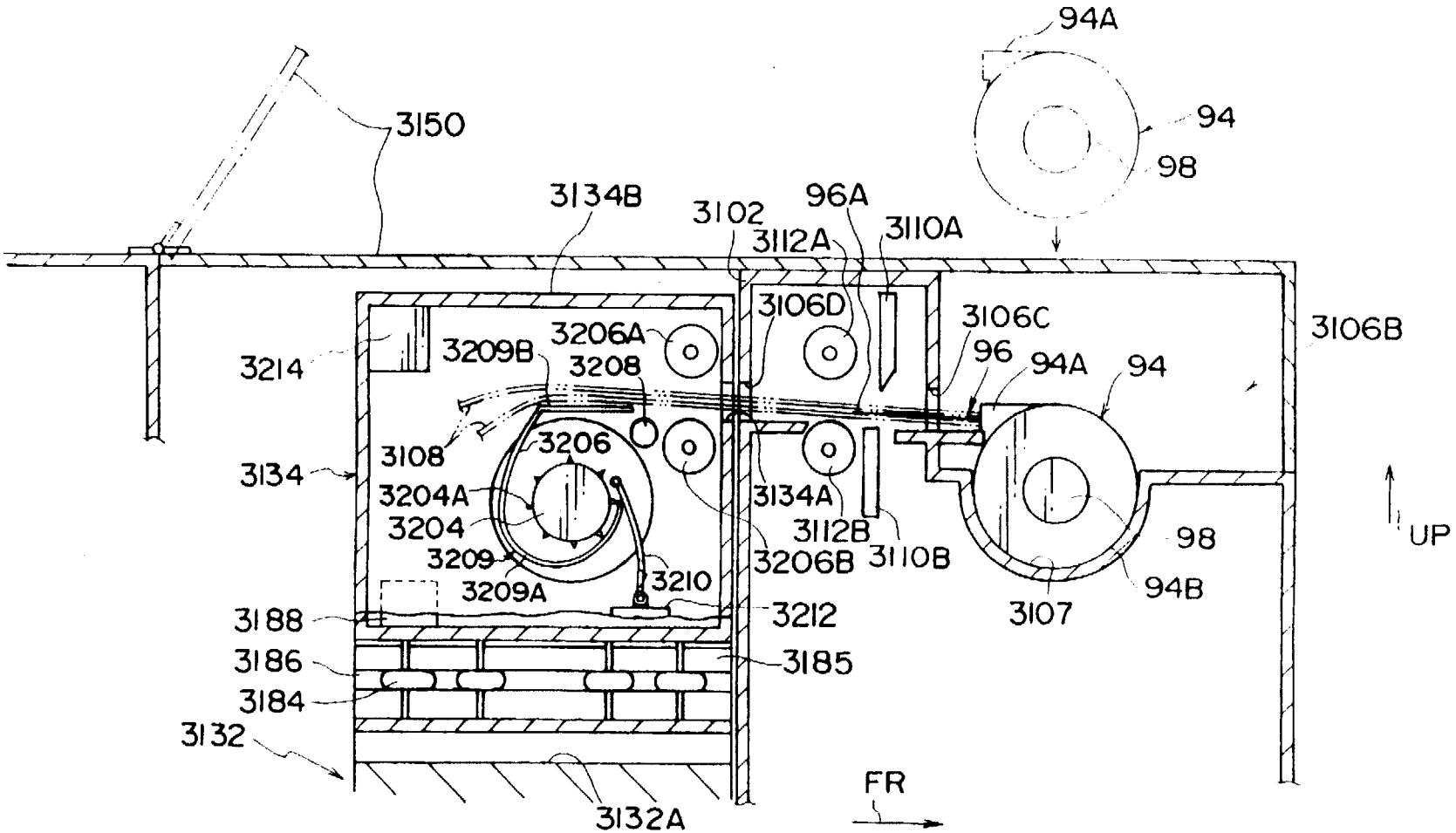
FIG. 60 is a cross-sectional view showing a key section of a container loading section of the processor.
Figure 64:
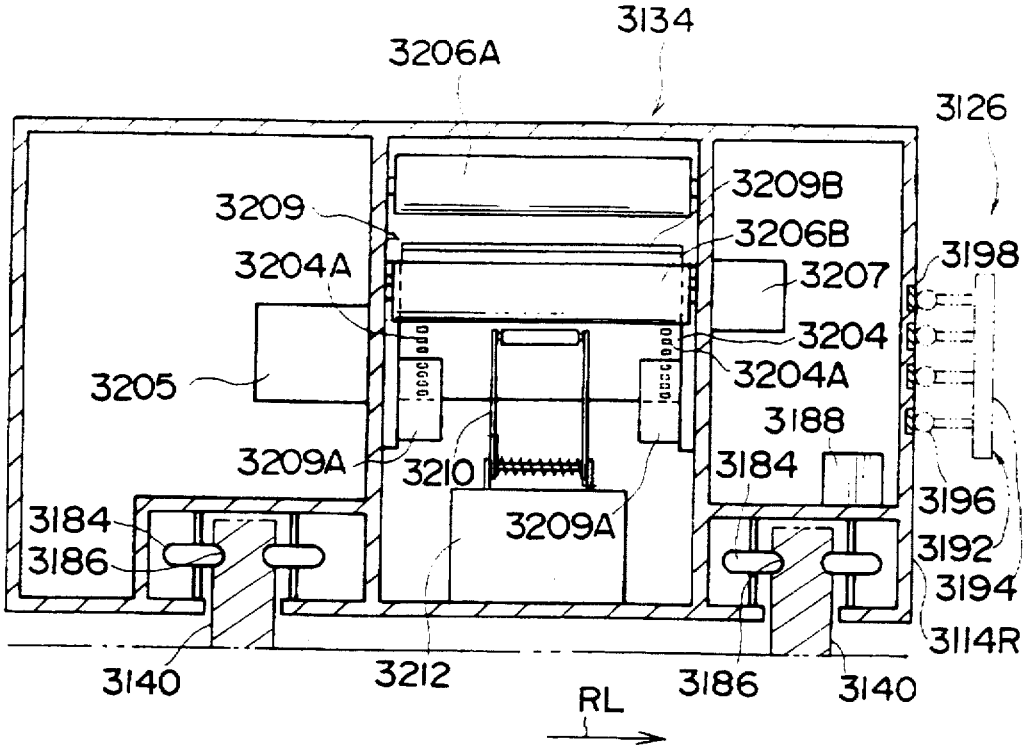
FIG. 64 is a cross-sectional view showing a front side of an intermediate magazine.

Next description is made for configuration of the intermediate magazine 3134 with reference to FIG. 60 and FIG. 64. It should be noted that the same reference numerals are assigned to the same components as those in the accommodating magazine 3136 and detailed description thereof is omitted herein. As shown in FIG. 60, an intermediate spool shaft 3204 is rotatably provided at a substantially central position of the intermediate magazine 3134, and projections 3204A each having a V-shaped cross-section for engagement with perforation not shown are formed at both edges in its lateral direction of the intermediate spool shaft 3204.

Figure 73:
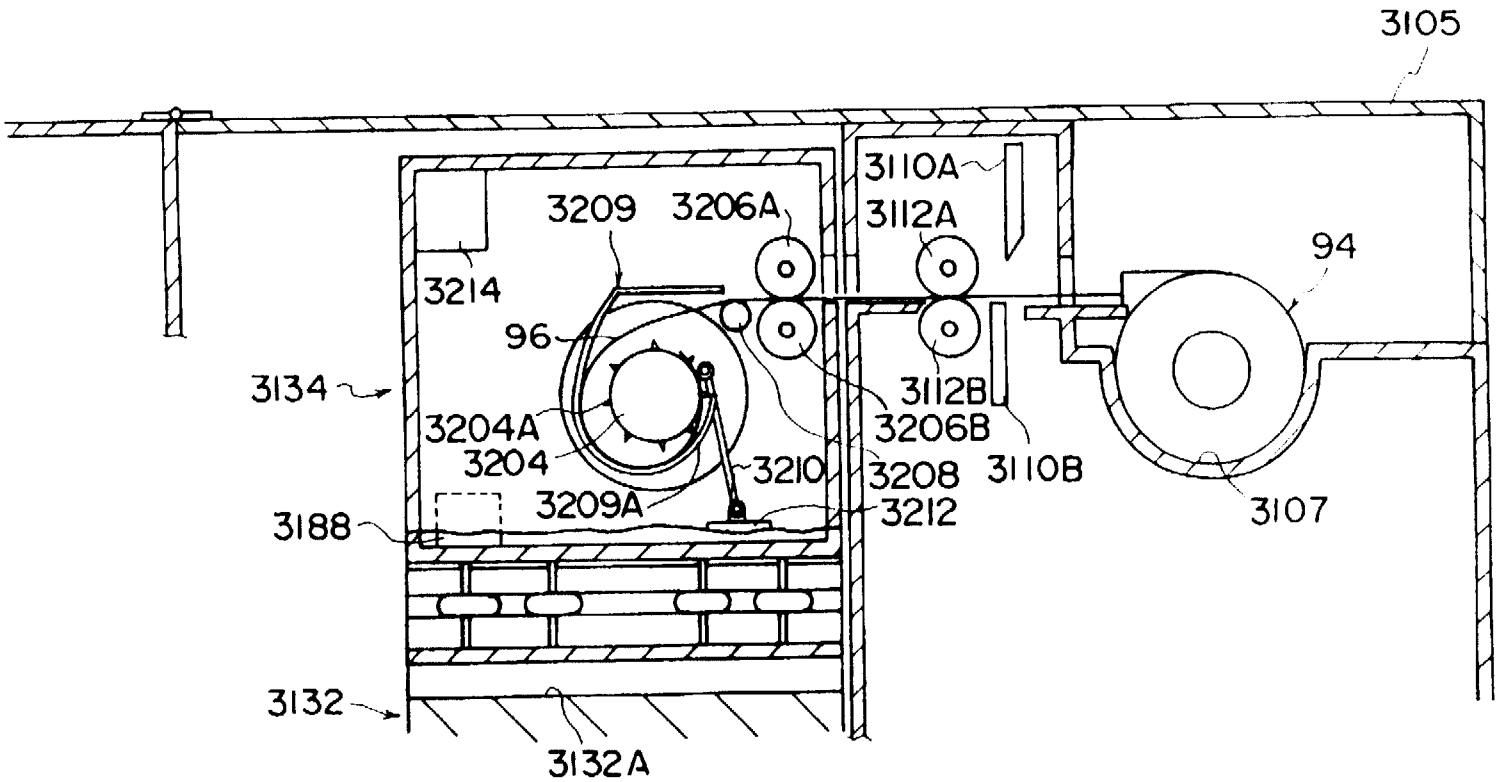
FIG. 73 is a cross-sectional view showing the state where a film is wound around an intermediate spool shaft.

As shown in FIG. 64, a motor 3205 is jointed to the intermediate spool shaft 3204, and when the motor 3205 rotates in the regular or reverse direction, the intermediate spool shaft 3204 rotates in the regular or reverse direction. For instance, as shown in FIG. 73, after the projecting sections 3204A are engaged with perforation of the film 96, the intermediate spool shaft 3204 starts rotating.

In the intermediate magazine 3134, an opening 3106A is provided at a position opposite to the opening 3106D. This opening 3134A opposes to the opening 3106D, and film 96 is inserted or taken out therethrough. Also a pair of guide rollers 3206A, 3206B are provided at a position opposite to the opening 3134A. As shown in FIG. 64, the motor 3207 is jointed to the guide roller 3206B, and when the motor 3207 rotates in the regular or reverse direction, the guide roller 3206B rotates in the regular or reverse direction.

Further the guide roller 3206A in the side of external peripheral surface 3134B of the intermediate magazine 3134 can move up and down, and the guide roller 3206A is saved as shown in FIG. 60 when the film 96 is wound or withdrawn.

As shown in FIG. 60, a pair of withdrawing members 3108 constituting a portion of a withdrawing device (as disclosed, for instance, in Japanese Patent laid Open Publication No. 2229/1980) are movably provided inside the intermediate magazine 3134. The withdrawing members 3108A, 3108B are made from an elastic material, and are inserted via the openings 3134A, 3106D, and 3106C from the outlet/inlet port 94A of the cartridge 94 into the cartridge 94 to hold the film 96 inside the cartridge 94. Then, by pulling the withdrawing members 3108A, 3108B from the cartridge 94, the film 96 is withdrawn from the cartridge 94.

Base edges of the withdrawing members 3108A, 3108B are fixed to a rotor not shown, and the rotor rotates in the regular or reverse direction in association with rotation of a motor (not shown) to pull out or pull in the withdrawing members 3018A, 3108B.

Provided inside the intermediate magazine 3134 is a guide member 3209 made from an elastic material and formed into a peripheral form surrounding the intermediate spool shaft 3204. A tip section 3209A of this guide member 3209 forks off in to two, as shown in FIG. 64, toward both sides of the intermediate spool shaft 3204.

A base section 3209B of the guide member 3209 has a linear (horizontal form) facing the opening 3134A and guides the withdrawing member 3108A to the opening 3134. Also a guide roller 3208 is rotatably provided at the back of the guide roller 3206B.

Further a film holding member 3210 for having the film 96 engaged with perforation of the intermediate spool shaft 3204 without fail is provided in the intermediate magazine 3134, and this film holding member 3210 is connected to the solenoid 3212. This solenoid 3212 is connected to the auxiliary control unit 3214 (Refer to FIG. 60), and the film holding member 3210 rotates in the regular or reverse direction according to a control signal from the auxiliary control unit 3214.

It should be noted that other components of the intermediate magazine (guide roller 3184, guide rail 3185, motor 3188, and others) are the same as those of the accommodating magazine 3136 and detailed description thereof is omitted herein.

(Development processing section)

As shown in FIG. 61, a development processing section has a processing tank 3300 made from synthetic resin or the like and having a from like a sheath of a sword. This processing tank 3300 is slightly inclined against the vertical direction, and a film insertion port 3304 with the upper edge opened.

Figure 65:
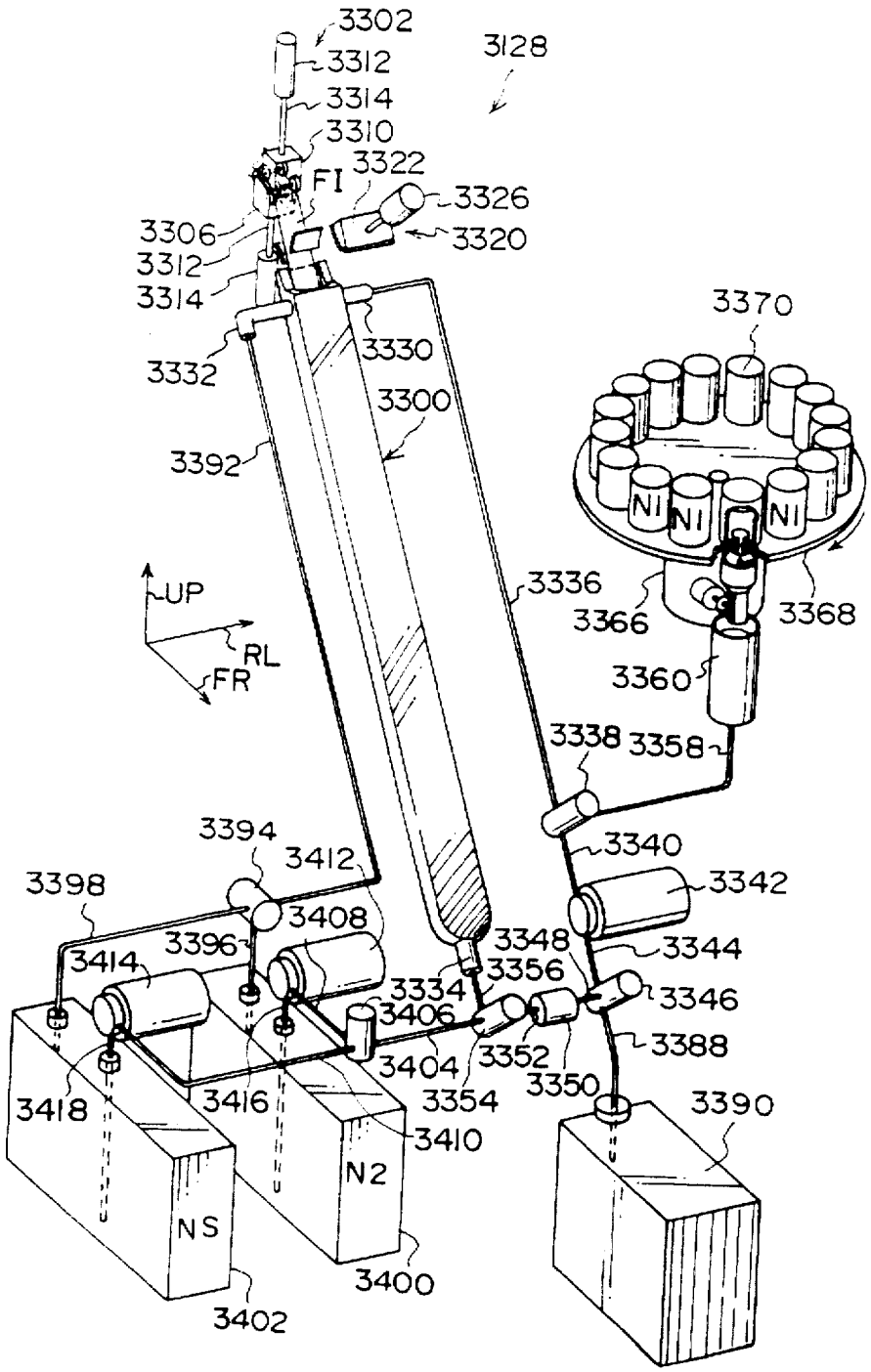
FIG. 65 is a perspective view showing a developing section.
Figure 70:
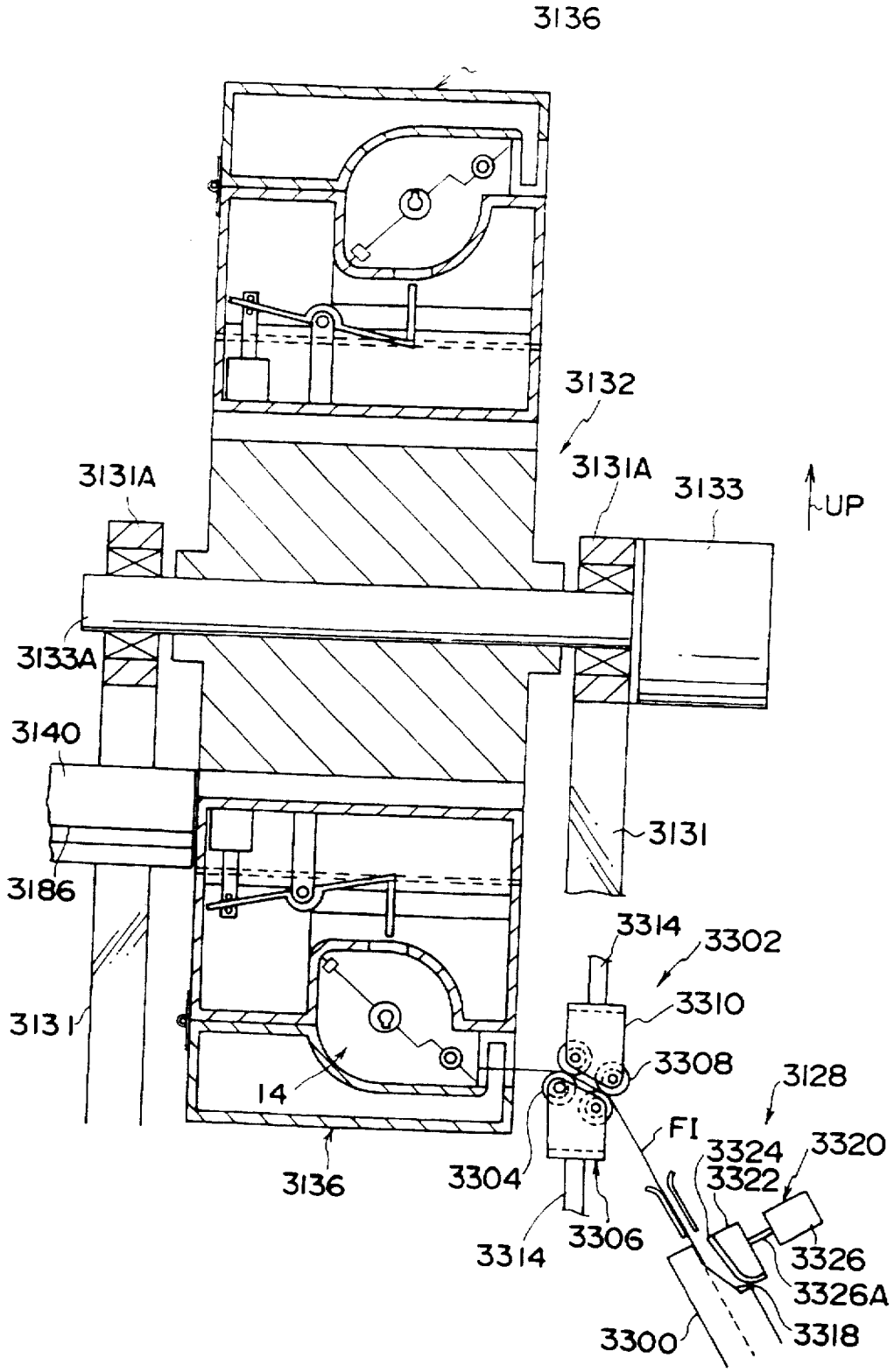
FIG. 70 is a cross-sectional view showing the state where a film is fed out into a processing tank.

As shown in FIG. 65 and FIG. 70, a movable film guide 3302 as a pair of pulling unit for guiding the film 96 or FI are provided at the back of the processing tank 3300. The movable film 3302 comprises a lower guide 3306 having a pair of rollers 3304 for guiding a bottom surface of the film FI and a air of rollers 3308 for guiding an upper surface of the film FI, and the lower guide 3306 and upper guide 3310 are attached to cylinder rods 3314 of the cylinder 3312 provided in the vertical posture.

As shown in FIG. 70, the rollers 3304 and 3308 hold the film FI fed out in the horizontal direction from the cartridge 14 therebetween and guides the film FI to an opening of the processing tank 3300. It should be noted that, when the accommodating magazine 3136 moves, the cylinder 3312 is operated to save the lower guide 3306 and upper guide 3310.

Figure 66:
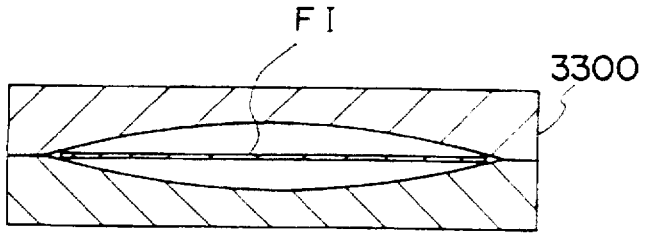
FIG. 66 is a cross-sectional view showing a processing tank viewed from the longitudinal direction thereof.

A form of a cross-section in the longitudinal direction of the tank 3300 is as shown in FIG. 66, and a space between the internal wall faces opposite to each other is narrow at both sides in its lateral direction (in the section opposite to both edge sections of the film FI in its lateral direction) and wide at a central portion thereof (section opposite to an image frame of the film FI).

For this reason, when the film FI is inserted from the opening, the both edge sections of the film FI in its lateral direction are guided by the both internal side sections of the processing tank 3300 in its lateral section, and a central portion of the film FI in its lateral direction, namely an image frames thereof are prevented from contacting the internal wall face of the processing tank 3300. It should be noted that a form of the processing tank 3300 is not limited to a linear and sheath-shaped form, and for instance, a U-shaped form is allowable.

(Sealing device)

Figure 67:
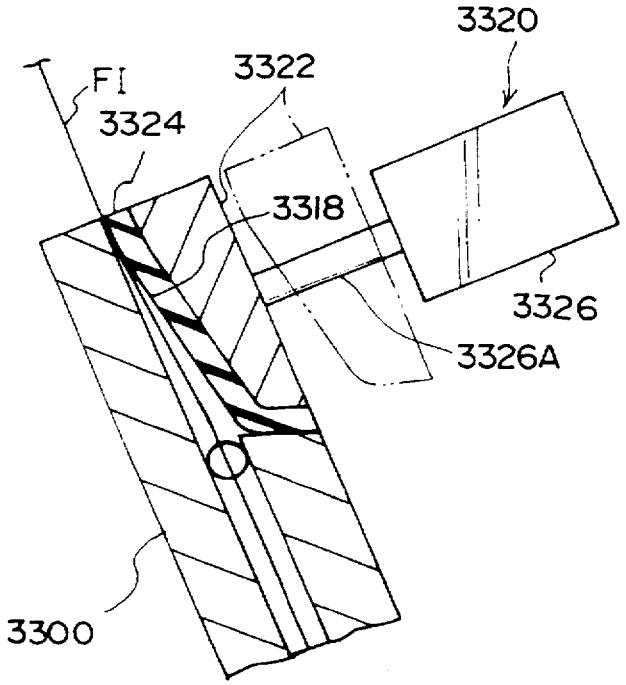
FIG. 67 is a cross-sectional view showing a side face of the processing tank shielded with a shielding device.

As shown in FIG. 67, a sealing device 3320 is provided at a position opposite to the film insertion port 3304. The sealing device 3320 has a film insertion port 3318 and an adhering block 3322. A thick packing 3324 made from an elastic material such as rubber is adhered to a section adhering to the film insertion port 3318.

This block 3322 is linked to the movable iron core 3326A of the solenoid 3326, and when an current flows through the solenoid 3326, the movable iron core 3326A presses the block 3322 to the insertion port 3318 to seal up inside of the tank. Namely the block 3322 moves from the position indicated by the imaginary line in FIG. 67 to the position indicated by the solid line in FIG. 67.

(Circulation path of a processing solution)

As shown in FIG. 65, a pipe-shaped connecting section 3330 communicating to inside of the processing tank is provided at a position near the upper section of the processing tank in one side in the lateral direction thereof, and also a pipe-shaped connecting section 3332 communicating to inside of the processing tank is provided in the other side in the lateral direction thereof. Further s pipe-shaped connecting section 3334 communicating to inside of the processing tank is provided also at a lower edge section of the processing tank 3300. The connecting section 3330 is connected via a piping 3336 extending downward along the processing tank 3300, an electromagnetic valve 3338 (3-port 2-position switching valve), a piping 3340, a pump 3342, a piping 3344, an electromagnetic valve (3-port 2-position switching valve), a piping 3348, an inline ceramic heater 3350, a piping 3352, an electromagnetic valve (3-port 2-position switching valve) 3354, and a piping 3356 to the connecting section 3334.

One edge of the piping 3358 is connected to the electromagnetic valve 3338, and the other edge of the piping 3358 is connected to a reducer 3360.

Figure 68:
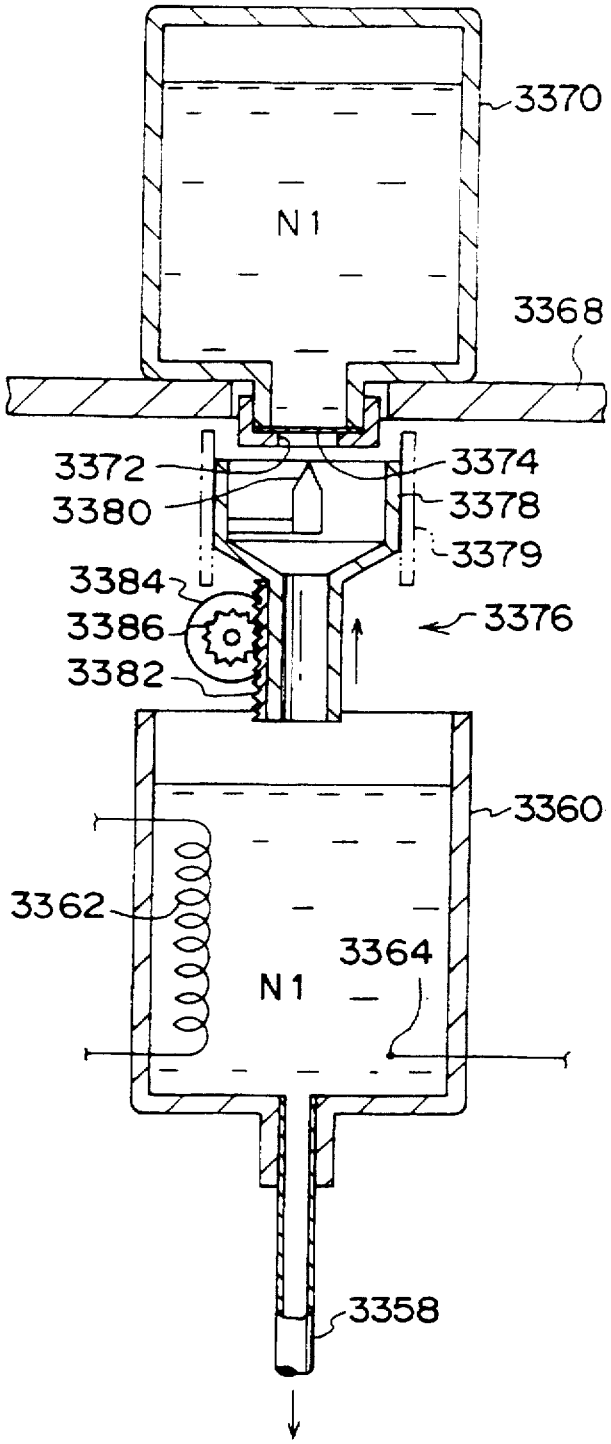
FIG. 68 is a cross-sectional view showing a drilling unit.

As shown in FIG. 68, the reducer 3360 is a cupshaped tank with a specified capacity (a capacity sufficient for temporally storing therein a color development solution for developing 11 strings of film FI), and has a heater 3362 for heating the stored color development solution to a specified temperature and a temperature sensor 3364. It should be noted that the heater 3362 and the temperature sensor 3364 is connected to the main control unit 3202 (not shown in FIG. 68).

As shown in FIG. 65, a disk-shaped turn table 3368 rotated by a motor 3366 is provided above the reducer 3360. A plurality of bottles 3370 each in the upside-down posture are provided along a peripheral direction of the turn table 3368.

As shown in FIG. 68, a color-development solution is stored in the bottles 3370 by a quantity required for developing 11 strings of film FI. An exit/entrance port of each bottle 3370 is clogged with a thin film 3374, and the color development solution can be taken out by breaking this thin film 3374.

A punching device 3376 is provided between the reducer 3360 and turn table 3368. The punching device 3376 has a funnel 3378, and a projection 3380 for punching the film 3374 on the bottle 3370 is provided at a central portion of the funnel 3378.

The funnel 3378 is supported by a guide member 3379 fixed to a frame not shown so that it can move in the vertical direction. A rack 3382 is formed on a side face of the funnel 3378, and a gear 3386 rotated by a motor 3384 is engaged with the rack 3382.

When the gear 3386 rotates and the funnel 3378 moves upward by a specified range, the projection 3380 punches the film 3374, and the coupling-development solution stored in the bottle 3370 is discharged via the funnel 3378 into the reducer 3360. It should be noted that the motor 3366 and motor 3384 is controlled by the main control unit 3203 (not shown in FIG. 68).

As shown in FIG. 65, one edge of the piping 3388 is connected to the electromagnetic valve 3346, and the edge of the piping 3388 is inserted into a discharged solution tank 3390 for storing therein a used coupling-development solution.

On the other hand, one edge of the piping 3392 extending downward along the processing tank 3300 is connected to the connecting section 3332, and the other edge of the piping 3392 is connected to the electromagnetic port (3-port 2-position switching valve) 3394.

One edge of the piping 3396 and also one edge of the piping 3398 are connected to this electromagnetic valve 3394, and the other edge of the piping 3396 is inserted into a bleaching/fixing solution tank 3400 with a bleaching/fixing tank stored therein, while the other edge of the piping 3398 is inserted into a rinsing solution tank 3402 with a rinsing solution stored therein.

Also one edge of the piping 3404 is connected to the electromagnetic valve 3354, and the other edge of the piping 3404 is connected to the electromagnetic valve (3-port 2-position switching valve) 3406.

One edge of the piping 3408 and one edge of the piping 3410 are connected to the electromagnetic valve 3406, and the other edge of the piping 3408 is connected to one connection port of the pump 3412, while the other edge of the piping 3410 is connected to one connection port of the pump 3414.

It should be noted that the piping 3416 for sucking the bleaching/fixing solution in the bleaching/fixing solution tank 3400 is connected to the other connection port of the pump 3412, and the piping 3418 for sucking the rinsing solution in the rinsing solution tank 3402 is connected to the other connection port of the pump 3414.

(Drying section)

As shown in FIG. 61, a drying section for drying the film FI which has already developed is provided at the back of the processing tank 3300, and the drying section 3130 comprises a drying fan 3422. This drying fan 3422 is provided at the back of the drum 3132, blows a drying air (hot air) to the film FI to dry the film FI.

(Image reading section)

Figure 71:
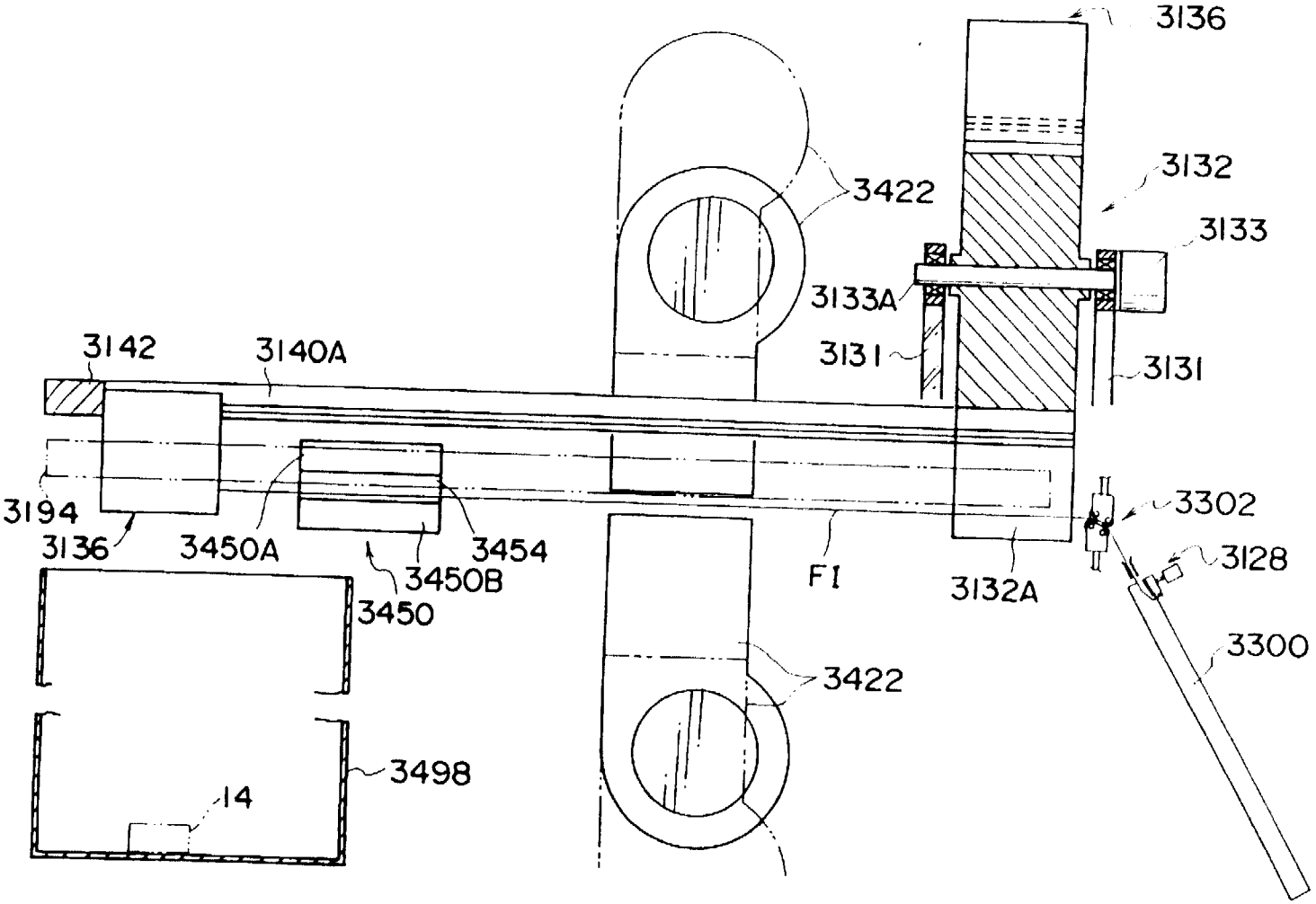
FIG. 71 is a cross-sectional view showing the state where the international magazine ran spontaneously.
Figure 72:
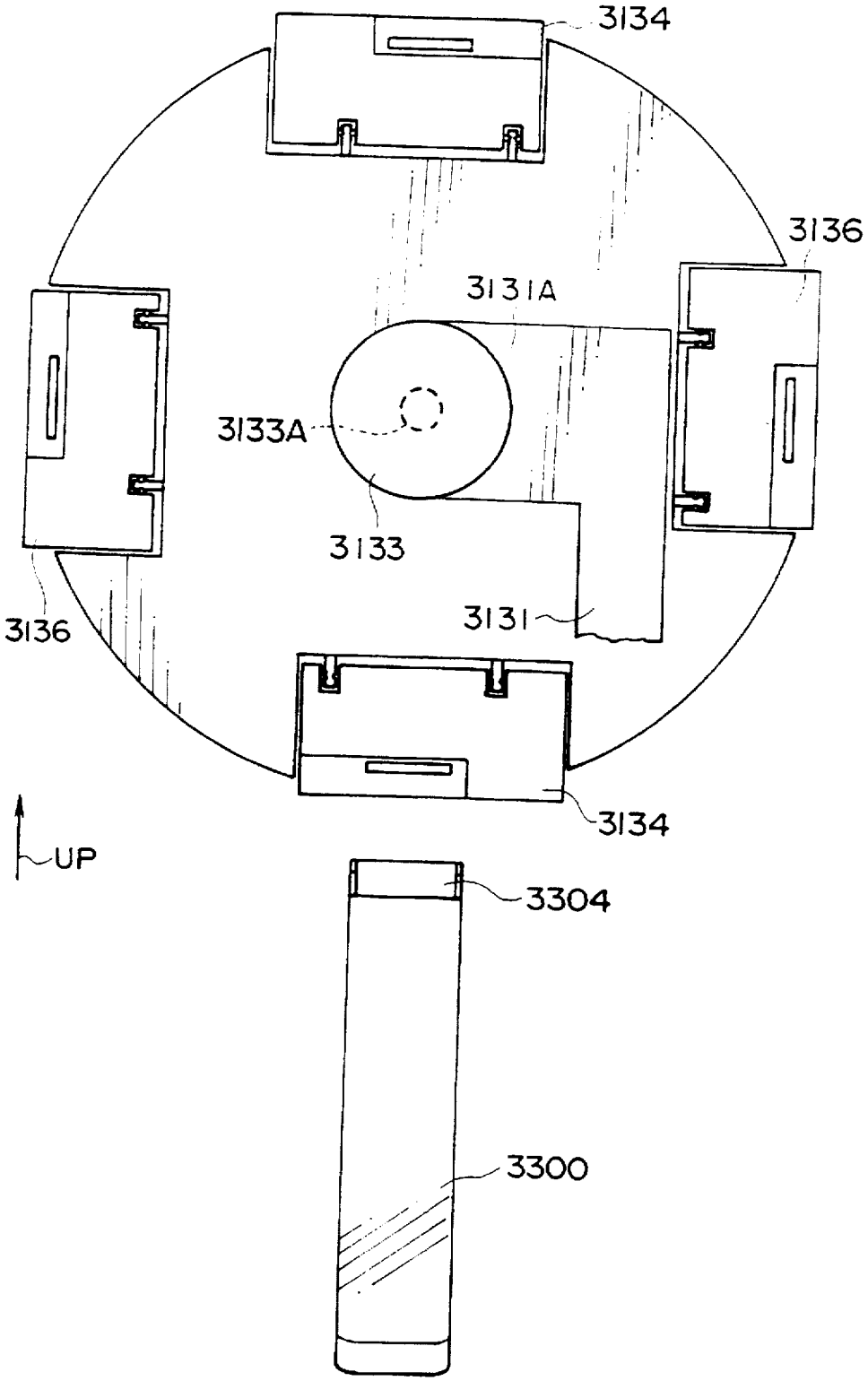
FIG. 72 is a front view showing the state where the drum has been rotated.

An image reading section 3132 is provided at the back of the drying section 3130. The image reading section 3132 comprises a reading unit 3450 having a substantially U-shaped cross-section for retaining the film FI in the flat state. This reading unit is attached to a cylinder rod 3452A of the cylinder provided in the horizontal posture, and moves in the lateral direction of the film FI. It should be noted that, as shown in FIG. 71, a slit 3454 for insertion of the film FI is provided on a side face of the reading unit 3450. A light source not shown is provided in the upper section 3450A of the reading unit 3450, and a CCD not shown is provided in the lower section 3450B of the reading unit 3450. The CCD receives light transmitted through the film FI (or film 96) and outputs as image data to the main control unit 3202. The image data supplied to the main control unit 3202 is output to a printer device not shown herein, and is subjected to printing by a printer.

Namely, in this embodiment, image data read by the reading unit 3450 is printed out by a separate printer, so that the exposure processing or printing process for the wound-back film FI or developed film 96 are not required.

A container carrier 3138 driven by a motor now shown is provided at the back of and under the reading unit 3450. A plurality of baskets 3498 are attached to an endless belt for this container carrier 3138. It should be noted that right and left edge sections of the container carrier are located in the side inner from the automatic door 3124 described above (Refer to FIG. 59)

The cartridge 14 or the film 96 dropped from the accommodating magazine 3136 is received via a duct 500 into a specified basket 3498. And the cartridge 14 or the film 96 is taken out from an opening 3498B formed on an external peripheral surface (a surface in the side contrary to the endless belt 3496) of the basket 3498.

(Operation)

Next description is made for actions in this embodiment.

At first description is made for a case where the APS film FI is to be developed. A user operates a select button on the operating device 3115 to set the accommodating magazine 3136 at a position opposite to the loading port 3106A. Namely the accommodating magazine 3136 is set in the state shown in FIG. 69.

The customer set the cover 3105 in the open state (the state shown in FIG. 59), and set the cartridge 14 with a film IF which has not developed stored therein in the recessed section 3150 of the empty magazine 3136, and closes the covers 3148 and 3105.

When the cartridge is loaded, the bar code on the cartridge 14 is read by a bar code scanner not shown herein, the main control unit 3203 determines the number of image films on the film FI, computes a development fee and a printing fee, and displays the total charge on the display unit 3114.

It should be noted that a time required printing or a time when the finished print is delivered to the customer is displayed on the display unit 3112 provided at the side of the accommodating magazine 3136 with the cartridge 14 loaded therein.

When a customer put in a sum of money displayed in the display unit 3114 from the fee paying section 3104, an ID card 3118 is issued from the ID card exit/entrance port 3120 (It should be noted that change is returned to the receiving tray 3116).

ID card includes such data (printed data or magnetic data) as a receipt number, a receipt time, a time of delivery, an ID number of the accommodating magazine 3136 with the cartridge 14 loaded therein, an ID number of the cartridge 14, or the number of photographed images recorded thereon.

Figure 69:
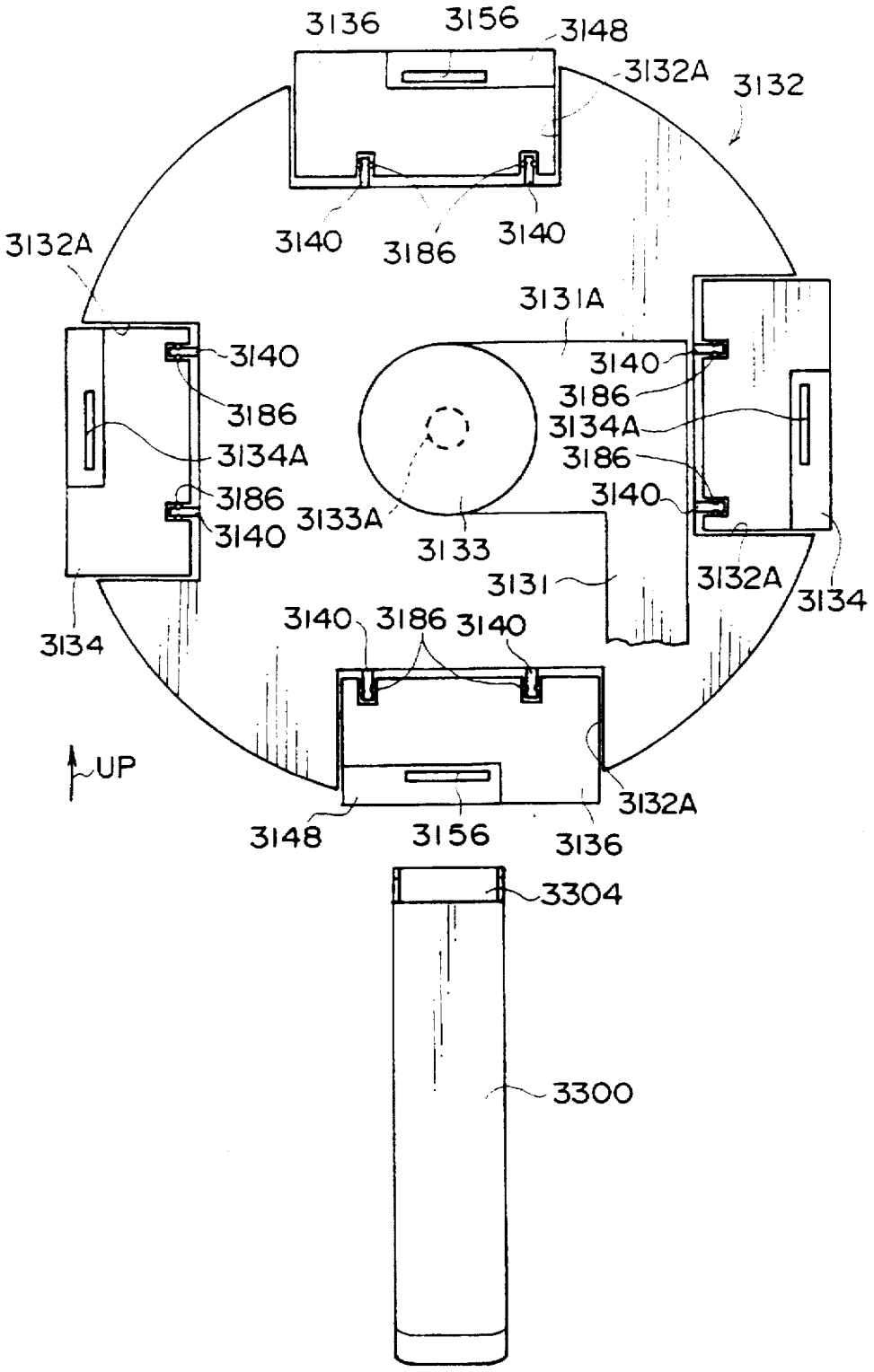
FIG. 69 is a front view showing a drum.

The customer operates a start button on the operating unit 3115, the drum 3132 rotates by 180 degrees (from the upper edge to the lower edge), and the accommodating magazine 3136 with the cartridge 14 loaded therein stops at a specified position in the developing section 3128 (the position shown in FIG. 69 and FIG. 70).

When rotation of the drum 3132 is stopped, the chucking device 3162 is actuated, and the driver 3158 is engaged in a key hole not shown in the figure, and the spool driver 3160 in a key hole (not shown) of the spool shaft 16.

Then the cylinder 3312 is driven, the lower guide 3306 and upper guide 3310 got closer to each other, so that it becomes possible to guide the film FI to the processing tank 3300 with the rollers 3304 and 3308.

Then, in the accommodating magazine 3136, the motor 3164 starts rotating with the door opened, and the spool driver 3160 is rotated with a tip of the film FI fed out from the insertion port 28 of the cartridge 14.

The film FI fed out from the cartridge 14 passes between the rollers 3304 and 3308 of the lower and upper guides 3306 and 3310 and is inserted from the opening of the processing tank 3300 into inside of the processing tank 3300. It should be noted that, when the film FI is inserted into the processing tank 3300, the block 3322 of the sealing device 3320 is away by a specified range from the film insertion port 3318, and when the film FI has completely been inserted into the processing tank 3300, the block 3322 presses the film insertion port 3318 to seal inside of the processing tank.

Next description is made for the processing for developing the film FI.

One bottle of color-development solution is prepared in the reducer 3360, and is heated up to a specified temperature (450° C. in this embodiment) by the heater 3362.

When the processing tank is sealed, the pump 3342 is driven, and the color-development solution stored in the reducer is supplied for the piping 3358, electromagnetic valve 3338, piping 3340, pump 3342, piping 3344, electromagnetic valve 3346, piping 3348, inline ceramic heater, piping 3352, electromagnetic valve 3354, and piping 3356 to the processing tank 3300.

When the color-development solution in the reducer 3360 is completely discharged, the electromagnetic valve is switched, and the color-development solution in the tank is circulated through the piping 3338, electromagnetic valve 3338, piping 3340, pump 3342, piping 3344, electromagnetic valve 3346, piping 3348, inline ceramic heater 3350, piping 3352, electromagnetic valve 3354, and piping 3356. With this operation, color development of the film FI is carried out. It should be noted that temperature of the color-development solution is kept constant by the inline ceramic heater 3350 to prevent temperature of the color-development solution from dropping during circulation. When the color-development solution is circulating in the tank, the turn table 3368 rotates by a specified angle with a new bottle positioned above the punching device 3376, and then the punching device 3376 operates and a color-development solution in the bottle 3370 is poured into the reducer 3360. This color-development solution is used for processing the next film FI.

When the processing for development of the film IF is finished within a specified period of time, the pump 3342 stops with the electromagnetic valve 3346 switched, and the color-development solution in the tank as well as in the piping is discharged via the piping 3388 to the discharged solution tank 3390.

When the specified period of time has passed and the color-development solution has completely been discharged, the electromagnetic valve 3354 is switched with the pump 3412 driven, and bleaching/fixing solution in the bleaching/fixing solution tank 3400 is supplied via a piping 3416, a pump 3412, a piping 3408, an electromagnetic valve 3406, a piping 3404,an electromagnetic valve 3354, and a piping 3356 to the processing tank 3300, and further the bleaching/fixing solution in the tank is returned and circulated via a piping 3392, an electromagnetic valve 3394, and a piping 3396 to the bleaching/fixing solution tank 3400. With the operations described above, the film FI is bleached and fixed.

When a specified period of time has passed and the processing for beaching and fixing the film FI is over, the pump rotates in the reverse direction with the bleaching/fixing solution in the tank as well as in the piping returned to the bleaching/fixing solution tank 3400. It should be noted that the solution in the piping 3392, electromagnetic valve 3394, and piping 3396 drops due to gravity.

When a specified period of time has passed and the bleaching/fixing solution is returned to the bleaching/fixing solution tank 3400, the pump 3412 stops with the electromagnetic valves 3406, 3394 switched and also with the pump 3414 driven, and the rinsing solution in the rinsing solution tank 3402 is supplied via the piping 3418, the pump 3414, the piping 3410, the electromagnetic valve 3400, the piping 3404, the electromagnetic valve 3354, and the piping 3356 to the processing tank 3300, and further the rinsing solution in the tank is returned and circulated through the piping 3392, an electromagnetic valve 3394, and the piping 3398 to the rinsing solution tank 3402. With the operations above, the film FI is rinsed.

When a specified period of time has passed and the processing for rinsing the film FI is finished, the pump 3414 rotates in the reverse direction, and the rinsing solution in the tank as well as in the piping is returned to the rinsing solution tank 3402. It should be noted that the solution in the piping 3392, electromagnetic valve 3394, and piping 3398 drops due to gravity. When a specified period of time has passed and all the rinsing solution in the tank has completely been discharged, the pump 3414 stops with the block 3322 of the sealing device 3320 separated from the film insertion port 3318, and the accommodating magazine retaining the cartridge 14 is removed from the lacked section 3132A of the drum 3132 moves (runs) to the rear side at a constant speed and stops at a stopper 3142 on the rails 3140A, 3140B in the side indicated by the arrow mark B (Refer to FIG. 71).

When the accommodating magazine 3136 moves, the processed films FI are drawn out from inside of the tank successively, and pass through the drying section 3130, where hot air is blown by a drying fan 3422 to a surface of the film FI.

When the accommodating magazine 3136 stops, the film FI is wound up, and when a first image frame in the cartridge 14 is located at a position opposite to an opening of the reading unit 3450, transfer of the film FI is once stopped, and printing is executed by a printer according to image data read by the reading unit 3450. It should be noted that an image frame can be stopped at a position opposite to an opening of the reading unit by detecting perforation of the film FI with a sensor.

When all the image data has been read, the spool driver 3160 is rotated with the film FI wound around the spool shaft 16 of the cartridge 14 and a door not shown is closed. When this door s closed, power supply to the solenoid 3170 is stopped, and tips of the door driver 3158 and spool drive 3160 are separated from the cartridge 14.

At this point of time, as the accommodating magazine 3136 is in the reversed state, the extruding device 317 is operated to open the cover 3148 and have the cartridge dropped into an opening of the duct 500. The cartridge 14 passes through the duct 500 and drops into the basket 3498. Then the accommodating magazine 3136 automatically runs up to the lacked portion 3132 of the drum 3136, and engages the lacked portion 3132A.

When the customer inserts the customer's card 3118 into the ID card inlet/outlet port 3120, the ID card 3118 is verified, and the basket 3498 with the cartridge 14 accommodated therein is moved to inside from the automatic door 3124 with the automatic door 3124 opened, and then the customer can take out the cartridge 14 from the basket 3498.

Next description is made for an operation for developing the 135-size film 96. The customer operates a select button on the operating unit 3115 to locate the intermediate magazine 3134 at a position opposite to the loading port 3106. Namely the intermediate magazine 3134 is set in the state shown in FIG. 72.

Then the customer set the cover 3105 in the open state, load the cartridge 94 with the film 96 not developed yet accommodated therein in the recessed section 3107 of the loading port 3106, and returns the cover 3104 to the closed position. When the customer operates a start button on the operating device 3115, as shown in FIG. 60, the withdrawing member 3018 is inserted into the cartridge 94 with the tongue 96A of the film 96 drawn out.

When the tongue 96A is positioned above the guide roller 3208, only the withdrawing member 3108 in the lower side is rolled up by the rotor not shown with the tongue 96A dropped and contacting the guide roller 3208. Then the guide roller 3206A moves downward with the film 96 held between the guide roller 3206A, 3206B, and the film 96 is wound around the intermediate spool shaft 3204 in association with rotation of the guide rollers 3206A, 3206B.

Namely the film 96 moved up to a position opposite to a tip of the film holding member 3210 being supported by the guide member 3209. Then, as shown in FIG. 73, the film holding member 3210 rotates counterclockwise to hold the film 96, and perforation not shown and formed on the film 96 engages the projection 3204A.

Figure 74:
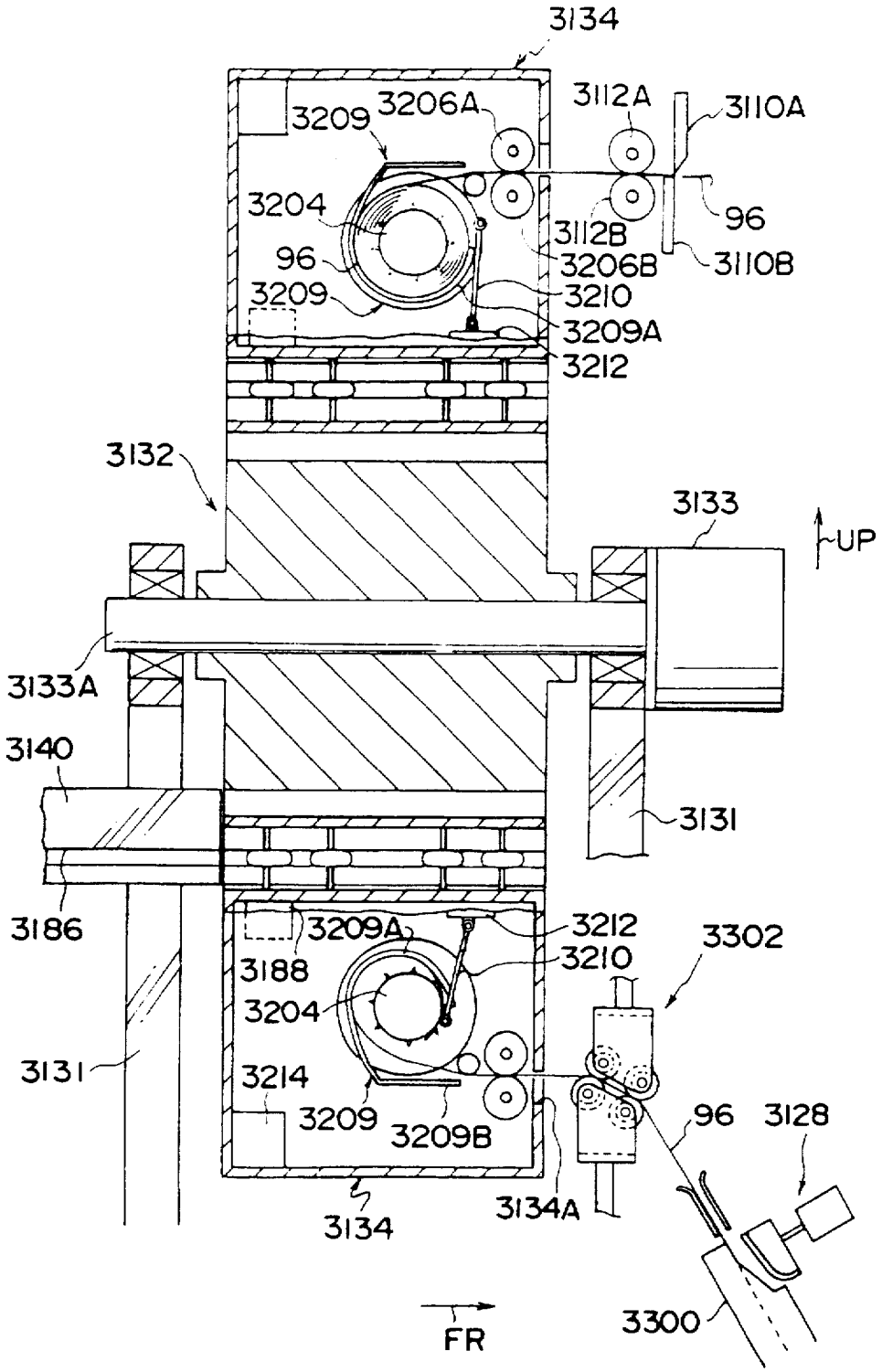
FIG. 74 is a cross-sectional view showing the state where a film is fed into a processing tank.

Then the film holding member 3210 rotates clockwise and is separated from the film 96. And, the intermediate spool shaft 3204 rotates, and when a specified period of time has passed and the film 96 in the cartridge 94 has completely been wound around the intermediate spool shaft 3204, as shown in FIG. 74, the cutter 3110A moves downward to cut the film 96 at the rear edge. When the film 96 is wound around the intermediate spool shaft 3204, the tip section 3209A of the guide member 3209 deforms elastically.

When the cutter 3110A moves down and the film 96 is cut, the cut edge of the film 96 is wound around the intermediate spool shaft 3204 up to a point beyond the opening 3134A of the intermediate magazine 3134. Then the drum 3132 rotates by 180 degrees (from the upper edge to the lower edge), and the intermediate magazine 3134 stops at a specified position on the developing section 3128 (at the position shown in FIG. 72 and FIG. 74).

When rotation of the drum 3132 is stopped, the motor 3205 (Refer to FIG. 64) starts rotating, and the film 96 is fed out from the opening 3134A being guided by the base section 33209B of the guide member 3209. When positioned at the final edge of the film 96, the film holding member 3210 rotates clockwise to hold the final edge of the film 96 (in the locked state), and development processing is executed in this state. Namely, the film 96 is not separated from the intermediate spool shaft 3204, and the film 96 is inserted by a specified length (a length of a range including the final image frame) into the processing tank 3300. It should be noted that timing of operations of the film holding member 3210 and withdrawing member 3109 is detected by a sensor or the like not shown, and is controlled by the auxiliary control unit 3200.

Other operations for developing the film 96 are the same as those in development of the film FI. To have the film 96 dropped into the duct 500, the film holding member 3210 is separated from the film 96 and the intermediate spool shaft 3204 is rotated. Then the film 96 drops via the duct 500 into the basket 3498. Other operations are the same as those when developing the film Fi, so that description thereof is omitted herein.

As described above, in the present embodiment, the intermediate magazine 3134 and accommodating magazine 3136 are provided in the drum 3132, so that both the APS film FI and 135-size film 96 can be developed in the same processing tank, which eliminates the necessity to install separate photosensitive material processing apparatuses and enables cost reduction as well as installation thereof even at a small space.

It should be noted, as shown in FIG. 73, the cartridge 94 may be loaded into the container loading section 3106 of the processor 3100 after the tongue 96A of the film 96 is drawn out with a separated withdrawing member from the cartridge 94 for the 135-size negative film. In this case, for instance, the tongue 96A of the film 96 is located on the roller 3112 and the cover 3105 is closed, when the tongue 96A is held between the roller 3112B and the roller 3112A supported on the cover 3105. When the customer operate the start button provided on the operating unit, the film 96 is wound around the intermediate spool shaft 3204. Namely in this case, it is not required to provide the withdrawing mechanism having the drawing members 3198A, 3108B like those in Embodiment 1 in the magazines 3134 and 3136.

What is claimed is:

1. A photosensitive material processing apparatus comprising:

a loading section for loading therein a film container accommodating a film which is wound from one edge section in the longitudinal section thereof around a spool shaft with the edge section thereof in the longitudinal section separated from the spool shaft for development and also which is returned in the separated state to a customer, said film accommodated therein in the state of being wound around the spool shaft;

a feeding means for feeding the film into the loading section from another edge section of the film wound around the spool shaft and also retaining the film in the state where the former edge section of the film in the longitudinal direction is kept locked in the loading section; and a single processing tank for receiving a portion of the film fed out by the feeding means from the loading section and developing the film with a processing liquid.

2. The photosensitive material according to claim 1 further comprising a processing solution supply unit for circulating, replacing, and discharging a processing solution in the processing tank.

3. The photosensitive material processing apparatus comprising:

a loading section for loading therein a film container accommodating a film which is wound from one edge section in the longitudinal section thereof around a spool shaft with the edge section thereof in the longitudinal section separated from the spool shaft for development and also which is returned in the separated state to the customer, the film accommodated therein in the state of being wound around the spool shaft;

an intermediate spool shaft for retaining one edge section of the film in the longitudinal direction of the film withdrawn from said film container loaded in the loading section and also for winding up the film from the one edge section in the longitudinal direction thereof up to another edge section thereof from said film container;

a cutting unit for cutting the another edge section of the film in the longitudinal direction thereof after the film accommodated in the film container have been wound up around the intermediate spool shaft up to the other edge section of the film in the longitudinal direction thereof;

a feeding means for feeding out the film wound around the intermediate spool shaft from the other edge section of the film in the longitudinal direction thereof and also for retaining the film in the state where the one edge section of the film in the longitudinal direction thereof is locked on said intermediate spool shaft; and a single processing tank for accommodating therein a portion of the film fed out by said feeding unit from the loading section and developing the portion with a processing liquid.

4. A photosensitive material processing apparatus comprising:

a first loading section for loading a first film container accommodating a film which is wound around a spool shaft from one edge section in the longitudinal direction thereof with the edge section in the longitudinal section thereof separated from the spool shaft for development and which is returned in the separated state to the customer, the film accommodated in the container in the state where the film is wound around the spool shaft, and also for winding up and holding the film from the first film container;

a first feeding unit for feeding out the film wound around in the first loading section from the other edge section of the film in the longitudinal section thereof and holding the film in the state where the edge section of the film in the longitudinal direction thereof is locked in the first loading section;

a second loading section having an insertion/passage port through which a lengthy film wound around a spool shaft is inserted or withdrawn therefrom and for loading therein a second film container accommodating therein the film which is returned to the customer in the state where the film has been wound around the spool shaft from one edge section of the film in the longitudinal direction thereof, the film accommodated there in the state where the film has been wound up around the spool shaft;

a second feeding unit for feeding out the film, starting from the other edge section of the film in the longitudinal direction thereof, from inside of the second film container loaded in the second loading section and also for maintaining the state wherein the one edge section of the film in the longitudinal direction thereof is locked on the spool shaft;

a single processing tank having a film insertion port and for accommodating therein the film's portion fed out from the first loading section or second loading section and developing the film with a developing liquid; and a moving unit for moving the other edge section of the film wound into the first loading section in the longitudinal direction thereof to a position opposite to a film insertion port of the processing tank and also moving an insertion/passage port of the second film container loaded in the second loading section to the film insertion port of the processing tank.

5. A photosensitive material processing apparatus comprising:

a first loading section for loading a first film container accommodating a film which is wound around a spool shaft from one edge section in the longitudinal direction thereof with the edge section in the longitudinal section thereof separated from the spool shaft for development and which is returned in the separated state to the customer, the film accommodated in the container in the state where the film is wound around the spool shaft, and also for winding up and holding the film from the first film container;

a first feeding unit for feeding out the film wound around in the first loading section from the other edge section of the film in the longitudinal section thereof and holding the film in the state where the edge section of the film in the longitudinal direction thereof is locked in the first loading section;

a second loading section having an insertion/passage port through which a lengthy film wound around a spool shaft is inserted or withdrawn therefrom and for loading therein a second film container accommodating therein the film which is returned to the customer in the state where the film has been wound around the spool shaft from one edge section of the film in the longitudinal direction thereof, the film accommodated there in the state where the film has been wound up around the spool shaft;

a second feeding unit for feeding out the film, starting from the other edge section of the film in the longitudinal direction thereof, from inside of the second film container loaded in the second loading section and also for maintaining the state wherein the one edge section of the film in the longitudinal direction thereof is locked on the spool shaft;

a first processing tank provided at a position opposite to the other edge section of the film wound into said first loading section in the longitudinal direction thereof and for accommodating therein a portion of the film fed out by said first feeding unit from said first loading section and developing the film with a developing liquid; and a second processing tank provided at a position opposite to an insertion/passage port of said second film container loaded in said second loading section and accommodating therein a portion of said film fed out by said second feeding unit from said second loading section and developing the film with a developing liquid.

6. A photosensitive material processing apparatus comprising:

a single shared loading section for loading therein a first film container accommodating said first film which is wound up around a first spool shaft from one edge section of the film in the longitudinal direction thereof with the one edge section of the film in the longitudinal direction thereof separated from said first spool shaft and is returned to the customer in the separated state, said first film stored therein in the state where the film has been wound up around said first spool shaft, and also a second film container having an insertion/passage port from which a second lengthy film wound around a second spool shaft is inserted and withdrawn therethrough and is returned to the customer in the state where the film has been wound around said second spool shaft from an edge section of said second film in the longitudinal direction thereof, said second film accommodated therein in the state where said second film has been wound around said second spool shaft;

a linkage unit for linkage to said second spool shaft; and a rotation driving unit for rotating said second spool shaft through said linkage unit.

7. The photosensitive material processing apparatus according to claim 6 comprising:

a feeding unit for moving said linkage unit to a position opposite to said second spool shaft and engaging said linkage unit therein; and a retaining unit linked to said feeding unit and for positioning said second film container in association with movement of said moving unit and retaining the moving unit there.

8. A photosensitive material processing apparatus according to claim 6; wherein said linkage unit comprises an intermediate spool shaft for retaining one edge of said first film withdrawn out from said first film container loaded in said loading section in the longitudinal direction thereof and also winding up said first film from the one edge section of the film in the longitudinal direction thereof up to the other edge section in the longitudinal direction thereof from said first film container.

9. The photosensitive material processing apparatus according to any of claims 6 to 8 comprising:

a cutting unit for cutting, when said first film in said first film container loaded in said loading section has been wounded into said loading section, the other edge section of said first film in the longitudinal direction thereof;

a feeding unit for feeding out said first film from one edge section of said first film set in said loading section in the longitudinal section thereof or from the other edge section of the second film in the longitudinal section thereof and holding the film in the state where the one edge section of the film in the longitudinal section thereof is locked in said loading section; and a single shared processing tank having a film insertion port and for accommodating a portion of said first film and a portion of said second film, in the state where the other edge section of said first film wound up in said loading section or an insertion/passage port of said second film container loaded in said loading section is positioned at a position opposite to a film insertion port of said processing tank and developing the portions of the first and second films fed out by said feeding unit from said film insertion portion.

10. The photosensitive material processing apparatus according to claims 6 comprising:

cutting unit for cutting, after said first film in said firs film container loaded in said loading section has been wound up into said loading section, the other edge section of said first film in the longitudinal direction thereof;

a feeding unit for feeding out said film from one edge section of said first film in the longitudinal section thereof set in said loading section or the other edge section of said second film in the longitudinal section thereof and holding the film in the state where the edge section of the film in the longitudinal direction thereof is locked in said loading section;

a first processing tank having a film insertion port and also having an internal width dimension corresponding to a width of said first film and for accommodating a portion of said first film fed out from said feeding unit from said loading section and developing the film with a processing liquid;

a second processing tank having a film insertion port and also having an internal width dimension corresponding to a width of said second film and for accommodating a portion of said second film fed out by said feeding unit from said loading section and developing the film with a developing liquid; and a moving unit for moving either one of said loading section of said first processing tank to position the other edge section of said first film to a position opposite to the film insertion port of said first processing tank and also moving either one of said loading section and said second processing tank to position an insertion/passage portion of said second film container to a position opposite to the film insertion port of said second processing tank.

11. The photosensitive material processing apparatus according to claim 9 comprising:

a processing solution supply unit for circulating, replacing, and discharging a processing solution in said processing tank.

12. The photosensitive material processing apparatus according to claims 9 comprising:

an image data recording unit for recording images formed in said firs film as well as on said second film.

13. A development processing apparatus comprising:

a first loading section for loading therein a first film container accommodating therein a first film which is wound around a spool shaft from one edge section of the film in the longitudinal direction thereof with the one section of the film in the longitudinal section thereof separated from said spool shaft and is returned to the customer in the separated state, said first film accommodated therein in the state where the first film has been wound around said spool shaft and also winding up and retaining said first film from said first film container;

a second loading section having an intermediate spool shaft for retaining one edge section of said first film withdrawn from said first film container loaded in said loading section and winding up said first film, starting from said one edge section of said first film in the longitudinal section thereof up to the other section of the film in the longitudinal section thereof, from said first film container;

a third loading section for loading therein a second film container having a insertion/passage port through which a lengthy second film wound up around a spool shaft is inserted or withdrawn therefrom and accommodating said second film returned to the customer in the state where said second film has been wound around said spool shaft;

a feeding unit for feeding out said first film wound around an intermediate spool shaft in said second loading section or said second film in said second film container in said third loading section from the other edge section of said second film in the longitudinal direction thereof and also holding the film in the state where said one edge section in the longitudinal section thereof is loaded on said intermediate spool shaft or said spool shaft; and a processing tank for accommodating therein a portion of said film fed out by said feeding unit from said second loading section or said third loading section and developing the film with a developing liquid.

14. A photosensitive material processing apparatus according to claim 13 comprising:

a pulling unit for pulling said first film or said second film fed out by said feeding unit from said second loading section and said third loading section respectively holding one edge section of the film in the longitudinal direction thereof into said processing tank.

15. A photosensitive material processing apparatus according to claim 13 comprises a cutting unit for cutting, after said first film in said first film container loaded in said first loading section has been wound around said intermediate spool shaft in said second loading section, the other edge section of said film in the longitudinal direction thereof.

* * * * *